US011674508B2

(12) United States Patent
Turner et al.

(10) Patent No.: US 11,674,508 B2
(45) Date of Patent: Jun. 13, 2023

(54) HIGH-THROUGHPUT DIAPHRAGM COMPRESSOR

(71) Applicant: PDC MACHINES, INC., Warminster, PA (US)

(72) Inventors: Chris Turner, Windsor, CO (US); Guy Babbitt, Fort Collins, CO (US); Alex Beckerman, Tuscon, AZ (US); Bryce Whitehill, Fort Collins, CO (US); Garrett Casassa, Fort Collins, CO (US)

(73) Assignee: PDC Machines Inc., Warminster, PA (US)

( * ) Notice: Subject to any disclaimer, the term of this patent is extended or adjusted under 35 U.S.C. 154(b) by 0 days.

(21) Appl. No.: 17/840,948

(22) Filed: Jun. 15, 2022

(65) Prior Publication Data

US 2023/0147328 A1 May 11, 2023

Related U.S. Application Data

(60) Provisional application No. 63/277,125, filed on Nov. 8, 2021.

(51) Int. Cl.
*F04B 45/053* (2006.01)
*F04B 45/04* (2006.01)
(Continued)

(52) U.S. Cl.
CPC ..... *F04B 45/0533* (2013.01); *F04B 45/043* (2013.01); *F04B 45/053* (2013.01);
(Continued)

(58) Field of Classification Search
CPC .... F04B 45/0533; F04B 45/043; F04B 53/06; F04B 53/14; F04B 2201/0201; F04B 2201/0202; F04B 2205/05
See application file for complete search history.

(56) References Cited

U.S. PATENT DOCUMENTS 4,213,298 A 7/1980 Milgram
4,381,180 A * 4/1983 Sell ..... F04B 43/0736 417/393

(Continued)

FOREIGN PATENT DOCUMENTS

CN 205654517 U 10/2016

OTHER PUBLICATIONS

International Search Report and Written Opinion for PCT/US22/33565 dated Sep. 13, 2022.

(Continued)

*Primary Examiner* — Dominick L Plakkoottam
(74) *Attorney, Agent, or Firm* — Reed Smith LLP; Matthew P. Frederick; Travis J. Sumpter

(57) ABSTRACT

Devices and methods for operating a diaphragm compressor system provide high output pressure and high throughput. In some embodiments, modular diaphragm compressors are stacked with a clamping mechanism pressing the compressor modules together. In embodiments, multiple stacks are provided as stages of a pressurization process. In embodiments, a main stage valve controls one or more pressure circuits for one or more hydraulic actuators of compressor modules. In embodiments, orifices configured for damping are incorporated to control actuator piston movement within a compressor module.

20 Claims, 28 Drawing Sheets

(51) Int. Cl.
*F04B 53/06* (2006.01)
*F04B 53/14* (2006.01)

(52) U.S. Cl.
CPC ..... *F04B 53/06* (2013.01); *F04B 53/14* (2013.01); *F04B 2201/0201* (2013.01); *F04B 2201/0202* (2013.01); *F04B 2205/05* (2013.01)

(56) References Cited

U.S. PATENT DOCUMENTS 4,450,685 A * 5/1984 Corey ..... F02G 1/0435 60/520
4,854,832 A * 8/1989 Gardner ..... F04B 43/0736 417/393
5,020,974 A * 6/1991 Searle ..... F04B 25/04 91/310
5,326,234 A * 7/1994 Versaw ..... F01L 25/063 417/393
6,004,105 A 12/1999 Reynolds
11,174,854 B2 * 11/2021 Hines ..... F04B 49/20
2010/0186433 A1 7/2010 Galante et al.
2013/0101445 A1 * 4/2013 Schutze ..... F04B 43/073 417/395
2015/0004003 A1 * 1/2015 Roberts ..... F04B 49/22 417/384
2015/0285238 A1 * 10/2015 Lynn ..... F04B 53/16 417/274
2017/0009760 A1 * 1/2017 Lutz ..... F04B 43/0736

OTHER PUBLICATIONS

International Search Report and Written Opinion for PCT/US22/33570 dated Sep. 21, 2022.
International Search Report and Written Opinion for PCT/US22/33574 dated Sep. 21, 2022.

* cited by examiner

HIGH-THROUGHPUT DIAPHRAGM COMPRESSOR

CROSS-REFERENCE TO RELATED APPLICATIONS

This application claims the benefit under 35 U.S.C. § 119(e) of the earlier filing date of U.S. Provisional Patent Application No. 63/277,125 filed on Nov. 8, 2021, the disclosure of which is incorporated by reference herein.

FIELD OF THE INVENTION

The present invention is directed to diaphragm compressors and modifications for improving reliability and hydraulic efficiency in high-pressure and/or high-throughput applications.

BACKGROUND OF THE INVENTION

A diaphragm compressor actuates a diaphragm at high speed to pressurize a process gas. Although some modern applications require process gas at high pressures and/or in large tanks, a conventional diaphragm compressor system is limited by physical constraints, for example the compressor head volume, speed of operation, actuation force, material strength, and the like.

SUMMARY OF THE INVENTION

A feature and benefit of embodiments is a diaphragm compressor system, comprising a plurality of compressor modules mounted in a stack configuration, and a clamping mechanism configured to apply a clamping force to the first and second compressor head of each compressor module of the plurality of compressor modules. Each compressor module comprises a first compressor head, a second compressor head, and a hydraulic drive. Each of the first and second compressor heads comprises a head cavity and a diaphragm mounted in the head cavity and dividing the head cavity into a work oil region and a process gas region. The diaphragm is configured to actuate from a first position to a second position during a discharge cycle to pressurize process gas in the process gas region from an inlet pressure to a discharge pressure, and discharge the pressurized process gas through the respective compressor head. The diaphragms of the first and second compressor heads of each compressor module are centered on a compressor axis. The hydraulic drive is configured to pressurize work oil and provide the pressurized work oil to the first and second compressor heads. The hydraulic drive comprises: a hydraulic power unit configured to provide a variable-pressure supply of work oil to the hydraulic drive, a plurality of pressure circuits comprising: a first pressure circuit of work oil at a first pressure, and a second pressure circuit of work oil at a second pressure, a first diaphragm piston, wherein a first variable volume region is defined between the first diaphragm piston and the diaphragm of the first compressor head, and a second diaphragm piston, wherein a second variable volume region is defined between the second diaphragm piston and the diaphragm of the second compressor head. During a discharge cycle of a compressor head, the hydraulic power unit is configured to drive the respective diaphragm piston toward the corresponding diaphragm compressor head, intensifying the work oil in the respective variable volume region to an intensified pressure, and actuating the diaphragm to the second position. The clamping mechanism is configured to apply a clamping force to the first and second compressor head of each compressor module of the plurality of compressor modules, the clamping mechanism comprising a base plate and an end plate configured to be compressed on opposing sides of the plurality of compressor modules. The clamping mechanism is configured to increase a distance between the base plate and the end plate in response to thermal expansion of one or more compressor modules of the plurality of compressor modules, and the clamping mechanism is configured to apply the clamping force parallel to the compressor axis.

In embodiments, each compressor head comprises a work oil head support plate and a process gas head support plate, wherein the clamping force of the clamping mechanism is configured to clamp together each work oil head support plate with the respective process gas head support plate for each compressor module of the plurality of compressor modules.

In embodiments, the plurality of compressor modules are in a staged configuration configured to discharge process gas at a first pressure and a second pressure, and wherein the system is configured to provide the discharged process gas at the first pressure from the first compressor head of the first compressor module of the plurality of compressor modules as an inlet supply of process gas to another compressor head of the system.

In embodiments, one or more of the compressor modules of the plurality of compressor modules comprises a bypass check valve configured to bypass process gas past the respective compressor module In embodiments, each compressor module comprises the first compressor head outputting process gas at a first pressure and the second compressor head outputting process gas at a second pressure, and wherein the system is configured to provide the discharged pressurized process gas from the first compressor head as an inlet supply of process gas to the second compressor head.

In embodiments, the plurality of compressor modules comprises four compressor modules. In embodiments, the four compressor modules are configured to provide four sequential stages of increasing process gas pressurization.

In embodiments, the four compressor modules comprise a first compressor module configured to output pressurized process gas of at least 50 bar, a second compressor module configured to output pressurized gas of at least 200 bar, a third compressor module configured to output pressurized gas of at least 600 bar, and a fourth compressor module configured to output pressurized gas of at least 800 bar.

In embodiments, the clamping mechanism connects the base plate and the end plate by at least one of: at least two tie rods and a reactionary frame.

In embodiments, the clamping mechanism comprises: one or more tie rods, and at least one of a plurality of pretensioning nuts and a plurality of Belleville spring washers. The clamping mechanism is configured to provide a pretension load on at least one of the base plate and the end plate.

In embodiments, the clamping mechanism further comprises a clamp actuator configured to provide a dynamic clamping force to the plurality of compressor modules.

In embodiments, the clamping mechanism comprises: a plurality of tie rods and a plurality of tensioner nuts.

In embodiments, the hydraulic drive of each compressor module further comprising an actuator piston defining an actuator axis, wherein the actuator piston is configured to move along the actuator axis to drive the diaphragm pistons.

In embodiments, the compressor axis and the actuator axis are coaxial. In embodiments, the compressor axis and the actuator axis are not coaxial.

In embodiments, each compressor module of the plurality of compressor modules is configured to be selectively deactivated, wherein, when a compressor module of the plurality of compressor modules is deactivated, the compressor system is configured to operate the remaining compressor modules of the plurality of compressor modules.

In embodiments, the hydraulic drive of each compressor module comprises: the first pressure circuit comprising a low-pressure circuit, the second pressure circuit comprising a medium-pressure circuit, and a third pressure circuit comprising a high-pressure circuit of work oil at a third pressure, and the medium-pressure circuit comprising a first main stage valve and the high-pressure circuit comprising a second main stage valve, each main stage valve configured to control the flow of work oil to or from the hydraulic drive, and each main stage valve configured to control the flow of work oil to selectively drive at least two compressor heads of the compressor system.

In embodiments, the hydraulic drive of each compressor module further comprising an actuator piston configured to drive the diaphragm pistons, and the first main stage valve configured to control a flow of the medium-pressure circuit to or from either side of the actuator piston, and the second main stage valve configured to control a flow of high-pressure work oil to either side of the actuator piston.

In embodiments, the hydraulic power unit is configured to supply work oil from one or more pressure circuits of the plurality of pressure circuits to each hydraulic drive of two or more compressor modules of the plurality of compressor modules.

A feature and benefit of embodiments is a method of pressurizing a process gas, comprising: providing the diaphragm compressor system of above as a first stage; providing a second of the diaphragm compressor system of above as a second stage, wherein the second stage is configured to provide a higher maximum outlet pressure than the first stage; operating a low-pressure efficient mode, filling the tank with pressurized process gas from each of the first and second stages; and operating a high-pressure mode with the first and second stages in series. The low-pressure efficient mode, comprises: shutting off or bypassing the second stage, supplying a process gas at an inlet pressure to the first stage, filling a tank with pressurized process gas from the first stage. The operating a high-throughput mode with the first and second stages in parallel comprises: supplying a process gas at an inlet pressure to each of the first and second stages, and filling the tank with pressurized process gas from each of the first and second stages. The operating a high-pressure mode with the first and second stages in series comprises: supplying a process gas at an inlet pressure to the first stage, supplying pressurized process gas from the first stage to the second stage.

A feature and benefit of embodiments is a compressor system, comprising: a plurality of compressor modules mounted in a stack configuration, a clamping mechanism configured to apply a clamping force to the compressor head of each compressor module of the plurality of compressor modules, and a tank configured to retain pressurized process gas that is discharged from one or more of the compressor modules of the plurality of compressor modules. Each compressor module comprises a compressor head and a hydraulic drive. The compressor head comprises a head cavity and a diaphragm mounted in the head cavity and dividing the head cavity into a work oil region and a process gas region. The diaphragm is configured to: actuate from a first position to a second position during a discharge cycle to pressurize process gas in the process gas region from an inlet pressure to a discharge pressure, and discharge the pressurized process gas through the respective compressor head. The hydraulic drive is configured to pressurize work oil and provide the pressurized work oil to the compressor head. The hydraulic drive comprises: a hydraulic power unit configured to provide a variable-pressure supply of work oil to the hydraulic drive, and a plurality of pressure circuits comprising: a first pressure circuit of work oil at a first pressure, and a second pressure circuit of work oil at a second pressure. During a discharge cycle of a compressor head, the variable-pressure supply of work oil is configured to drive the respective diaphragm piston toward the corresponding diaphragm compressor head, intensifying the work oil in the variable volume region to an intensified pressure, and actuating the diaphragm to the second position. The clamping mechanism comprises: a base plate and an end plate being compressed on opposing sides of the plurality of compressor modules, and a clamp actuator configured to provide a dynamic clamping force to the plurality of compressor modules. The plurality of compressor modules comprises four compressor modules configured to provide four sequential stages of increasing process gas pressurization.

A feature and benefit of embodiments is a compressor system, comprising: a plurality of compressor modules mounted in a stack configuration and a clamping mechanism. Each compressor module comprises a first compressor head, a second compressor head, a hydraulic power unit, and a plurality of pressure circuits. Each of the first and second compressor heads comprising: a head cavity, and a diaphragm mounted in the head cavity and dividing the head cavity into a work oil region and a process gas region. The diaphragm is configured to: actuate from a first position to a second position during a discharge cycle to pressurize process gas in the process gas region from an inlet pressure to a discharge pressure, and discharge the pressurized process gas through the respective compressor head. The hydraulic power unit is configured to provide a variable-pressure supply of work oil to the first and second compressor heads. The plurality of pressure circuits comprising: a first pressure circuit of work oil at a first pressure, and a second pressure circuit of work oil at a second pressure. During a discharge cycle of a compressor head, the variable-pressure supply of work oil is configured to drive the respective diaphragm toward the corresponding process gas region, intensifying the work oil in the work oil region to an intensified pressure, and actuating the diaphragm to the second position. The clamping mechanism is configured to apply a clamping force to the first and second compressor head of each compressor module of the plurality of compressor modules.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

Another feature and benefit of embodiments is a diaphragm compressor system, comprising a first compressor head and a hydraulic drive. The first compressor head comprises a head cavity and a diaphragm mounted in the head cavity and dividing the head cavity into a work oil region and a process gas region. The diaphragm is configured to actuate from a first position to a second position during a discharge cycle to pressurize process gas in the process gas region from an inlet pressure to a discharge pressure, and discharge the pressurized process gas through the respective compressor head. The hydraulic drive is configured to pressurize work oil and provide the pressurized work oil to the compressor head. The hydraulic drive comprises a drive housing and an actuator piston. The drive housing comprises a drive cavity, a plurality of ports, a first plurality of orifices in communication with both the drive cavity and one or more ports of the plurality of ports, a second plurality of orifices in communication with both the drive cavity and one or more ports of the plurality of ports, and a piston subassembly. The plurality of ports comprises a first distal port and a second distal port, wherein the hydraulic drive is configured to provide a variable-pressure supply of work oil to the drive cavity through one or more of the plurality of ports. The piston subassembly comprises a first diaphragm piston mounted in the drive cavity and comprising a first diameter and an actuator piston located in the drive cavity. A first variable volume region comprises the work oil region of the compressor head and is defined between the first diaphragm piston and the diaphragm of the first compressor head. The actuator piston is located in the drive cavity, the actuator piston dividing the drive cavity into a first actuation volume in communication with the first distal port and the first plurality of orifices and a second actuation volume in communication with the second distal port and the second plurality of orifices. The actuator piston comprises a first side oriented toward the first actuation volume and a second side oriented toward the second actuation volume. During the discharge cycle of the first compressor head: the hydraulic drive is configured to provide the variable-pressure supply of work oil through the second port to the second actuation volume to press against the second side of the actuator piston to drive the actuator piston, driving the first diaphragm piston to actuate the corresponding first compressor head, intensifying the work oil in the first variable volume region to an intensified pressure, and actuating the diaphragm of the first compressor head to the second position, the drive cavity is configured to dampen the driving of the actuator piston due to a volume of work oil in the first actuation volume that vents through the first plurality of orifices during driving of the actuator piston, and the first plurality of orifices is configured to be open to the first actuation volume when the driving of the actuator piston begins, and the plurality of orifices being progressively covered by the actuator piston during the driving, increasing a damping force of work oil remaining in the first actuation volume against the first side of the actuator piston.

In embodiments, the drive housing further comprises a plurality of supplemental orifices in communication with the first actuation volume, the plurality of supplemental orifices being staggered axially relative to the plurality of first orifices, the plurality of supplemental orifices configured to dampen the driving of the actuator piston due to the volume of work oil in the first actuation volume that vents through the plurality of supplemental orifices during driving of the actuator piston.

In embodiments, each of the plurality of supplemental orifices comprise a smaller area than the each of the first plurality of orifices.

In embodiments, the plurality of supplemental orifices are configured to be progressively covered by the actuator piston during the driving, increasing the damping force of work oil remaining in the first actuation volume against the first side of the actuator piston.

In embodiments, the actuator piston is configured to drive in a linear direction along an actuator piston axis, and the first plurality of orifices is formed in one or more surfaces of the drive housing oriented at a non-parallel angle relative to the actuator piston axis.

In embodiments, the plurality of first orifices extend radially away from the drive cavity and the actuator piston.

In embodiments, the diaphragm compressor system further comprises one or more plugs installed in one or more of the first plurality of orifices to increase the damping force of the first actuation volume.

In embodiments, an annular gap is between the actuator piston and the drive housing, the annular gap configured to dampen the driving of the actuator piston by controlling an outflow of work oil in the first actuation volume during the discharge stroke.

In embodiments, the annular gap is configured to dampen the driving of the actuator piston after the first plurality of orifices are obstructed by the actuator piston.

In embodiments, the actuator piston comprises a first internal porting and a first opening in the first side, wherein the first distal port is selectively in fluid communication with the first actuation volume via the first internal porting.

In embodiments, during the discharge cycle of the first compressor head, the work oil in the first actuation volume also vents through the first internal porting of the actuator piston during driving of the actuator piston, wherein the first distal port is configured to receive both the vented work oil from the first plurality of orifices and the vented work oil from the internal porting, and wherein the hydraulic drive is configured to fill an accumulator of the low-pressure circuit from the vented work oil in the first distal port.

In embodiments, a landing orifice operatively connects the first distal port and a first proximal port, the landing orifice configured to control the flowrate of work oil venting through the first internal porting.

In embodiments, a feedback mechanism is configured to determine at least one of a position and velocity of the actuator piston during use.

In embodiments, the actuator piston comprises a variable-geometry portion, and the feedback mechanism comprising a sensor configured to detect a distance from the variable-geometry portion during the driving of the actuator piston.

In embodiments, the feedback mechanism comprises a pressure sensor operatively coupled to process gas in the first compressor head or discharged therefrom, the feedback mechanism configured to determine the velocity of the actuator piston based on the pressure of the discharged process gas.

In embodiments, the first actuation volume is in direct communication with a first proximal port, and the second actuation volume in direct communication with a second proximal port.

In embodiments, the drive housing further comprises a removable sleeve insert, wherein the sleeve insert comprises a first distal annulus in fluid communication between the first actuation volume and the first distal port and a second distal annulus in fluid communication between the second actuation volume and the second distal port.

In embodiments, the sleeve insert further comprises: a first proximal annulus in fluid communication between the first actuation volume and the first proximal port; and a landing orifice operatively connecting the first distal annulus and a first proximal annulus, the landing orifice configured to control the flowrate of work oil venting through the first internal porting.

In embodiments, the first plurality of orifices comprises twelve or more orifices, and wherein the second plurality of orifices comprises twelve or more orifices.

In embodiments, the orifices are in communication with at least one of the ports of the plurality of ports, and the orifices are configured to: during a stroke of the actuator piston toward the corresponding first or second actuation volume of the drive cavity, vent work oil from the same corresponding first or second actuation volume to the at least one of the ports, and during a stroke of the actuator piston in the opposite direction, supply work oil from the at least one of the ports to the drive cavity to pressurize the same corresponding first or second actuation volume.

In embodiments, the diaphragm compressor system further comprises a second compressor head and a second diaphragm piston, wherein, during the discharge cycle of the second compressor head: the hydraulic drive is configured to provide the variable-pressure supply of work oil through the first distal port to the first actuation volume to press against the first side of the actuator piston to drive the actuator piston, driving the second diaphragm piston to actuate the corresponding second compressor head, intensifying the work oil in a second variable volume region to an intensified pressure, and actuating a diaphragm of the second compressor head, the drive housing is configured to dampen the driving of the actuator piston due to a volume of work oil in the second actuation volume that vents through the second plurality of orifices during driving of the actuator piston, and the second plurality of orifices is configured to be open to the second actuation volume when the driving of the actuator piston begins, and the plurality of orifices being progressively covered by the actuator piston during the driving, increasing a damping force of work oil remaining in the second actuation volume against the second side of the actuator piston.

Still another feature and benefit of embodiments is a diaphragm compressor system with main stage valve controlling a hydraulic drive thereof, the diaphragm compressor comprising: a main stage valve and a diaphragm compressor system. The main stage valve comprises: a valve body comprising a first end and a second end, a pilot port proximate the first end, a supply port, a first vent port, a cylinder port, and a pin subassembly comprising a spool, a pilot pin proximate the second end, and a return pin proximate the first end. The pin subassembly is configured to move to a supply position with the supply port in fluid communication with the cylinder port and an end orifice configured to dampen motion of the pin subassembly into the supply position. The pin subassembly is configured to move to a vent position with the cylinder port in fluid communication with the first vent port and a vent damping orifice configured to dampen motion of the pin subassembly into the vent position. The diaphragm compressor system comprises: a first compressor head and a hydraulic drive. The first compressor head comprises: a head cavity, and a diaphragm mounted in the head cavity and dividing the head cavity into a work oil region and a process gas region. The diaphragm is configured to actuate during a discharge cycle to pressurize process gas in the process gas region. The hydraulic drive is configured to pressurize work oil and provide the pressurized work oil to the compressor head, the hydraulic drive comprising: a drive housing, a hydraulic power unit, and a plurality of pressure circuits. The drive housing comprises a plurality of ports and a drive cavity. The plurality of ports comprise a first port and a second port, wherein the hydraulic drive is configured to provide a variable-pressure supply of work oil to the drive cavity through one or more of the plurality of ports. The drive cavity is divided into a first actuation volume in communication with the first port and a second actuation volume in communication with the second port. The plurality of pressure circuits comprise a low-pressure circuit of work oil at a low pressure, and a high-pressure circuit of work oil at a high pressure. During the discharge cycle of the first compressor head: the hydraulic drive is configured to provide the variable-pressure supply of work oil through the second port to the second actuation volume 146, intensifying the work oil in the first variable volume region to an intensified pressure, and actuating the diaphragm of the first compressor head to the second position. The main stage valve is mounted to the drive housing with the cylinder port in fluid communication with the drive cavity and the supply port operatively coupled to the hydraulic power unit, and wherein the main stage valve is configured to selectively move to the supply position to connect the high-pressure circuit to the drive cavity during the discharge cycle of the first compressor head.

In embodiments, during a suction cycle of the first compressor head: the pin subassembly is configured to move to the vent position to connect the drive cavity of the drive housing to the first vent port of the main stage valve, and the hydraulic drive vents work oil from the second actuation volume through the main stage valve.

In embodiments, the low-pressure circuit of the hydraulic drive further comprises a recovered oil accumulator operatively coupled to the first vent port of the main stage valve, the main stage valve configured to supply oil from the drive cavity to the recovered oil accumulator when in the vent position.

In embodiments, the low-pressure circuit comprises the recovered oil accumulator.

In embodiments, the diaphragm compressor system with main stage valve of claim 4, further comprising a passive valve operatively connected to the recovered oil accumulator and the drive cavity. During the suction cycle of the first compressor head, the passive valve is configured to supply oil from the recovered oil accumulator to the drive cavity.

In embodiments, the diaphragm compressor system further comprises: a multi-stage pilot valve mounted in the second end of the valve body, the pilot valve configured to selectively actuate the pin subassembly of the main stage valve. The hydraulic drive further comprises a pilot pressure circuit and a pilot pressure accumulator operatively coupled to the pilot valve.

In embodiments, the pilot pressure circuit is operatively coupled to the pilot port at the first end of the valve body, and the pin subassembly has a larger area proximate the pilot valve than proximate the pilot port and the pin subassembly is configured to move to the supply position when pilot pressure is supplied to the pilot pin through the pilot valve and the pilot port.

In embodiments, a return spring is configured to bias the pin subassembly toward the vent position when pressure is not supplied to the pilot valve.

In embodiments, the main stage supply valve is a first main stage valve operatively coupled to the first actuation volume of the drive cavity, the diaphragm compressor system with main stage valve further comprises a second main stage valve. The second main stage valve is mounted to the drive housing with each of the vent port and the cylinder port in fluid communication with the second actuation volume of the drive cavity and the supply port operatively coupled to the hydraulic power unit. The second main stage valve is configured to selectively move to the supply position to connect the high-pressure circuit to the second actuation volume.

In embodiments, at least one of an actuator and a valve mounted in the second end of the valve body is configured to selectively actuate the pin subassembly of the main stage valve to the supply position.

In embodiments, one or more of the pilot port and the vent damping orifice comprises a plurality of rows of damping orifices comprising a row of relatively larger damping orifices proximate the spool and a row of smaller damping orifices proximate one of the respective first and second end.

In embodiments, the pilot port comprises a ring of removable orifices.

In embodiments, a diaphragm compressor system comprises: a plurality of pressure circuits comprising a medium-pressure circuit and a high-pressure circuit and four or more of the main stage valve described above. The system comprises a first main stage valve configured to selectively supply the high-pressure circuit to the first actuation volume and vent work oil from the first actuation volume, a second main stage valve configured to selectively supply the high-pressure circuit to the second actuation volume and vent work oil from the second actuation volume, a third main stage valve configured to selectively supply the medium-pressure circuit to the first actuation volume and vent work oil from the first actuation volume, and a fourth main stage valve configured to selectively supply the medium-pressure circuit to the second actuation volume and vent work oil from the second actuation volume.

In embodiments, the first and second main stage valves are each configured to vent from the respective first or second actuation volume through the respective first vent port to a recovered oil accumulator.

In embodiments, the diaphragm compressor system further comprises a passive valve configured to supply oil from the recovered oil accumulator to the drive cavity during the suction cycle of the first compressor head.

BRIEF DESCRIPTION OF THE DRAWINGS

The invention can be completely understood in consideration of the following detailed description of various embodiments of the invention in connection with the accompanying drawings, in which.

Figure 1:
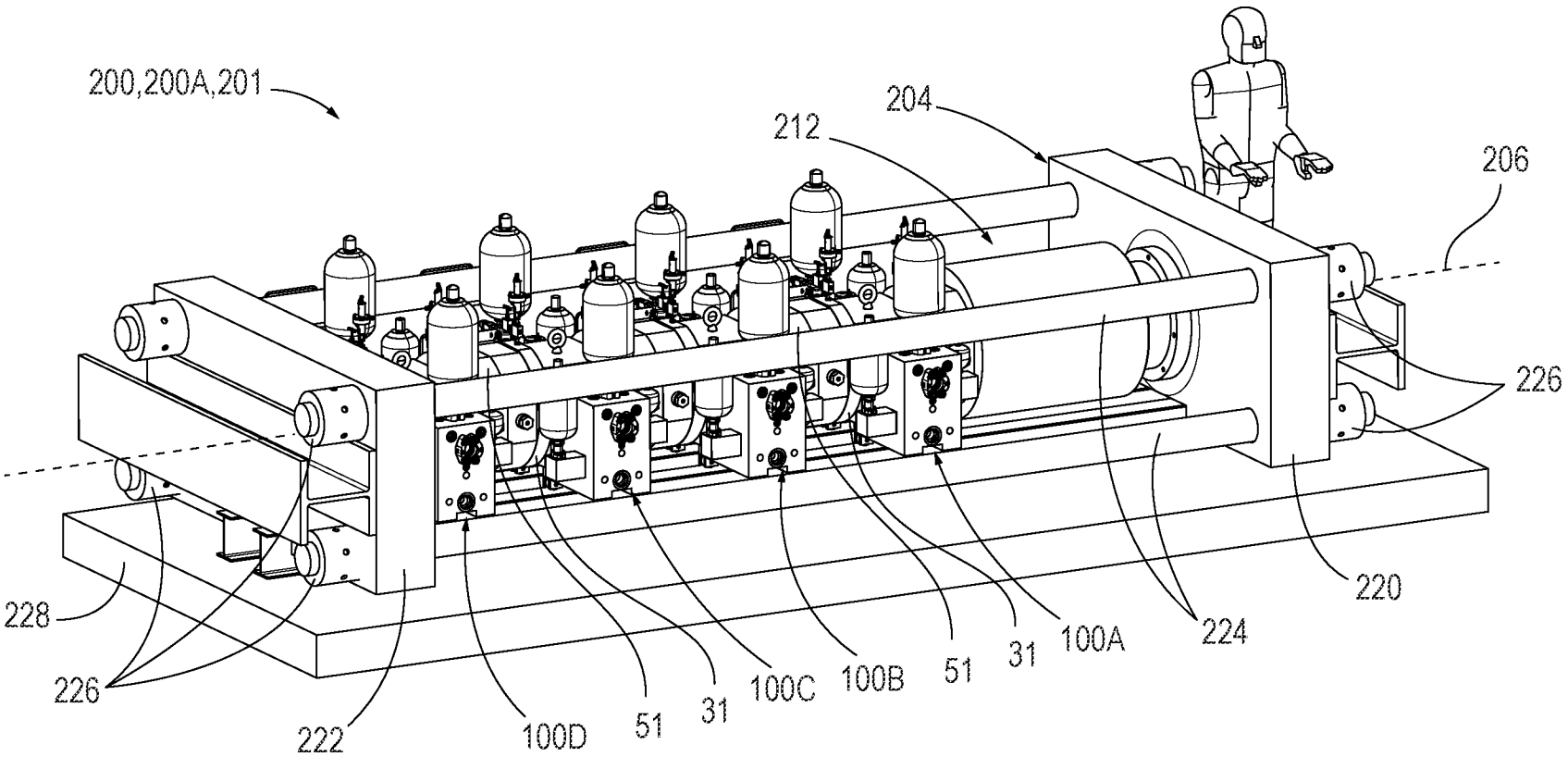
FIG. 1 is a front perspective view of a high-throughput compressor system with stacked compressor modules in accord with embodiments of the present disclosure.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As shown in FIG. 1, in embodiments of the present disclosure, a high-throughput compressor system 200 comprises multiple compressor modules 100, for example compressor modules 100A, 100B, 100C, 100D, collectively referred to as a stack 201 of compressor modules 100. Each compressor module 100 is a diaphragm compressor with one or more compressor heads 31, 51 each having a diaphragm 5.

The process gas may be any gas suitable for pressurization for any use. In embodiments, the process gas is hydrogen. For embodiments designed for filling stations for hydrogen fuel cell vehicles, the required outlet pressure of the high-throughput compressor system 200 may be approximately 10,000-12,000 psi. In embodiments, the target pressure of stored hydrogen in a tank (e.g., at a vehicle filling station) is up to about 14,500 psi to account for pressure losses in, e.g., storage and transfer. Therefore, the corresponding discharge pressure of the process gas from the high-throughput compressor system 200 in such embodiments is about 15,000 psi.

Figure 12:
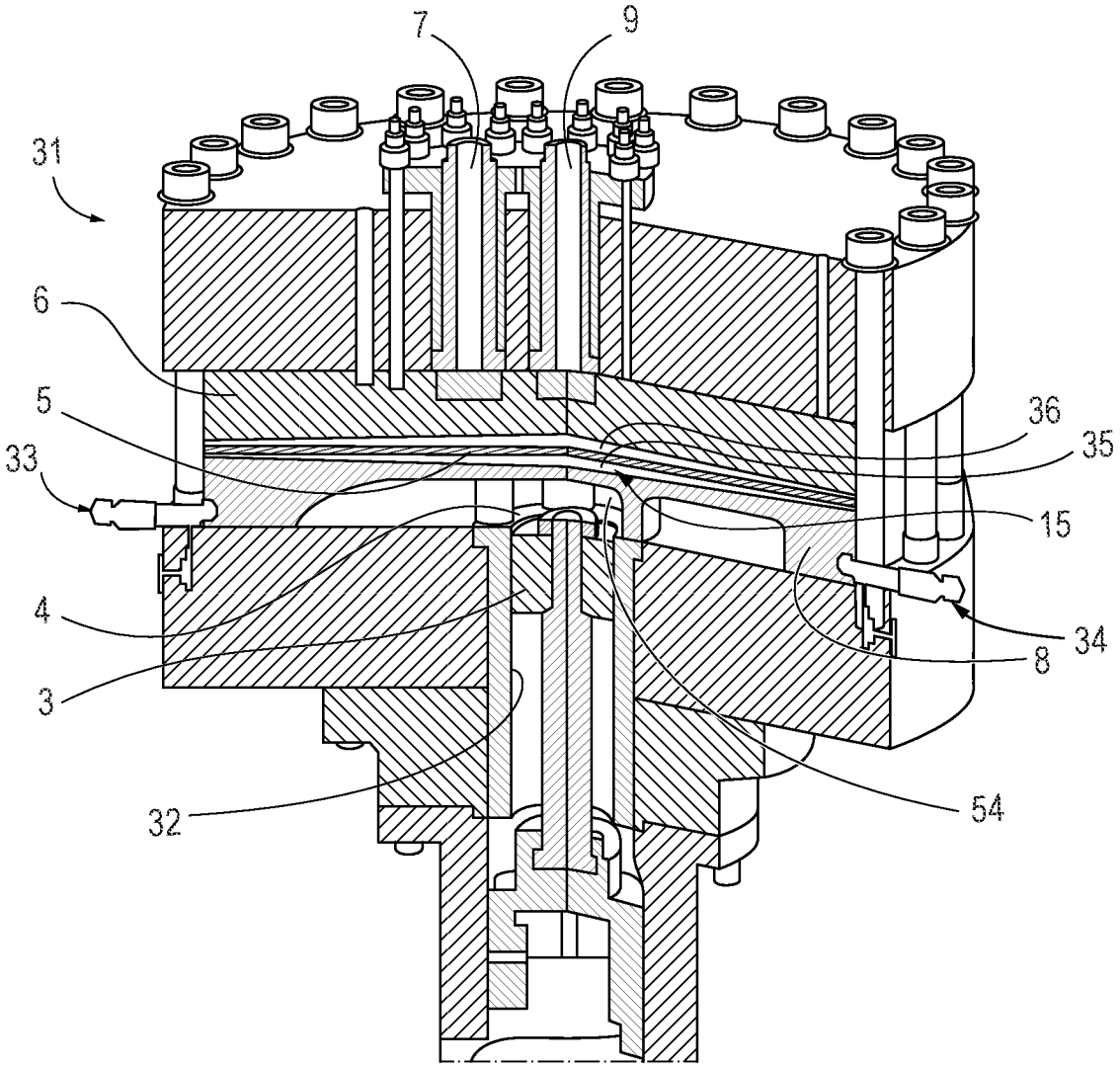
FIG. 12 is a sectional view of a compressor head for a compressor module in accord with embodiments of the present disclosure.
Figure 13:
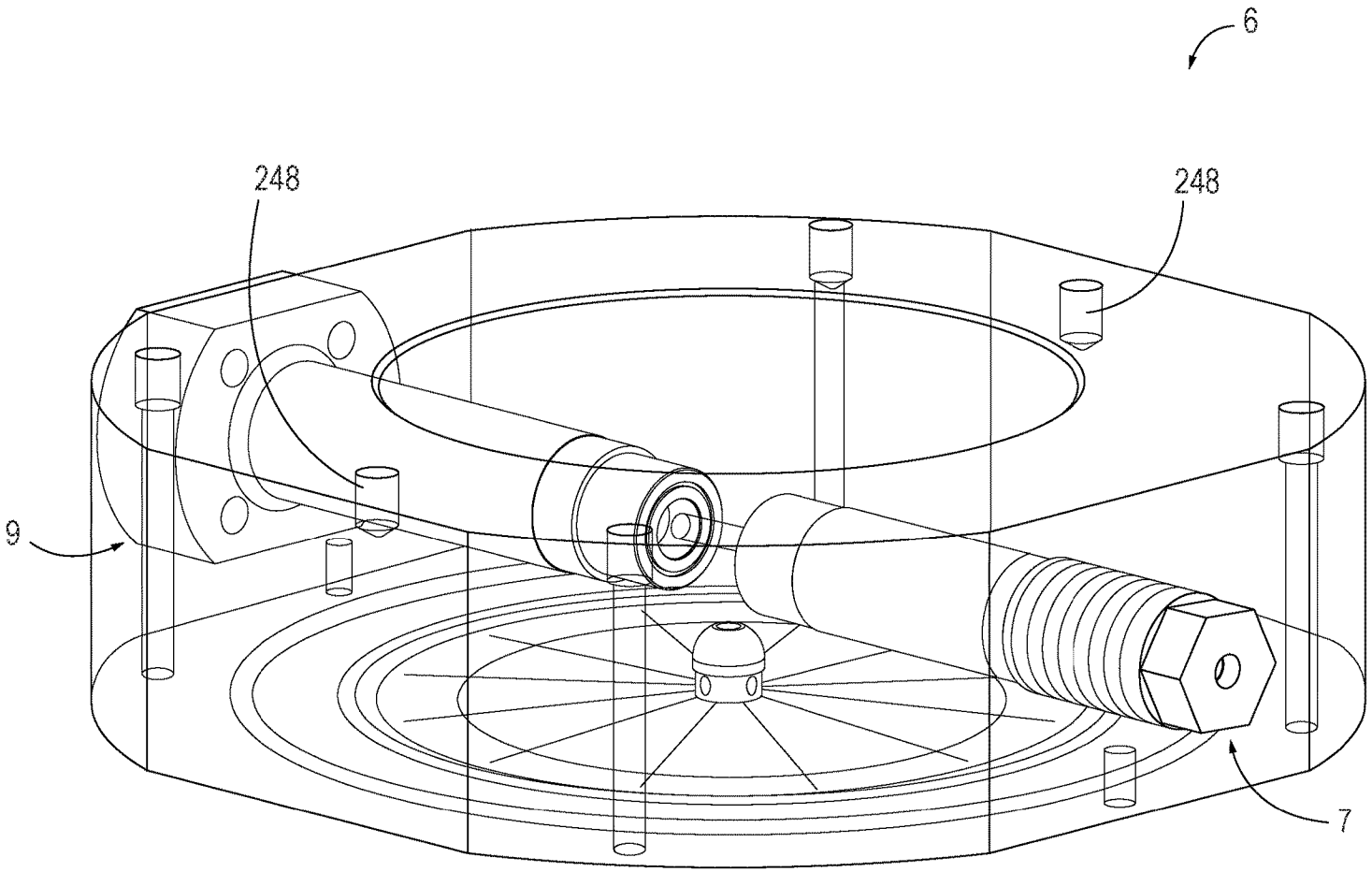
FIG. 13 is a top perspective wireframe view of another compressor head for a compressor module in accord with embodiments of the present disclosure.
Figure 14:
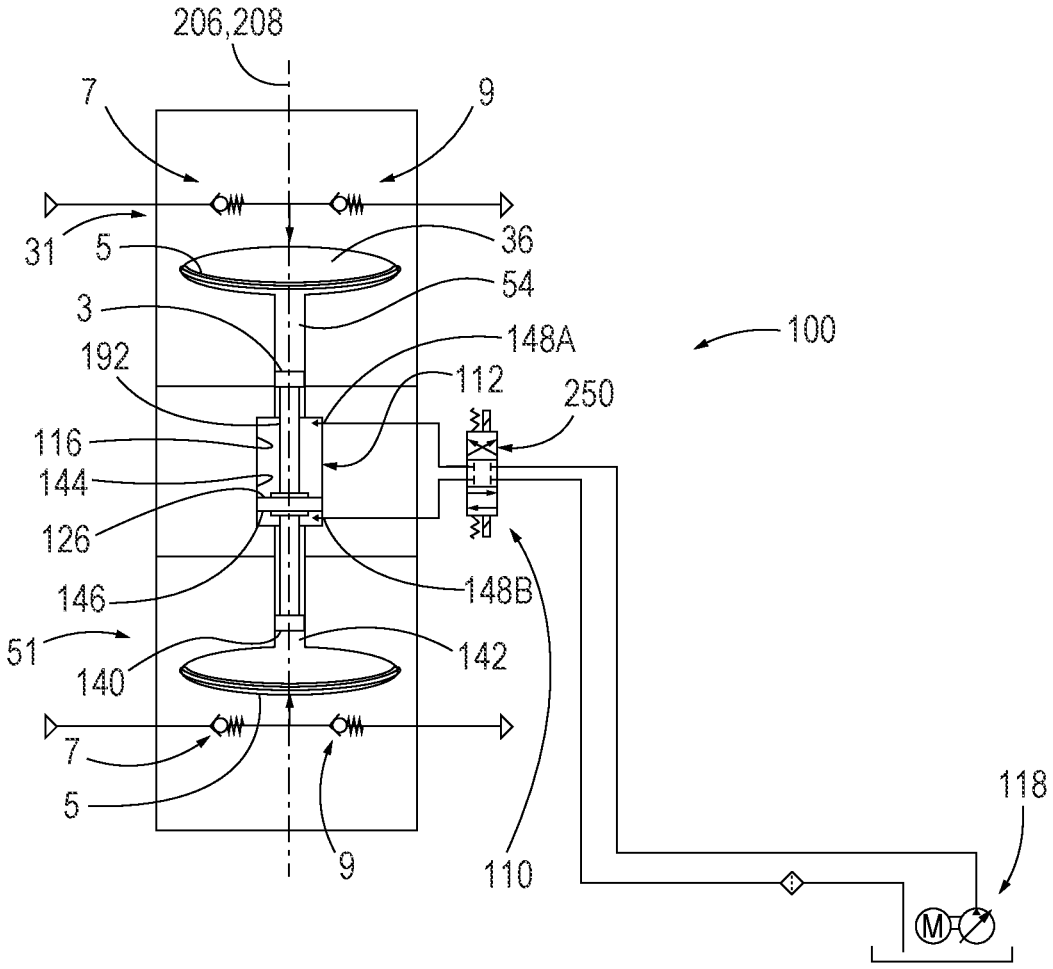
FIG. 14 is a schematic view of a hydraulically-driven compressor module with two compressor heads force coupled in accord with embodiments of the present disclosure.

Diaphragm Compressor Applicable embodiments of the architecture and function of an individual diaphragm compressor 1 are shown in FIGS. 12 and 13 and may be similar to the compressor disclosed in U.S. patent application Ser. No. 17/522,896, the entire contents of which are incorporated herein by reference and for all purposes. Relative to the present disclosure, the compressor 1 in U.S. Ser. No. 17/522,896 constitutes an embodiment of each diaphragm compressor head 31, 51, for example the diaphragm compressor heads of the compressor module 100. Similar diaphragm compressors and related systems are also disclosed in U.S. Provisional Application Nos. 63/111,356 filed Nov. 9, 2020 and 63/277,125 filed on Nov. 8, 2021, and U.S. patent application Ser. No. 17/522,896 filed Nov. 9, 2021, the entire contents of which are incorporated herein by reference and for all purposes.

In embodiments, the diaphragm compressor 1 is driven by a diaphragm piston 3 (also referred to as a high-pressure oil piston) that moves a volume of work oil (i.e., hydraulic fluid) through the compressor 1 suction and discharge cycles. Process gas compression occurs as the volume of work oil is pushed towards the diaphragm 5 by a diaphragm piston 3 to fill a work oil region 35 in a work oil head support plate 8 (or lower plate or oil plate), exerting a uniform force against the bottom of the diaphragm 5. This deflects the diaphragm 5 into an upper cavity in a gas plate 6 that is filled with the process gas, also referred to as a process gas region 36. The deflection of the diaphragm 5 against the upper cavity of gas plate 6 first compresses the process gas and then expels it through an outlet port 9 comprising a discharge check valve. As the oil piston 3 reverses to begin the suction cycle, the diaphragm 5 is drawn downward towards the oil plate 8 while the inlet check valve at the inlet port 7 opens and fills the process gas region 36 with a fresh charge of process gas at an inlet pressure. The diaphragm piston 3 reaches the end of its stroke before beginning its next stroke, and the compression cycle is repeated.

In embodiments, the compressor head 31 comprises a process gas head support plate 6, a work oil head support plate 8, and a diaphragm 5. The process gas head support plate 6 comprises a process gas inlet port 7 operatively connected to an inlet check valve and a process gas outlet port 9 operatively connected to a discharge check valve. In certain embodiments, the work oil head support plate 8 comprises an inlet 33 operatively connected to one or more inlet check valves 45, and an outlet 34 operatively connected to one or more relief valves 42 (inlet check valves and relief valves shown schematically in FIG. 33). A head cavity 15 is defined between the process gas head support plate 6 and the work oil head support plate 8. In certain embodiments, the compressor head 31 comprises a piston bore 32 extending toward the work oil head support plate 8 and sized to receive the diaphragm piston 3. In other embodiments, there is no piston bore 32 and the diaphragm piston 3 is configured to remain substantially within the drive housing 114.

The diaphragm 5 is mounted in the head cavity 15 between the process gas head support plate 6 and the work oil head support plate 8 and divides the head cavity into a work oil region 35 and a process gas region 36. The diaphragm piston 3 defines the volume of the work oil region 35 between a top face of the diaphragm piston 3 and a bottom face of the diaphragm 5. Because the diaphragm piston 3 and diaphragm 5 are dynamic, the volume of the work oil region 35 is variable.

The diaphragm 5 is configured to actuate from a first position proximate the work oil head support plate 8 (e.g., in contact with the work oil head support plate or fully extended toward the work oil head support plate) to a second position proximate the process gas head support plate 6 during a discharge cycle to pressurize process gas in the process gas region 36 from an inlet pressure to a discharge pressure, and discharge the pressurized process gas through the outlet port 9. During a suction cycle of the compressor head 31, the diaphragm 5 is configured to move from the second position to the first position to fill the process gas region 36 with process gas at the inlet pressure. In embodiments, the diaphragm 5 is a diaphragm set comprising a plurality of diaphragm plates sandwiched together and acting in unison, for example two, three, four, or more diaphragm plates may comprise a diaphragm set. In certain embodiments, the diaphragm plates are made from a metal. In other embodiments, the diaphragm plates are made from different metals. In other embodiments, one or more of the diaphragm plates are not made from metal. In certain embodiments, the diaphragm 5 includes three plates, the three plates comprising stainless steel in the outside plates, and brass on the inside plate.

Compressor heads applicable to embodiments of the present disclosure may be provided in any of various sizes and compression ratios. In embodiments, an individual compressor head 31 may be configured for a pressure range of process gas outlet of 200 psi to 15,000 psi. In other embodiments, a compressor head 31 may be configured for a maximum pressure range of 40 psi to 30,000 psi. In still further embodiments, a compressor head 31 may be configured for a pressure range of 300 psi to 45,000 psi. In certain embodiments, the aforementioned compressor heads 31 may be run at pressures below 200 psi, 40 psi, and 300 psi, respectively. In some embodiments, a compressor head 31 can have a compression ratio range of 0.25:1, 1:1, 2:1, 3:1, 4:1, 5:1, 6:1, 10:1, 20:1, and ranges therebetween.

Hydraulically-Driven Compressor Modules Referring to FIGS. 2-8, an embodiment of a compressor module 100 is shown. Applicable embodiments of the architecture and function of the individual compressor module 100 are discussed in U.S. patent application Ser. No. 17/522,896 (therein referred to as a "compressor system"). The compressor module 100 comprises a first compressor head 31 and a second compressor head 51. The compressor module 100 in some embodiments is hydraulically driven by a hydraulic drive 110 that is configured to intensify or pressurize work oil and provide the intensified work oil to the first and second compressor heads 31, 51. In embodiments, the hydraulic drive 110 comprises an actuator 112, a drive housing 114 defining a drive cavity 116, and a hydraulic power unit 118 ("HPU") providing pressurized hydraulic fluid at a pressure, which effectively supplies a pressurized circuit 120 (also referred to broadly as a pressure rail, volume of work oil at a given pressure, or flow of work oil at a given pressure). In embodiments, the hydraulic drive 110 includes one or more pressurized circuits 120 provided by one or more HPUs 118, and in further embodiments, the actuator 112 comprises a piston subassembly 122. In some embodiments, the hydraulic drive 110 is configured to provide a variable-pressure supply of work oil to the drive cavity 116 from one or more of: different pressures of work oil in a one or more pressurized circuits 120, variable areas of components of the piston subassembly 122 (e.g., a variable-area architecture), and/or variable control of the piston subassembly.

Figure 6:
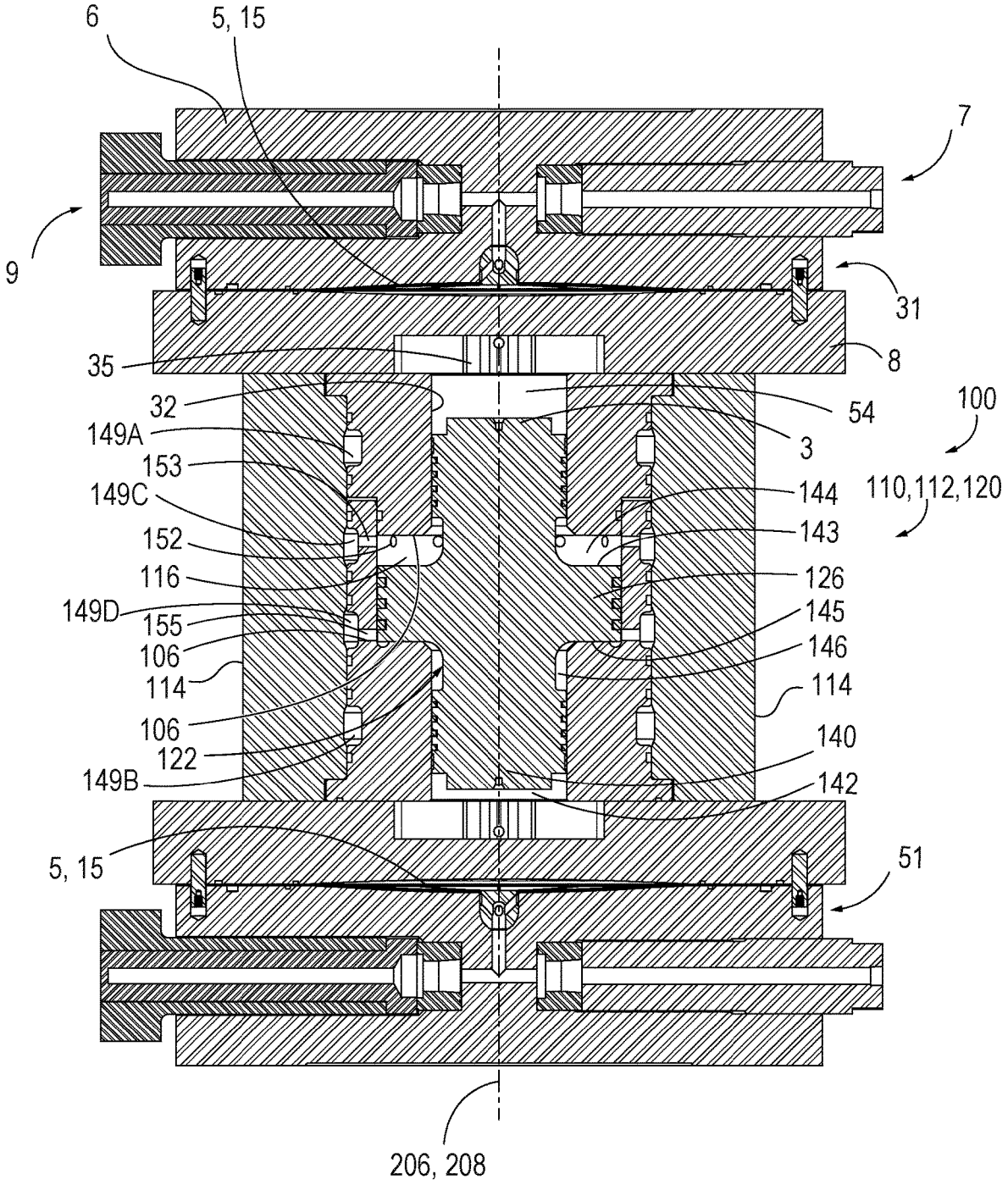
FIG. 6 is top sectional view of the compressor module of FIG. 2.

In certain embodiments, the piston subassembly 122 (e.g. as shown in FIG. 6) comprises the diaphragm piston 3 mounted at least partially in the drive housing 114 and extending into the piston bore 32 (FIG. 6, see also FIG. 12). In some embodiments, the piston bore 32 is formed partially or completely in the drive housing 114 (e.g., FIG. 6). A first variable volume region 54 comprises the work oil region 35 of the compressor head 31 along with the available volume of the piston bore 32; in other words, the first variable volume region 54 is defined between the diaphragm piston 3 and the diaphragm 5 of the corresponding compressor head 31. The piston subassembly 122 comprises an actuator piston 126 located in the drive cavity 116 and coupled (directly or indirectly, for example rigidly coupled, mechanically linked, or hydraulically coupled) to the diaphragm piston 3, the actuator piston defining an actuator piston axis 208. The diaphragm piston 3 is coupled to the actuator piston 126 to move in response to movement of the actuator piston 126. In some embodiments, the diaphragm piston 3 is mechanically rigidly fixed to the actuator piston 126 or, as shown in FIGS. 6-10, formed as a unitary one-piece part with the actuator piston. In other words, the diaphragm piston 3 may be one control area and the actuator piston 126 another control area of the same unitary piston; likewise, a second diaphragm piston 140 (discussed below) may be a third control area.

FIGS. 2-8, 9, and 10-11 illustrate embodiments of a compressor module 100 applicable to the present disclosure that is dual-headed and comprises the compressor head 31 and the second compressor head 51. FIGS. 14-17 schematically illustrate embodiments of the hydraulic drive 110 for a dual-headed compressor module 100, although the hydraulic drive is applicable to a compressor module having any number of heads, for example 1-6 heads. The second compressor head 51 is actuated by a second diaphragm piston 140 defining a second variable volume region 142. In some embodiments, the piston subassembly 122 is mounted in the drive cavity 116 of the drive housing 114 and a plurality of variable volumes are provided between the piston subassembly 122 and the drive housing 114.

Figure 8:
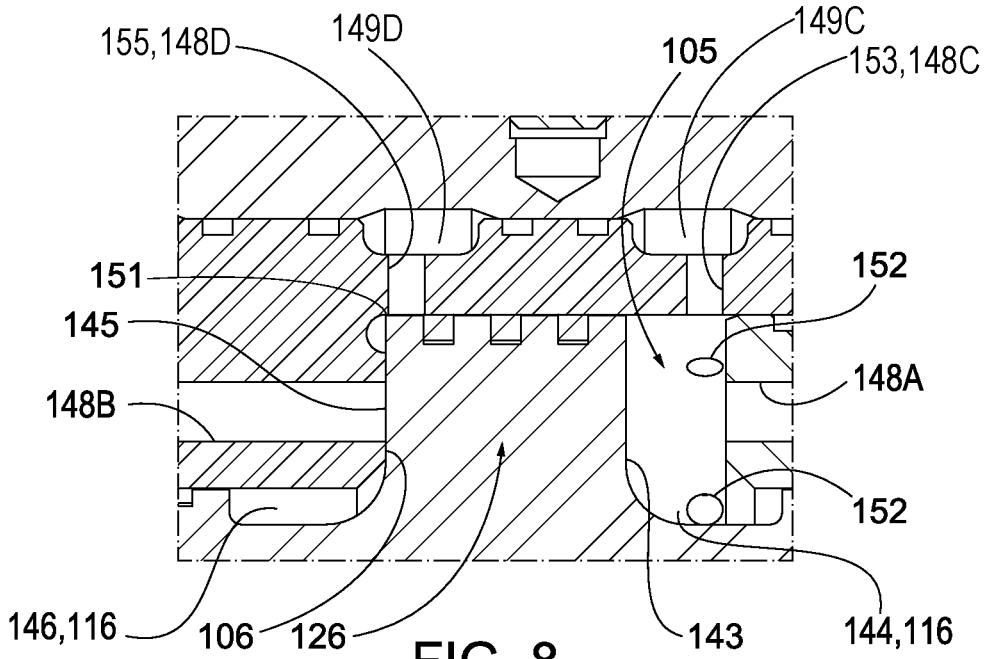
FIG. 8 is an enlarged partial view of FIG. 7.

As shown in FIG. 8, a first actuation volume 144 is defined on the side of the actuator piston 126 proximate the compressor head 31, and a second actuation volume 146 is defined on the opposite side of the actuator piston and proximate the second compressor head 51. Other embodiments may include one, three, or more variable volumes. Due to movement of the piston subassembly 122, the first and second actuation volumes 144, 146 are variable in volume and defined as the volume between the respective first and second sides 143, 145 of the actuator piston 126 and the interior of the respective first and second diaphragm pistons 3, 140. The variable volume is a result of the movement of the actuator piston 126 back and forth. As discussed below, in certain operating states, the first and second actuation volumes 144, 146 also serve a damping function against the actuator piston 126 as it is being driven.

Figure 7:
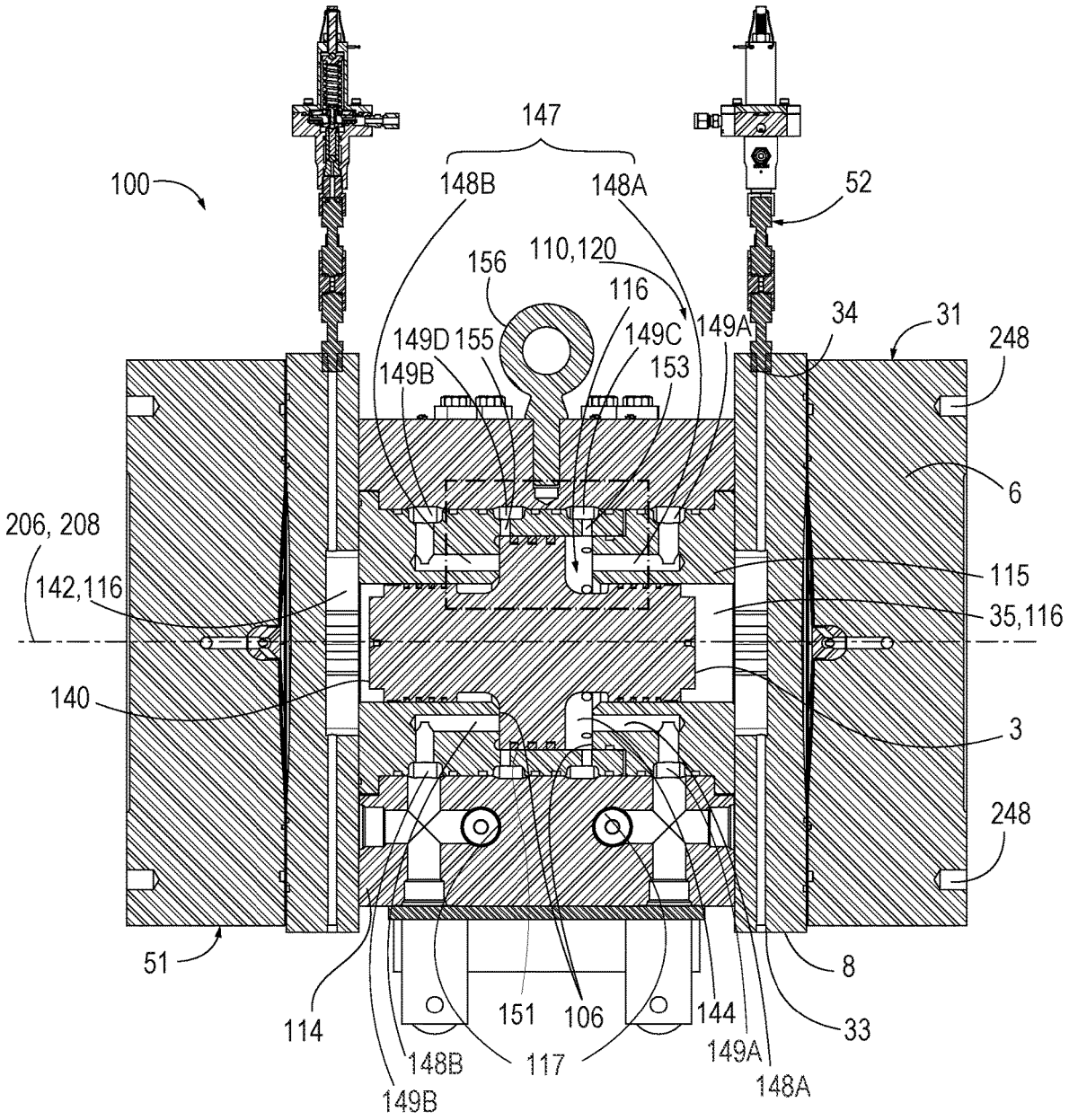
FIG. 7 is side sectional view of the compressor module of FIG. 2.

Referring to FIGS. 6-11, the drive housing 114 also comprises a plurality of ports 147 in communication with the first and second actuation volumes 144, 146. In embodiments, the ports 147 include a first distal port 148A for the first actuation volume 144 and a second distal port 148B for the second actuation volume 146. The hydraulic drive 110 is operatively connected to one or more of these actuator volumes 144, 146 through one or more of the plurality of ports 147. The hydraulic drive 110 is configured to supply work oil or vent work oil as required by the operating conditions of the compressor module 100. In some embodiments, one or more main stage valves 250 ("MSV 250") control the flow of work oil to or from one or more of these ports 147 and thereby control the flow of work oil to or from a respective actuation volume 144, 146 (see, e.g., FIG. 14). It will be appreciated that in embodiments any one or more of the of the plurality of ports 147 may be a plurality of ports arranged around the actuator piston 126, for example the cross-sectional view of FIG. 7 illustrates two each (at top and bottom) of the first and second distal ports 148A, 148B along with two each of the first and second proximal ports 148C, 148D. In certain embodiments, the plurality of first and second distal ports 148A, 148B are arranged around the actuator piston 126. The plurality of first and second distal ports 148A, 148B may be arranged annularly and/or symmetrically about the actuator piston axis 208. In embodiments, the drive housing 114 comprises one or more manifold ports 117 for connecting the plurality of ports 147 to exterior components (e.g., a valve manifold 244 discussed below with reference to FIG. 20).

Figure 16:
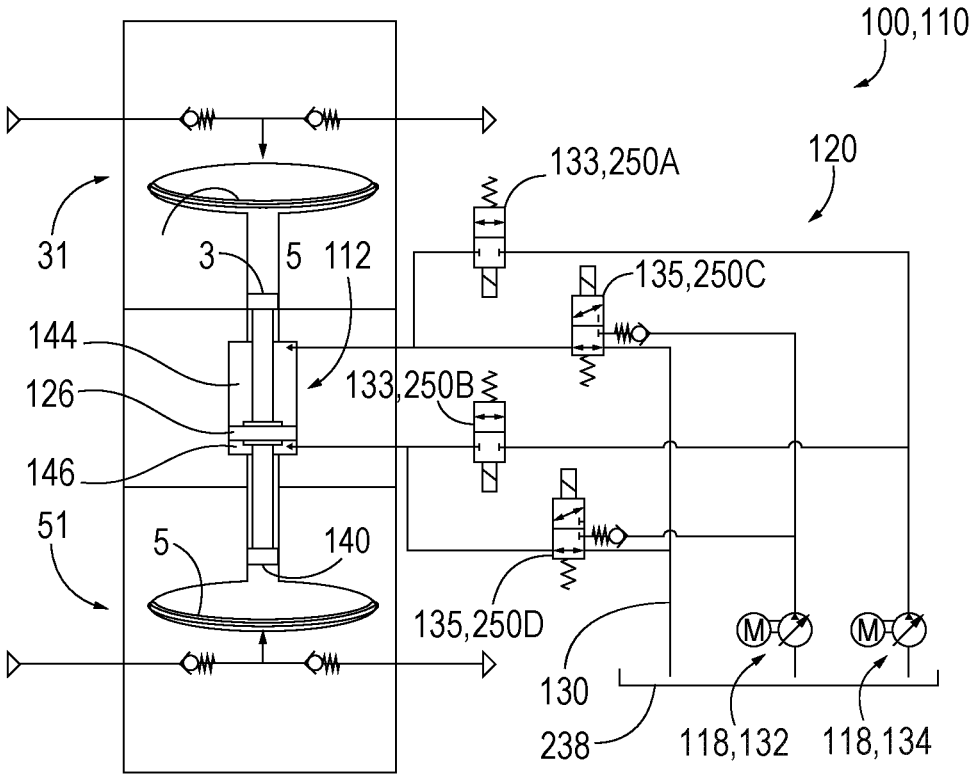
FIG. 16 is a schematic view of a hydraulically-driven compressor module with three pressure rails in accord with embodiments of the present disclosure.

As shown in FIG. 16, in some embodiments, four MSVs 250A-D are provided as two for each of the first and second actuation volumes 144, 146, each MSV corresponding to a pressurized circuit of the one or more pressurized circuits 120. In this embodiment, for the first actuation volume 144, the MSV 250C controls a medium-pressure circuit 132 and the MSV 250A controls a high-pressure circuit 134; for the second actuation volume 146, the MSV 250D controls the medium-pressure circuit 132 and the MSV 250B controls the high-pressure circuit 134. In another sense of this embodiment, each pressure circuit comprises two MSVs 250, one for supplying work oil and one for venting work oil during a piston stroke, with those roles reversed during the opposite stroke. For example, during the discharge stroke of compressor head 31, MSV 250B provides a supply of high pressure work oil through the high-pressure circuit 134, while MSV 250C vents work oil on the other side of the actuator piston 126 out of the first actuation volume 144.

As shown in FIGS. 2-8, in embodiments, the compressor module 100 comprises a first diaphragm compressor head 31 and a second diaphragm compressor head 51 that are each aligned and centered on a compressor axis 206 extending through the center of the diaphragm 5. In certain embodiments, the first diaphragm compressor head 31 and the second diaphragm compressor head 51 are driven by a single hydraulic actuator 114. In some embodiments, the hydraulic actuator 114 is operatively coupled to both the first and second diaphragm compressor heads 31, 51, such that the suction cycle of one compressor head aids in initiating the discharge cycle of the other compressor head, which creates a force couple between the compressor heads as discussed further below.

In certain embodiments, the process gas discharged from a compressor head (e.g., first compressor head 31) is at a relatively low pressure and, for further pressurization, may subsequently be fed into another compressor head, which may be either the second compressor head 51 of the same compressor module 100, or a compressor head 31, 51 of a separate compressor module 100B-D of the same stack 201, or a compressor head 31, 51 of a compressor module of a separate stack for further compression.

Figure 2:
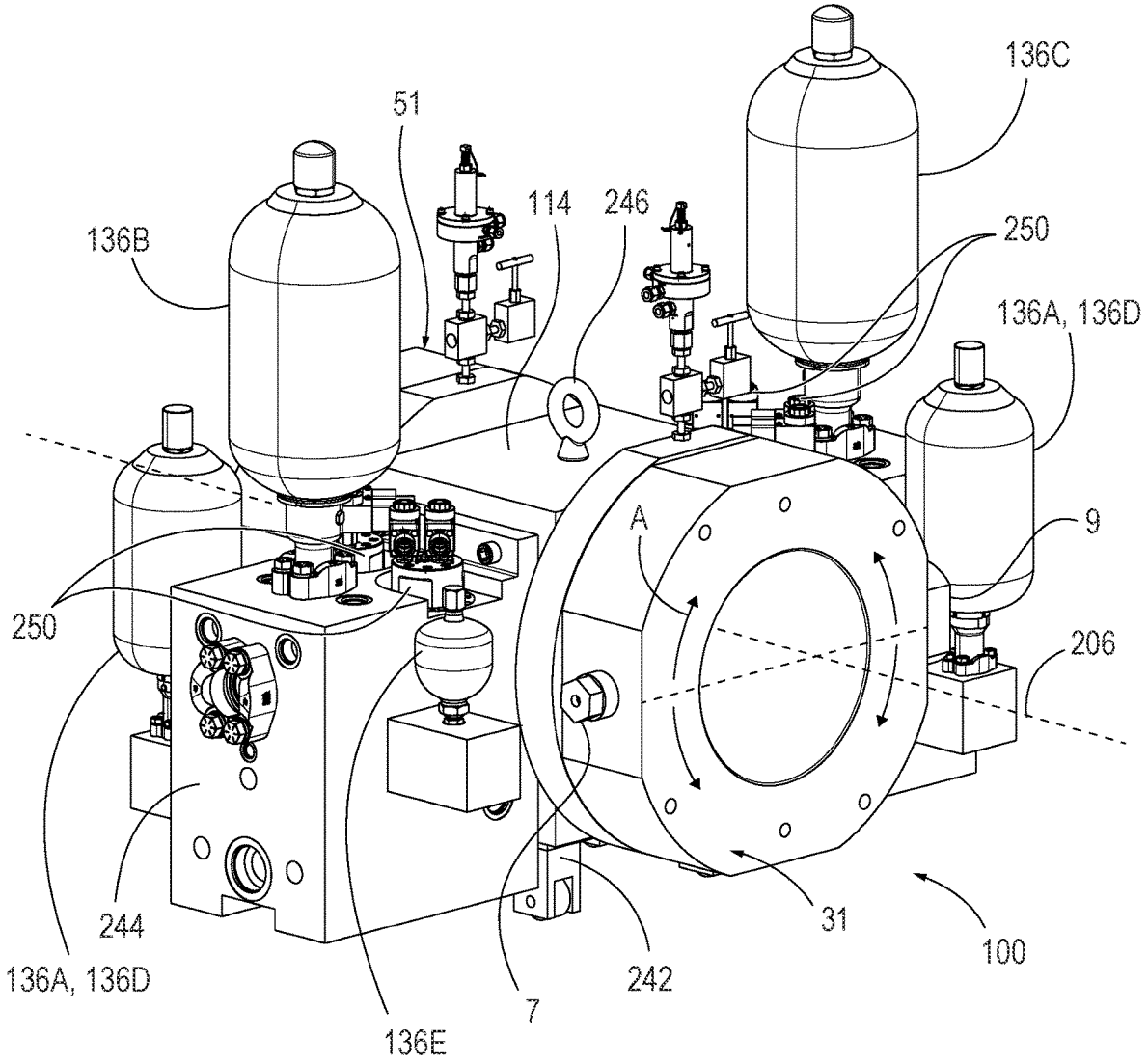
FIG. 2 is a top front perspective view of an embodiment of a compressor module of the system of FIG. 1 in accord with embodiments of the present disclosure.
Figure 3:
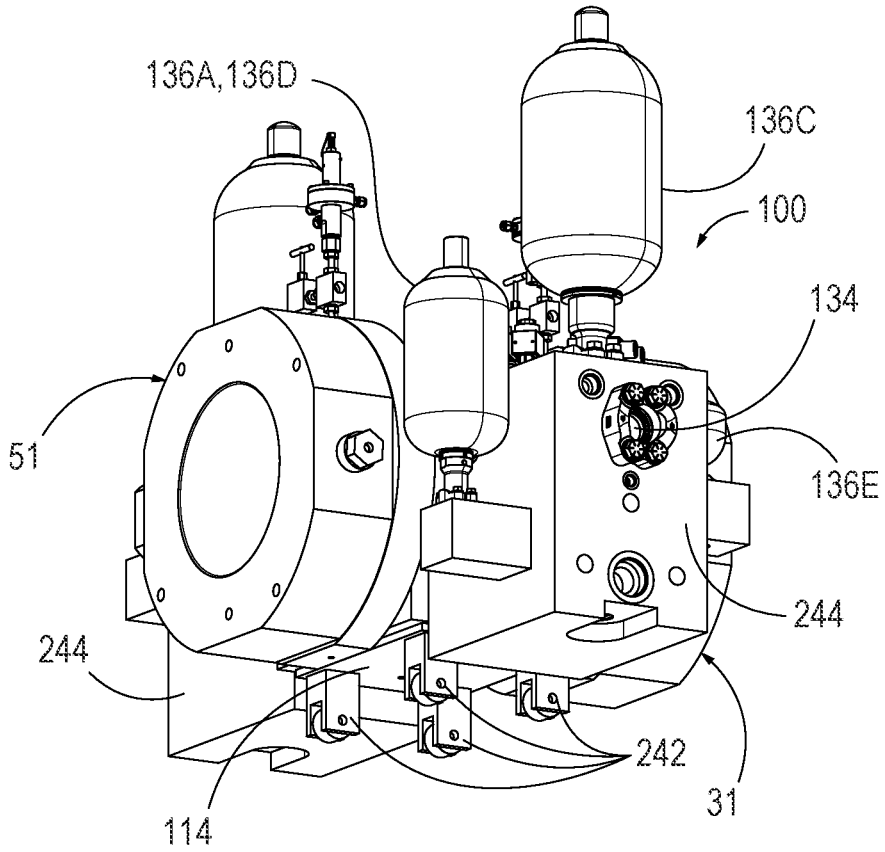
FIG. 3 is a bottom rear perspective view of the compressor module of FIG. 2.
Figure 4:
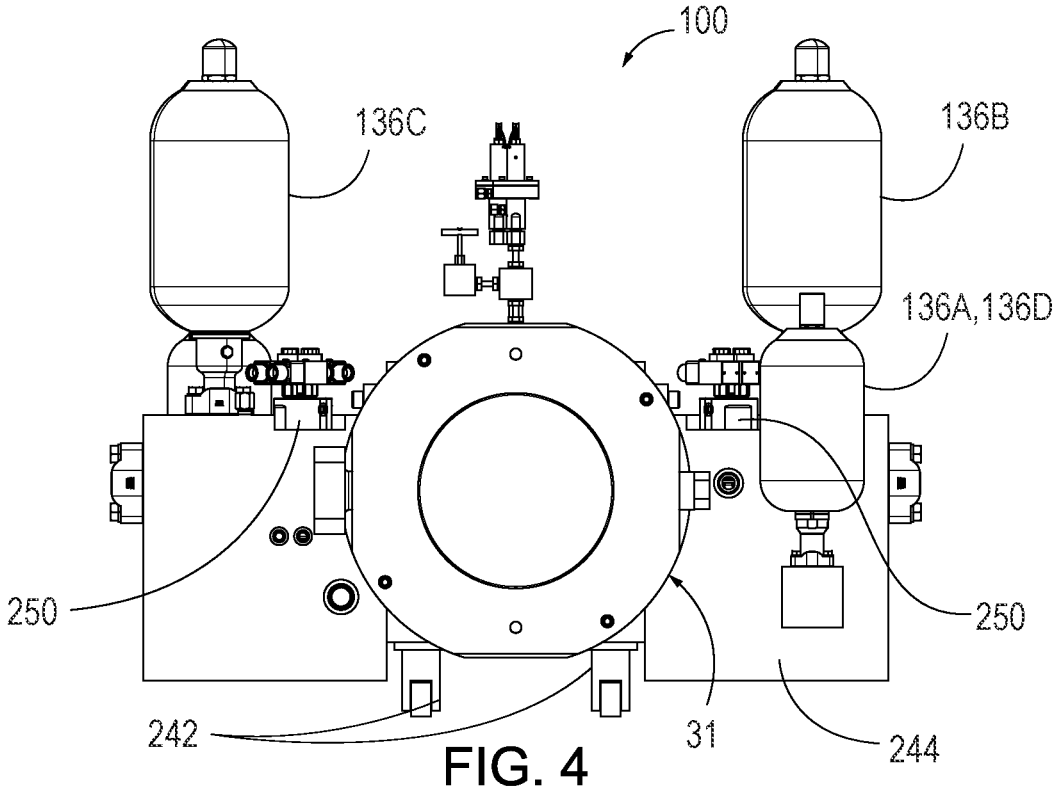
FIG. 4 is front elevation view of the compressor module of FIG. 2.
Figure 5:
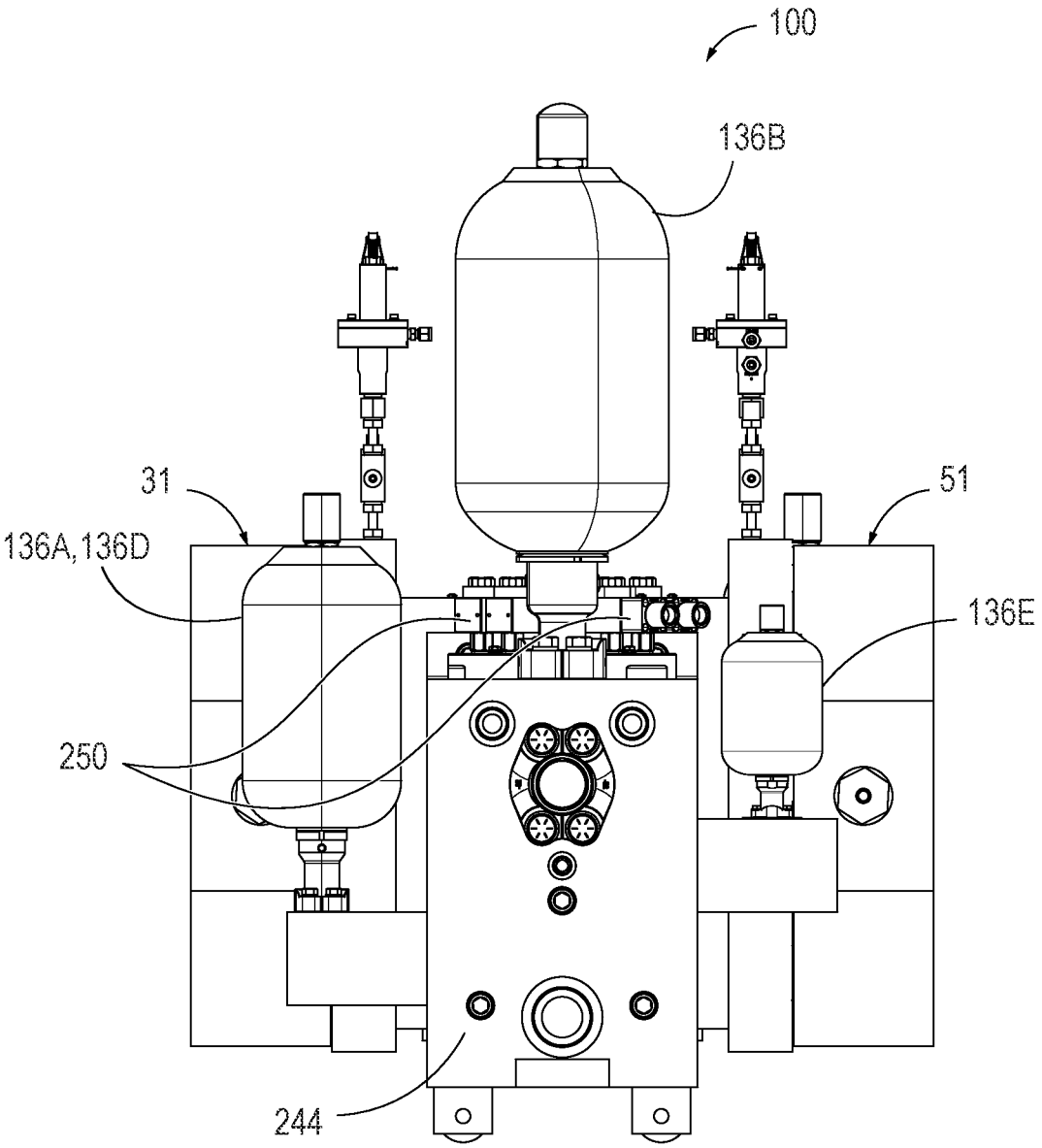
FIG. 5 is side elevation view of the compressor module of FIG. 2.

In some embodiments, the compressor module 100 is arranged compactly and therefore requires specific hydraulic routing and high pressure gas plumbing and connections. In some embodiments, the compressor heads 31, 51 can accommodate reorientation of the inlet and outlet ports 7, 9. As shown in FIG. 2, the 180° opposing inlet port 7 and outlet port 9 can be clocked in almost any desired orientation as indicated by the arrows A.

In certain embodiments, an energy recovery mechanism can be provided through a force couple architecture, embodiments of which are shown in FIGS. 2-8, 9, and 10-11. Referring to FIGS. 2-8, some embodiments of this architecture comprise a pair of opposing diaphragm compressor heads 31, 51 both driven by an actuator piston 126 that is a double acting double rod, which may or may not act as a hydraulic intensifier, and which is actuated to provide high pressure work oil to actuate the diaphragm compressors. The two pressurized actuation volumes 144, 146 are alternately fed pressurized fluid and vented to drive the actuator piston 126 back and forth towards either compressor head 31, 51. Additionally and as discussed further below, since the respective diaphragms 5 of the compressor heads 31, 51 oppose each other and are out of phase in this embodiment, the force imposed on one diaphragm by the intake of process gas (e.g., intake of process gas to compressor head 31) consequently imposes an aiding force during the opposing diaphragm's compression and discharge stroke (e.g., compression and discharge from compressor head 51). The force couple architecture imposes a force couple to the actuator 114 reducing the force and energy requirements for moving the actuator piston 126 to actuate the diaphragms 5 of both compressor heads 31, 51.

For a discharge cycle of the compressor head 31, operation begins when the actuator piston 126 is at or near the end of its stroke away from the compressor head 31. At this point, process gas at the inlet pressure has already been supplied to the process gas region 36 of the diaphragm compressor head 31 whereas the opposing second compressor head 51 is fully evacuated of process gas. When diaphragm 5 motion is desired for the compressor head 31, the MSV 250 actuates to supply pressurized work oil to the second actuation volume 146 on the second side 145 of the actuator piston 126, forcing the actuator piston 126 up towards the compressor head 31 that is filled with process gas ("up" and other such directions are in reference to FIG. 6 for sake of clarity and are an example embodiment of the relative movement and positions of various parts, but are not intended to be limiting). As the actuator piston 126 moves, the diaphragm piston 3 pressurizes the work oil in the work oil region 54 below the diaphragm 5. Since this hydraulic pressure in the work oil region 54 is greater than the pressure of process gas, the diaphragm 5 moves upwards thereby pressurizing the process gas. Once the process gas pressure reaches a target process gas pressure, the process gas is expelled out of the compressor head 31 and either supplied to the tank 256 or supplied to a subsequent compressor head (e.g., the compressor head 51 of the same compressor module 100, a compressor head 31, 51 of another compressor module in the same stack 201, or a compressor head 31, 51 of another compressor module in another stack) for further pressurization. After all or most of the process gas has been forced out of the process gas region 36, the MSV 250 stops providing hydraulic flow and the actuator piston 126 stops actuating.

When diaphragm motion is desired in the opposing direction (i.e., a discharge stroke of the second compressor head 51), the MSV 250 is actuated to provide pressure to the opposing first side 143 of the actuator piston 126 into the first actuation volume 144, thereby forcing the actuator piston in the opposite direction and compressing the gas in the second variable volume region 142 toward the second compressor head 51. As the hydraulic actuator 112 pressurizes the process gas within the second compressor head 51, the compressor head 31 is undergoing its intake or suction stroke where the process gas at inlet pressure is supplied above the diaphragm 5 in the process gas region 36. This initial supply of inlet-pressure process gas may initially assist in providing pressure and moving the diaphragm 5 downwardly and pressurizes the remaining work oil below the diaphragm 5 in the variable volume region 54, which applies a force to the diaphragm piston 3 thereby providing an aiding force during the opposing compressor head 51 compression, or discharge stroke. This aiding force from the process gas supply reduces the required force from the HPU 118 to drive the actuator piston 140 and compress gas in the second compressor head 51. Subsequently, process gas completely fills the compressor head 31 in process gas region 36. To finish the discharge stroke of the second compressor head 51, pressurized process gas is discharged from the process gas region 36 of the second compressor head 51. Upon completion of the discharge stroke of the second compressor head 51, the compressor head 31 is filled with process gas and the second compressor head 51 is fully evacuated of process gas.

Figure 9:
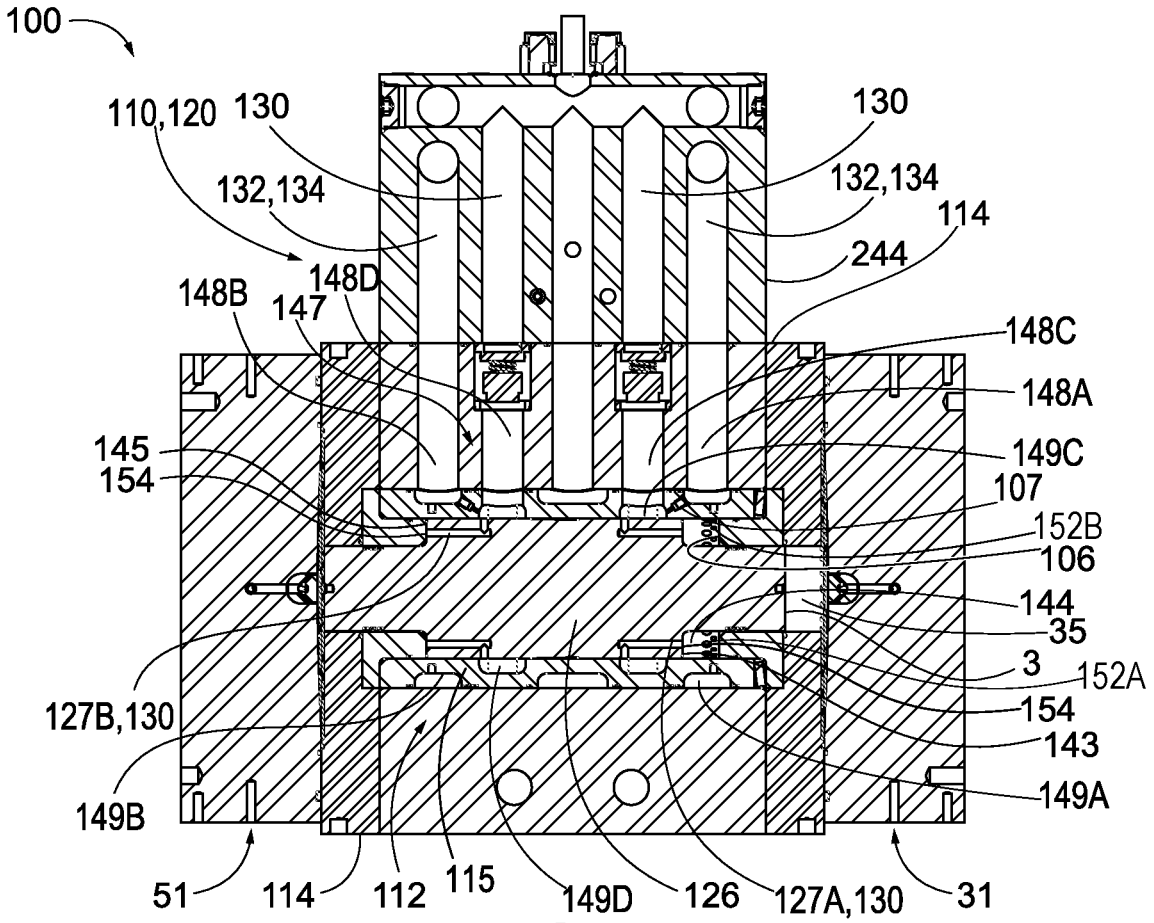
FIG. 9 is a side sectional view of another embodiment of a compressor module of the system of FIG. 1 in accord with embodiments of the present disclosure.

Referring to FIG. 9, another embodiment of a compressor module 100 includes a first and second internal porting 127A, 127B through the respective first and second sides 143, 145 of the actuator piston 126. The first side 143 of the actuator piston 126 comprises a first opening 154 and the first internal porting 127A that are in fluid communication with both the first actuation volume 144 and the first proximal port 148C. In this manner, the first actuation volume 144 can be supplied or vented through the first internal porting 127A and the first opening 154. In the illustrated embodiment, the first proximal port 148C is part of a low-pressure circuit 130 and is controlled by a main stage valve 250 ("MSV 250") to selectively supply low-pressure work oil to the first actuation volume 144 or vent work oil from the first actuation volume. In other embodiments, the first internal porting 127A may be in fluid communication with any one or more of the plurality of ports 147 and operable with any one or more of a plurality of pressurized circuits 120.

In embodiments, at least one of the first opening 154 and the first internal porting 127A of the actuator piston 126 comprises a check valve (not shown) to prevent the flow of work oil out of the first actuation volume 144 through the first internal porting 127A when the first actuation volume is pressurized for a discharge stroke of the second diaphragm piston 140, the check valve thereby maintaining the pressure in the first actuation volume 144. As discussed below, in some embodiments a landing orifice 107 connects the first proximal port 148C to the first distal port 148A, and vented work oil from the first internal porting 127A flows out through the first distal port 148A via the landing orifice to a pressurized circuit, accumulator, or the reservoir 230. In some embodiments, additional ports (e.g., first proximal port 148C in FIG. 9) of the plurality of ports 147 are in fluid communication with the first actuation volume 144 separately from or in addition to the first opening 154. It will be appreciated that, in embodiments, the first opening 154 and the second internal porting 127B are provided at the second side 145 of the actuator piston 126 and in communication with the second actuation volume 146 in a substantially similar manner as at the first side 143 of the actuator piston.

Figure 10:
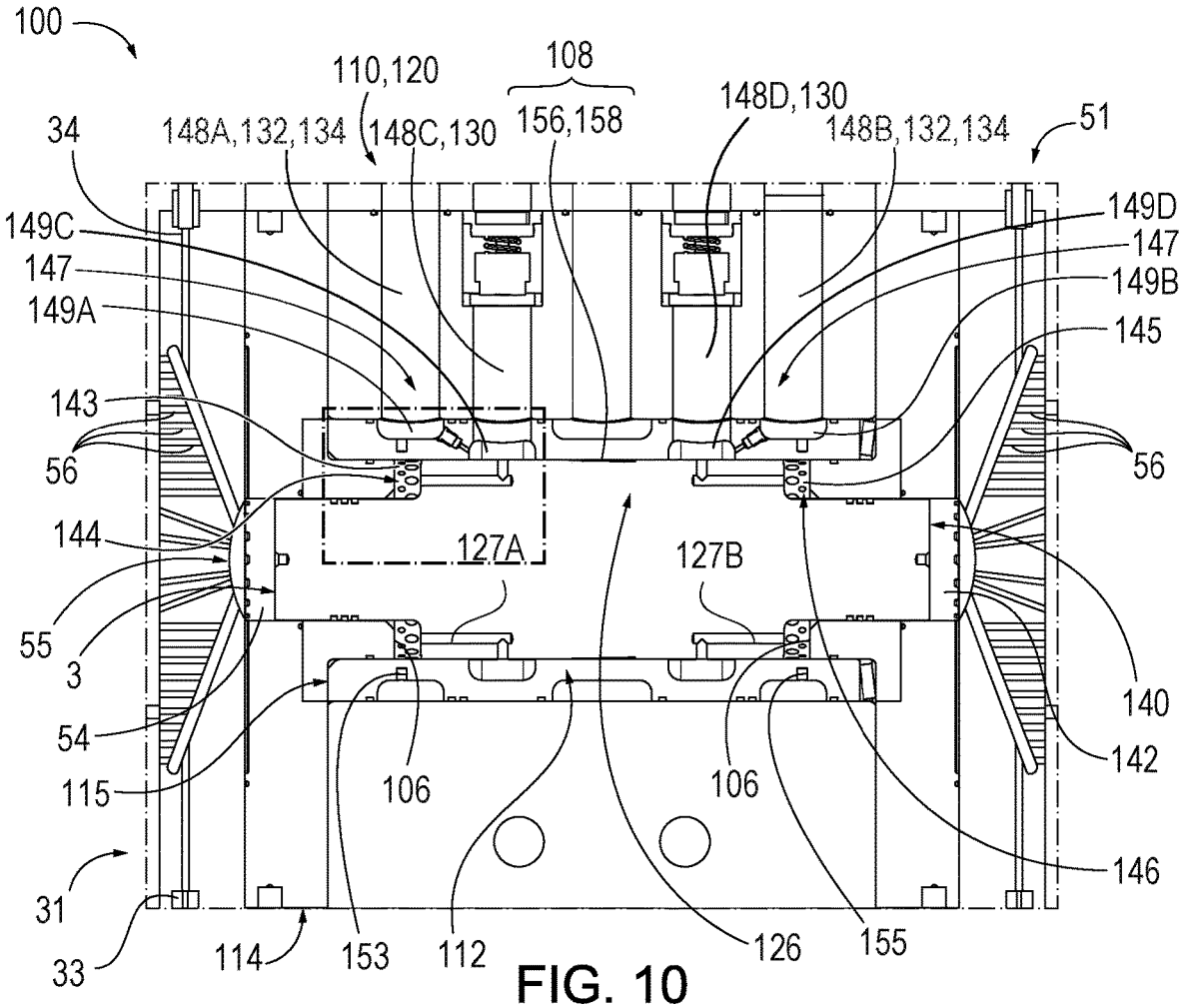
FIG. 10 is a side sectional view of still another embodiment of a compressor module of the system of FIG. 1 in accord with embodiments of the present disclosure.
Figure 11:
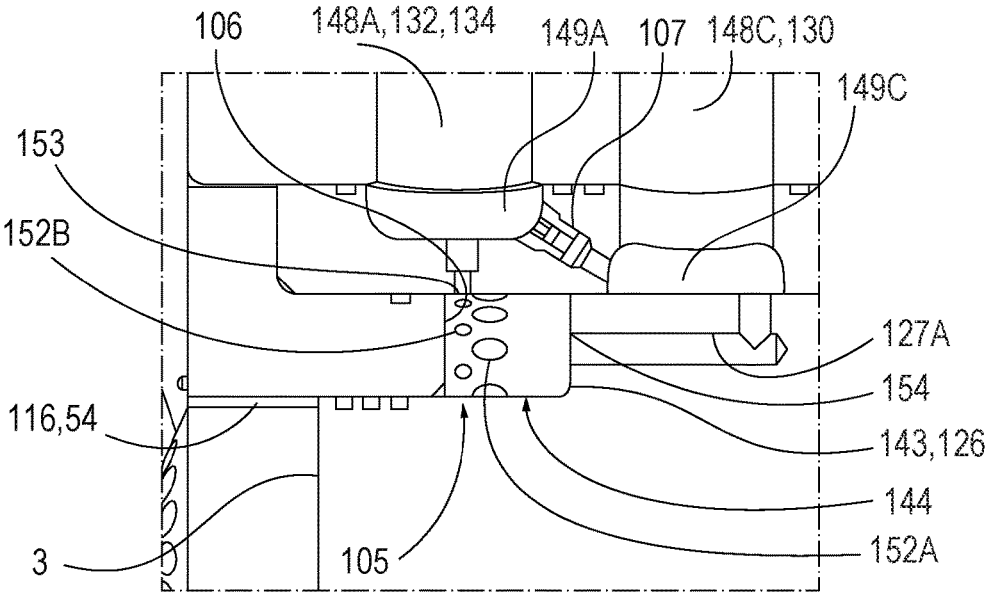
FIG. 11 is an enlarged partial view of FIG. 10.

Referring to FIGS. 10-11, still another embodiment of a compressor module 100 is shown that is generally similar to FIG. 9. In embodiments, the first and second compressor heads 31, 51 comprise an oil distribution plate 55 including an array of passages 56 from the respective variable volume region 54, 142 to the diaphragm 5.

Referring to FIG. 10, in some embodiments, the compressor module 100 comprises a feedback mechanism 108 configured to determine one or more of a position and velocity of the actuator piston 126 during use. The feedback mechanism may include one or more of a sensor 158 and a pressure sensor 159. In some embodiments, the actuator piston 126 comprises an indication feature 156 that is detectable by the sensor 158. In various embodiments, the sensor 158 is one or more of an inductive sensor, an optical sensor, a Hall Effect sensor, or the like.

In certain embodiments, the indication feature 156 is a variable-geometry portion of the actuator piston 126, for example a decreasing radius, and the sensor 158 is an inductive proximity sensor configured to measure the distance to the indication feature 158, the distance measured in a direction perpendicular to the motion of the actuator piston 126 along the actuator piston axis 208. In one such embodiment shown in FIG. 10, as the actuator piston 126 moves right-to-left toward the first compressor head 31, the sensor 158 can detect an increase in the distance to the indication feature 158 because the radius of the actuator piston is decreasing. Based on the measured distance between the sensor 158 and the indication feature 158, the feedback mechanism 108 is configured to determine the absolute position of the actuator piston 126. In embodiments, the feedback mechanism 108 is configured to determine the velocity of the actuator piston 126 based on multiple measurements by the sensor 158 over time.

In embodiments, the feedback mechanism 108 comprises a pressure sensor 159 (FIG. 15) operatively coupled to pressurized process gas in or from the compressor head 31, for example directly measuring pressure of the process gas in the process gas region 36 or measuring the pressure of discharged process gas from the first compressor head 31 after the inlet port 7. The feedback mechanism 108 is configured to calculate the velocity of the actuator piston 126 based on the measured pressure of the discharged process gas. In embodiments, the feedback mechanism 108 is configured to calculate the velocity of the actuator piston based on multiple inputs, such as measurement(s) from the sensor 158 in conjunction with the pressure sensor 159 or other sensors operatively configured to sense or detect a portion of the compressor module 100 and/or hydraulic drive 110 (e.g., pressure sensor(s) in the first and/or second variable volume region 54, 142, pressure sensor(s) in the first and/or second actuation volume 144, 146). The feedback mechanism 108 is configured to control other aspects of the module 100 based on the position and/or velocity of the actuator piston 126, for example controlling the main stage valves 250 to supply or vent work oil to the hydraulic drive 110 or controlling the supply of process gas to a compressor head 31, 51.

Figure 19:
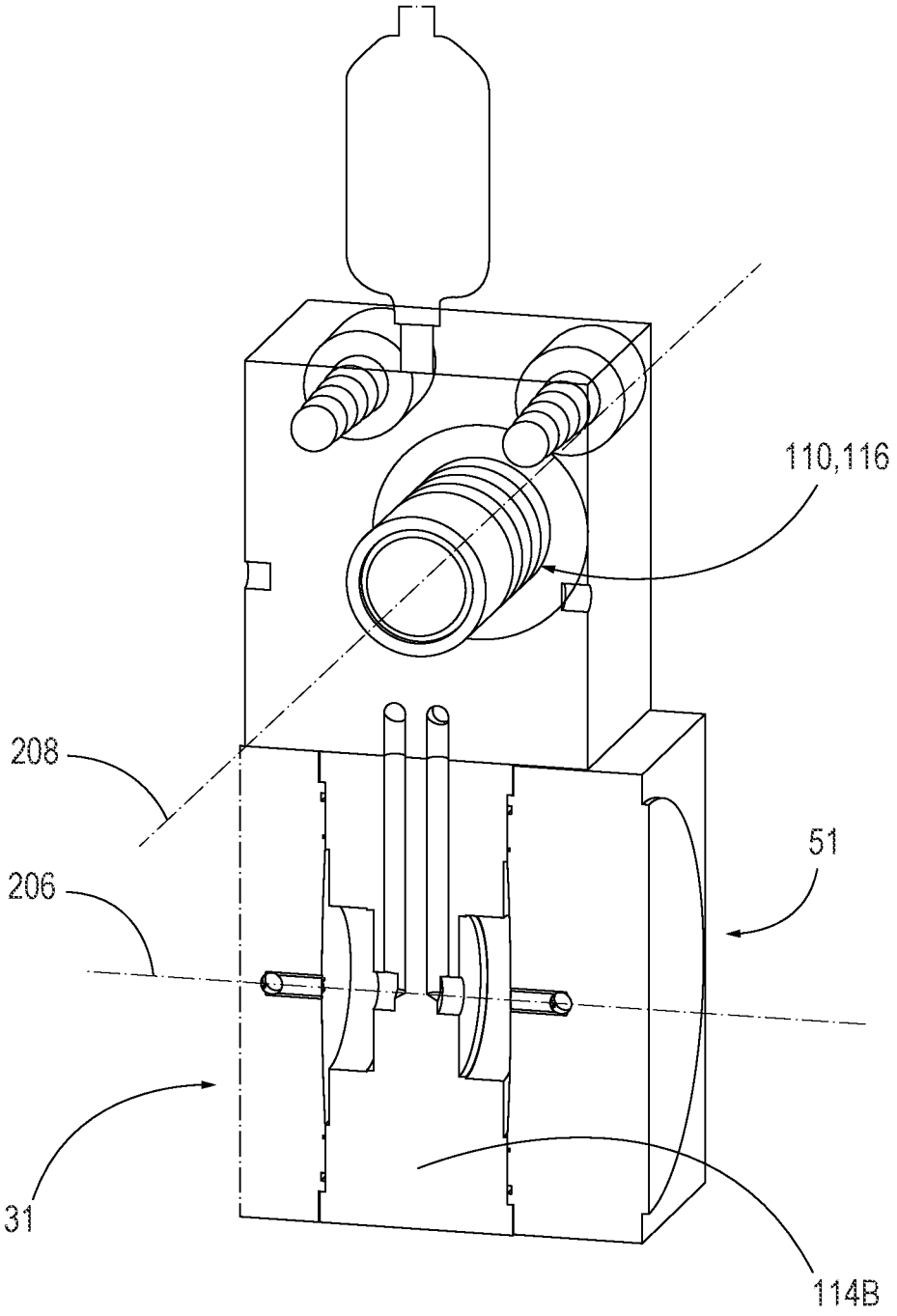
FIG. 19 is a partial cross-sectional view of a compressor module of the system of FIG. 1 in accord with embodiments of the present disclosure.

Referring to FIG. 19, an alternative embodiment of a compressor module 100 is shown with the hydraulic drive 110 positioned offset from one or more compressor heads 31, 51 with only a hydraulic passage manifold 114B between the compressor heads. The hydraulic passage manifold 114B provides passages that hydraulically connects the hydraulic drive 110 to the compressor heads 31, 51 without pistons and is significantly smaller than the drive housing 114 of other embodiments. This arrangement reduces the axial length of the stack 201 and may reduce the overall footprint of the stack 201 or the entire high-throughput compressor system 200. In the illustrated embodiment, the compressor head axis 206 is perpendicular to the actuator piston axis 208. However, compressor head axis 206 can be oriented in nearly any relationship to the actuator piston axis 208 so long as they are in fluid communication.

In embodiments, the compressor heads 31, 51 of the compressor module 100 may be independently operated and timed to be synchronized, not synchronized, or alternating. Such arrangements are generally achievable in any compressor architecture that is not force coupled. In embodiments, the compressor heads 31, 51 are discharged at substantially the same time. Similarly in embodiments of a stack 201 of compressor modules 100 or a stage 202 of compressor modules 100, the timing of discharge cycles for compressor heads 31, 51 may be independent or dependent within each module, stack, or stage. In embodiments providing independent operation of the compressor heads 31, 51, one or more actuator pistons 126 are separately provided for each compressor head. In certain such embodiments, one or more ports of the plurality of ports 147 are dedicated to a given individual compressor head 31, 51 for control of the respective compressor head. In any of the above embodiments with independent operation, any one or more compressor head 31, 51, compressor module 100, or stack 201 may be selectively turned off and on during operation of the diaphragm compressor system 200, for example turned off when not needed during certain stages of filling the tank 256.

Pressure Rails

The hydraulic system pressure(s) provided by the hydraulic power unit 118 ("HPU") in some embodiments ranges from 0-5000 psi, but in other embodiments a higher hydraulic pressure is implemented. The HPU 118 in embodiments comprises a single pump/motor, many small pump/motor systems, or fewer larger pump/motor systems, or combinations thereof, as based on operational requirements. In embodiments, the hydraulic drive 110 comprises actively-controlled pressure-compensated pumps or the like in order to actively control hydraulic pressure throughout operating modes. This active control enables the hydraulic drive 110 to operate efficiently by minimizing energy expenditure to meet system requirements. The HPU 118 is configured to provide work oil at a pressure to the drive cavity 116, and in some embodiments, this pressure is intensified, e.g., by increasing the supply area relative to the piston area.

For some embodiments, in order to minimize hydraulic energy consumption, a variable pressure architecture of the compressor module 100 provides a variable-pressure supply of work oil to provide step or analog changes in the applied pressure to any actuator piston 126 as discussed in U.S. patent application Ser. No. 17/522,896. Accordingly, in embodiments, for different operating modes, the hydraulic drive 110 may supply work oil at multiple different set pressures (also referred to as pressure circuits 120 or pressure rails) and/or flowrates. The plurality of pressure circuits 120 comprises one or more low-pressure circuits 130, medium-pressure circuits 132, and high-pressure circuits 134. The term "circuit" is intended to broadly include both the pressurized fluid and the associated structures conveying and controlling the fluid, and one skilled in the art will appreciate that the same structure (e.g., plumbing) may serve as a part of multiple circuits depending on the operating conditions.

In some embodiments with multiple pressure circuits, the HPU 118 uses discrete pump/motor sets producing discrete pressures that supply some or all of the plurality of pressure circuits 120 individually in order to eliminate throttling losses. In embodiments, the HPU 118 comprises a variable pump-motor set that is configured to change the speed or pressure of pressurized work oil output by the HPU. In embodiments, the HPU 118 is automatically variable and/or actively controlled, for example, controlled and adjusted in response to conditions in the hydraulic drive 110, conditions of the outlet process gas or conditions in the fill tank 256. Moreover, in certain embodiments, any of the above approaches is used to charge one or more accumulators 136 that are included in one or more of the plurality of pressure circuits 120.

In embodiments of the variable pressure architecture, a low-pressure circuit 130 is implemented to provide a "back-fill" or "assist" hydraulic supply to the hydraulic system 100 when a higher pressure is not needed (e.g., when ambient-pressure work oil or other relatively low-pressure work oil is sufficient). In certain embodiments, as the hydraulic actuator starts to move from the end of its stroke, the force imposed by the intake stroke process gas on the diaphragm 5 imposes an aiding force on the diaphragm piston 3 and consequently on the actuator 112. In some embodiments, this force may be enough to move the actuator 112, or initiate movement of the actuator 112, with minimal pressure from the HPU 118 or without the addition of hydraulic pressure to available work oil. The drive cavity 116, however, will still need a supply of work oil to backfill in one of the actuation volumes 144, 146 to allow the actuator 112 to move in the opposite direction, which may be provided by the low-pressure supply rail 130. In embodiments, the low-pressure circuit 130 comprises relatively low-pressure work oil from one or more of the following: unpressurized work oil from the HPU 118, an oil reservoir 38 of an active oil injection system 30 providing a circuit of supplemental work oil to the compressor heads, vented work oil from the drive cavity 116 in a previous cycle (e.g., intensified work oil vented via a valve and stored in a hydraulic accumulator 136D as discussed below), vented work oil from the variable volume region 54, process gas at the inlet pressure, or other sources in the compressor system 100.

In certain embodiments, the one or more pressure circuits 120 comprises a medium-pressure circuit 132 comprising work oil pressurized by the HPU 118 (e.g., by a throttled supply of higher pressure work oil or by a direct supply from one or more pumps/motors of the HPU). In some embodiments, the one or more pressure circuits 120 comprises a high-pressure circuit 134 comprising high-pressure work oil pressurized by the HPU 118. It will be appreciated that any of the low-pressure circuit 130, medium-pressure circuit 132, and high-pressure circuit 134 may be implemented as multiple pressure circuits at different set pressures. The additional circuits of the plurality of pressure circuits 120 allow for finer tuning and control of the compressor module 100, and increases efficiency by only providing as much pressure as necessary to move the actuator at a particular part of its stroke.

As discussed above, in embodiments the compressor module 100 is configured to control the variable-pressure supply of work oil by supplying work oil from the high-pressure circuit 134 after work oil has been supplied from the low-pressure circuit 130 and/or the medium-pressure circuit 132. In certain embodiments, the hydraulic drive system 110 is configured to control the variable-pressure supply of work oil by sequentially providing work oil to the drive cavity 116 from the low-pressure circuit 130, the medium-pressure circuit 132, and the high-pressure circuit 134. In embodiments with low pressure operating conditions or requirements, it may be sufficient to provide the work oil to the drive cavity 116 from the low-pressure circuit 130 and the medium-pressure circuit 132, only.

In some embodiments, the plurality of pressure circuits 120 are each operatively connected to the drive cavity 116 and may be fed on one or both sides of the actuator piston 126. In embodiments, the hydraulic drive 110 comprises a passive first valve 131 (FIG. 17) configured to supply work oil from the low-pressure rail of the low-pressure circuit 130 to the drive cavity 116 and an active second valve 133 (FIG. 16) configured to supply work oil from the medium-pressure rail of the medium-pressure circuit 132 to the drive cavity. Certain embodiments further comprise an active third valve 135 configured to supply work oil from the high-pressure rail of the high-pressure circuit 134 to the drive cavity 116. As detailed below, in embodiments the active second valve 133 and/or the active third valve 135 may be the main stage valve 250 ("MSV").

In certain embodiments, each of the active second valve 133 and the active third valve 135 is configured to adjust from a supply stage to a return stage, the return stage permitting an outflow of intensified work oil from the drive cavity 116 during the discharge cycle of a corresponding one of the compressor heads 31, 51. In embodiments, a hydraulic accumulator 136D receives the outflow of intensified work oil from the drive cavity 116. The hydraulic accumulator 136D in some embodiments operatively functions as a low-pressure accumulator 136A of the low-pressure circuit 130, a medium-pressure accumulator 136B of the medium-pressure circuit 132, a high-pressure accumulator 136C of the high-pressure circuit 134, or a pilot accumulator 136E of the pilot valve 290.

Supplying flow from the low-pressure circuit 130 into the hydraulic actuator 112 can be achieved several ways. In some embodiments, the fluid can be supplied through a hydraulic valve (in place of the passive first valve 131 in FIG. 17) that opens to allow flow into the actuator 112 then closes when higher pressure fluid is required. In other embodiments, the flow can be supplied through a check valve, such as the passive first valve 131 which opens due to low pressure of work oil in the work oil region 35 during a suction cycle and as the hydraulic actuator 112 starts to move. Since this is a passive valve, it does not need to be actuated when relatively higher pressure fluid is supplied to the drive cavity 116 (e.g., from the medium-pressure circuit 132 or the high-pressure circuit 134) will force the valve closed. Alternately, a three-way valve can be used to supply low-pressure or high-pressure fluid to the hydraulic actuator 112 and vent from the hydraulic actuator when desired. The vent can be connected to the low-pressure circuit 130 as outlined above. In this scenario, fluid from the low-pressure circuit 130 can back flow through the passive first valve 131 into the hydraulic actuator 112 as the actuator starts to move.

In certain embodiments, a medium-pressure circuit 132 is set to a pressure approximately 50% of the high pressure circuit 134. In other embodiments, a medium-pressure circuit 132 is set to a pressure approximately 40% to 60% of the high pressure circuit 134. In some embodiments, the high-pressure circuit 134 is set at a pressure of approximately 5,000 psi, the medium-pressure circuit 132 is set to from 2,500 psi to 3,000 psi, and the low pressure circuit 130 is set to approximately 500 psi. In other embodiments, high-pressure circuit 134 is set to a pressure selected from 3,000 psi, 5,000 psi, and 7,500 psi. In some embodiments, at least one of the high-pressure circuit 134 and medium-pressure circuit 32 are controlled by the HPU 118 to be variable from the maximum pressure for each respective rail. In other embodiments, at least one of the high-pressure circuit 134 and medium-pressure circuits 132 are controlled by the HPU to be variable in a range from 0% to 100% of the maximum pressure for each respective rail. In further embodiments, at least one of the high-pressure circuit 134 and medium-pressure circuits 132 are controlled by the HPU to be variable in a range from 50% to 100% of the maximum pressure for each respective rail.

In certain embodiments, the compressor module 100 may include two stages, for example a low pressure stage with compressor head 31 and a high pressure stage with second compressor head 51, as discussed in U.S. patent application Ser. No. 17/522,896.

Figure 30:
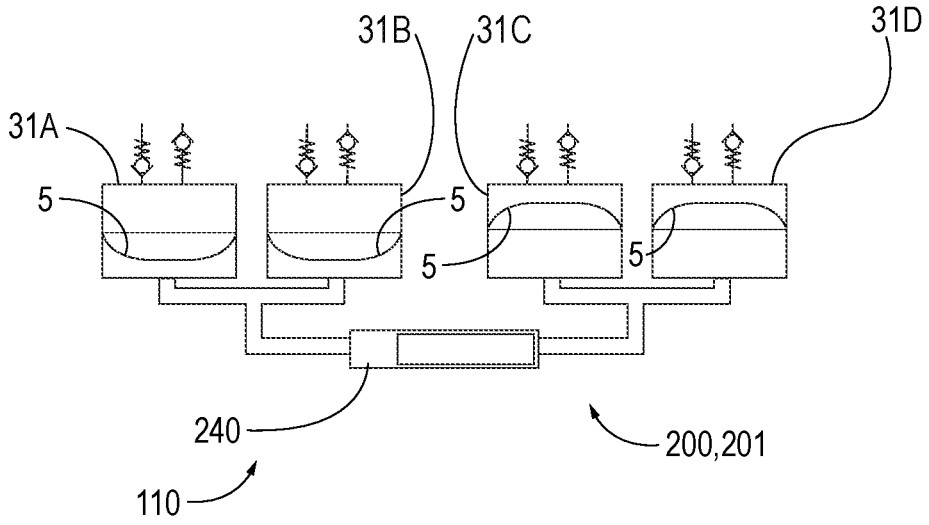
FIG. 30 is a schematic view of multiple hydraulically-driven compressor modules with a common intensifier in accord with embodiments of the present disclosure.
Figure 31:
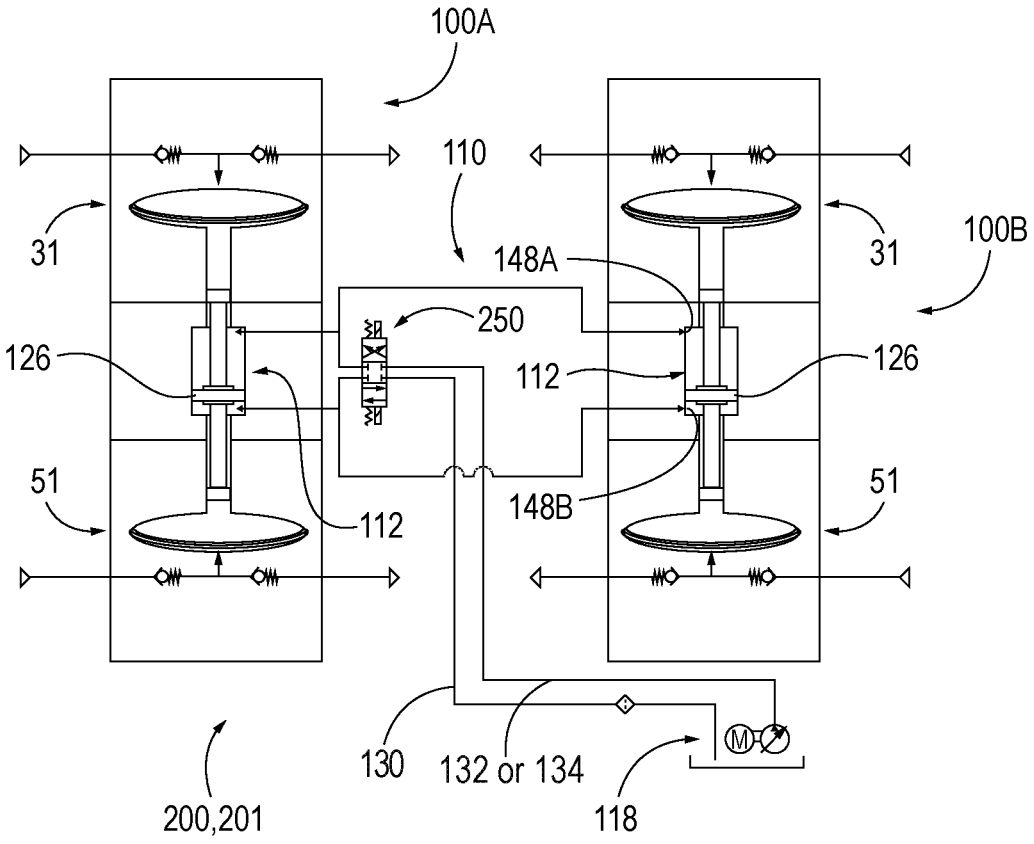
FIG. 31 is a schematic view of multiple hydraulically-driven compressor modules with a common control valve in accord with embodiments of the present disclosure.
Figure 32:
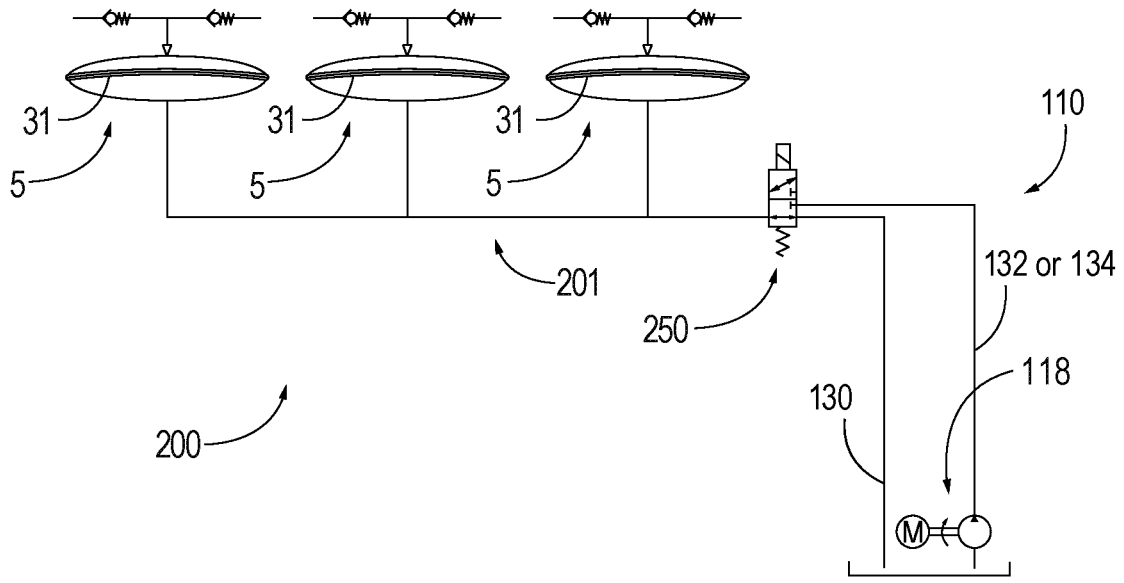
FIG. 32 is a schematic view of a hydraulically-driven compressor system with direct hydraulic actuation in accord with embodiments of the present disclosure.

FIGS. 30-32 show alternative embodiments where some components of the hydraulic drive 110 are shared over multiple compressor heads 31, 51 that may be part of a stack 201 applicable to the present disclosure.

Referring to FIG. 30, in embodiments a common actuator 240 is operatively coupled to several compressor heads, for example compressor heads 31A-D, while being physically offset from the compressor heads. This arrangement is in contrast to other embodiments with one actuator for each compressor module that is physically housed in the module between compressor heads. The common actuator 240 functions as the intensifier and hydraulic drive for each compressor head 31A-D. The common actuator 240 in embodiments is driven by a single HPU 118 or multiple HPUs. In certain embodiments and as illustrated in FIG. 30, the common actuator 240 provides pressurized fluid to simultaneously actuate the diaphragms 5 of both compressor heads 31A, 31B, and then the common actuator 240 reverses directions to simultaneously actuate the diaphragms 5 of both compressor heads 31C, 31D.

In some embodiments of the stack 201, the common actuator 240 is mounted in the stack with the actuator piston axis 208 coaxial with the compressor head axis 206. In other embodiments, the common actuator 240 is separate from the stack 201. In still other embodiments, the common actuator 240 and the corresponding compressor heads 31A-D are all separate from any stack 201 to operate as an auxiliary compressor plumbed to another compressor module or stack. In any such embodiments, a single compressor head of the compressor heads 31A-D may be configured to be taken offline while the remaining compressor heads continue to operate.

Referring to FIG. 31, in some embodiments a first and second compressor module 100A, 100B share a common control valve, MSV 250. The MSV controls a pressurized supply of work oil from the HPU 118. In this sense, the HPU 118 and the MSV 250 are configured to supply and control the supply of pressurized work oil to a plurality of compressor modules and a plurality of compressor heads. In other embodiments, multiple MSVs 250 and/or multiple HPUs 118 are provided and shared by the first and second compressor modules 100A, 100B, for example when providing both medium-pressure and high-pressure circuits 132, 134.

In an embodiment shown in FIG. 32, the HPU 118 is configured to act directly on the diaphragm 5 of one or more compressors 31 while omitting hydraulic actuator 112 and the piston subassembly 122. The MSV 250 is operatively connected to the HPU 118 to control the supply of work oil directly to the diaphragms 5. In the illustrated embodiment, the MSV 250 controls the supply to three compressors 31. In embodiments, any one or more of the pressure circuits 120 is implemented and controlled by one or more MSVs 250 for one or more of the compressor heads 31. Although FIG. 32 is illustrated schematically, it will be appreciated that the physical arrangement of the compressor heads 31 of the stack 201 can be coaxial on a compressor axis 206 as in previous embodiments. A compressor stack 201 implementing this embodiment provides an axial length and overall footprint are significantly decreased.

In any embodiments of the present disclosure, each pressure circuit of the one or more pressure circuits 120 may be independently and actively controlled to adjust the amount of pressure supplied to the hydraulic actuator 112. In embodiments, the active valves 133, 135 or MSV 250 may be controlled to adjust the respective pressure circuit. The plurality of ports 147 may similarly comprise a valve to actively control or throttle the flow to the drive cavity 116. It will be appreciated that the hydraulic drive 110 is likewise configured for nearly instantaneous stoppage of the actuator piston 126 and shutdown of the compressor module 100 due to the HPU 118 along with the active valves 133, 135 and/or the MSV 250, any associated control mechanisms (e.g., feedback mechanism 108), or shutoff valves. For example, the actuator piston 126 can be stopped during a discharge or suction stroke before such stroke is completed by closing off the pressure circuit(s) that are pressurizing the corresponding actuation volume. Accordingly, the hydraulic drive 110 is configured to stop a stroke of the actuator piston 126, a stroke of the diaphragm piston(s) 3, 140, and/or actuation of the diaphragm(s) 5 before the stroke or actuation completes its current cycle. This shutoff capability provides safety by minimizing further damage when a hazardous condition is detected. This is an improvement over prior compressor drives, e.g., crank-driven systems, which must mechanically stop components and overcome significant inertial forces before stopping, resulting in continuing operation during the hazardous condition.

Clamping Mechanism Referring to FIG. 1, in embodiments, the high-throughput compressor system 200 comprises a clamping mechanism 204 that holds the compressor modules 100 together while accommodating the significant pressures, vibrations, and other forces experienced during compressor cycles. In other embodiments, a clamping mechanism 304, 404, 504, 604, or 704 is provided as discussed below, with broad functionality similar to the clamping mechanism 204 (see FIGS. 24-29). Generally, each individual compressor head 31, 51 is formed of multiple plates that must be clamped together with enough force to resist cyclical forces including pressurized work oil, pressurized process gas, and diaphragm actuation without leakage. As such, a conventional individual compressor head requires a specialized individual mechanism such as a large number of high-strength bolts to sufficiently clamp the head together. By contrast, the clamping mechanism 204 of the present disclosure applies a clamping force sufficient to hold together each such compressor head for multiple compressor modules 100 with minimal or no clamping within individual heads.

In certain embodiments, the clamping force is exerted by the clamping mechanism 204 at opposite ends of a stack 201 of one or more compressor modules 100, with the force acting through each module 100 to clamp all of the heads 31, 51 of each module 100 in the stack. Clamping together each head 31, 51 comprises clamping together support plates that define each head, resisting pressure of compressed fluid(s) inside the head, and clamping one or more of the support plates (e.g., work oil head support plate 8) to a drive housing 114 of the compressor module 100. It will be appreciated that the clamping mechanism 204 therefore eliminates and/or reduces other hardware, including bolts and also the size and thickness of components of the heads 31, 51, necessary for clamping a conventional compressor head, and may provide reduced assembly time, reduced size and weight for each module 100 compared to a conventional diaphragm compressor, and improved serviceability. The clamping mechanism 204 is therefore also applicable to a single compressor head 31, 51 or a single compressor module 100 that is not stacked with other modules. In certain embodiments, the total clamping force necessary to operate each head 31, 51 in a stack 201 of modules 100 is not provided by bolts securing each individual head 31, 51 to each respective module 100. In other embodiments, the total clamping force is provided by a combination of the clamping mechanism 204 and bolts securing each individual head 31, 51.

In embodiments, the compressor system 200 comprises a clamp actuator 212 that applies a compressive force (i.e., clamping load) to the compressor modules 100 while also accommodating changes in thermal expansion of the compressor modules during operation. If the stack 201 were rigidly clamped without the clamp actuator 212, significant stresses would arise in the compressor modules 100 due to thermal growth of hardware that results from temperature increases as process gas is compressed. While accommodating thermal expansion, the compressive force of the clamp actuator 212 may be constant or substantially constant. In embodiments, the clamp actuator 212 is a hydraulic load actuator. The present disclosure provides several embodiments that are based around an actuator such as the clamp actuator 212 and a reactionary structure such as a frame or tie rod arrangement.

In the embodiment of FIG. 1, the clamping mechanism 204 comprises a base plate 220 and an end plate 222 connected by four tie rods 224 with respective tensioner nuts 226. In some embodiments, the stack 201 is mounted on a skid 228 or similar base. The compressor modules 100 are aligned along a common axis which, as discussed above, is a compressor head axis 206 of each compressor module 100. In some embodiments, one or both of the base plate 220 and end plate 224 are movable or repositionable along the compressor axis 206 to accommodate thermal expansion or various sizes of compressor modules 100. In certain embodiments, one or both of the base plate 220 and the end plate 224 are movable by the clamping actuator 212.

Figure 21:
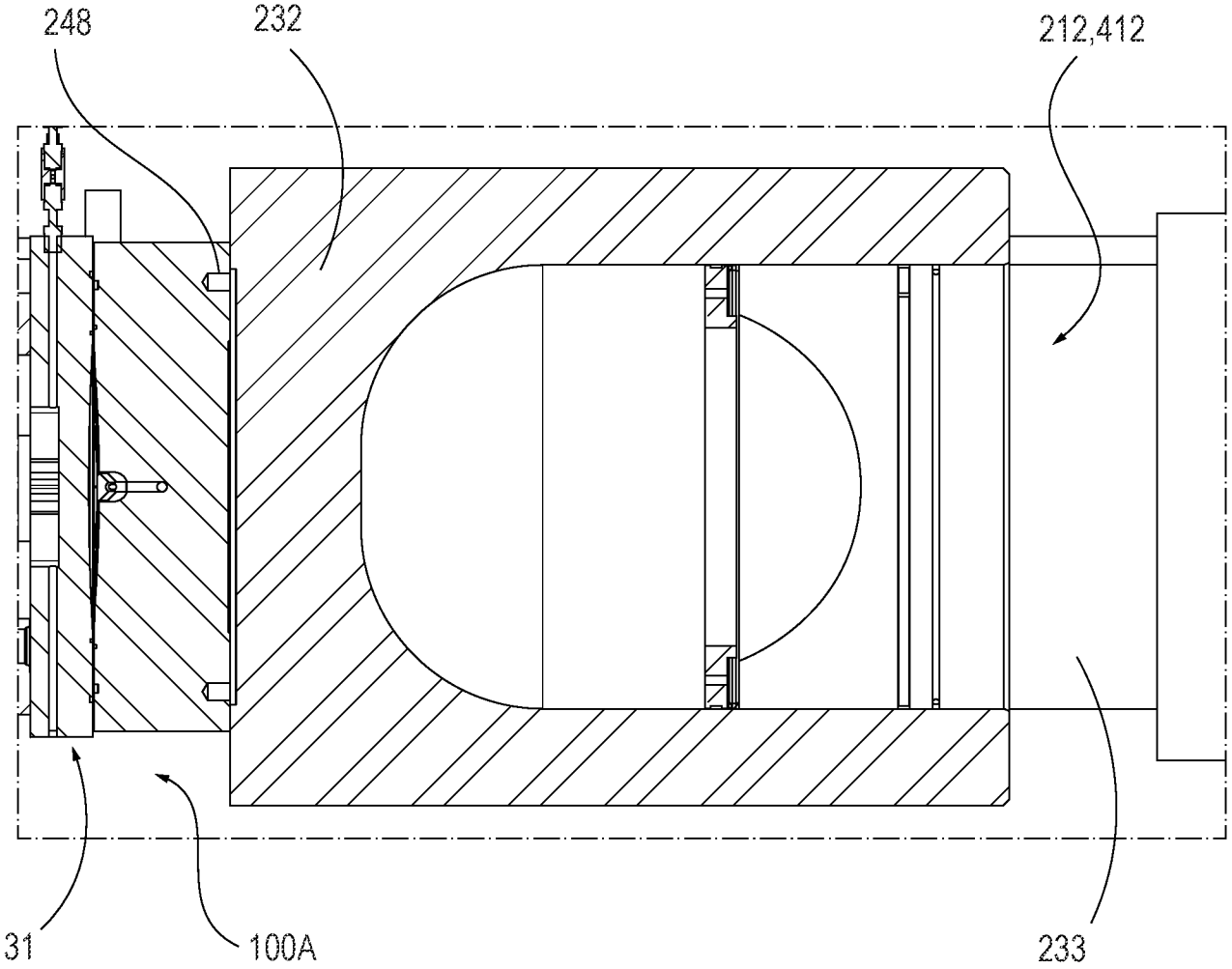
FIG. 21 is a top sectional view of a hydraulic clamp actuator of the system of FIG. 1 in accord with embodiments of the present disclosure.

Referring also to FIG. 21, the clamp actuator 212 in embodiments is a hydraulically-powered piston actuator comprising a hydraulic cylinder 232 and a piston 233. In the illustrated embodiment, the hydraulic cylinder 232 would have pressure applied to create the required clamping force for the constituent compressor modules 100 and compressor heads 31, 51. The same clamp actuator 212 architecture could be used for all compressor head sizes, but with different clamping loads as required for different supply pressures. In embodiments, the hydraulic supply for the clamp actuator 212 may be shared with one or more of the compressor modules 100, for example from a hydraulic power unit 118 of a compressor module.

In embodiments, operation of the clamp actuator 212 comprises manually charging the hydraulic cylinder 232 and subsequently monitoring the pressure within the clamp actuator 212. The cylinder 232 is then resupplied if pressure drops and leakage occurs over time, for example through dynamic seals. Alternatively, the hydraulic circuit of the clamp actuator 212 could be supplied with an additional make-up pump (not shown) to accommodate the lost fluid. The make-up pump may be similar to, or the same as used for the active oil injection system 30 applicable to embodiments of the compressor module 100 discussed below, and would be an adequate option to provide a low flow high pressure supply source. In embodiments, the monitoring may be automated with a configuration where the compressor system 200 shuts down when the pressure within the clamp actuator 212 drops below a certain threshold, and oil may also be injected, or oil pressure increased, as detected by the system.

In certain embodiments, as one mode to accommodate thermal growth, the large volume of oil within the hydraulic cylinder 232 of the clamp actuator 212 inherently has some compressibility, which may account for some of the increased pressure from modules 100 due to thermal growth. Even with this compressibility, the clamp load could grow by nearly 25% with a four-module stack 201. This load increase is proportional to the length of the overall stack 201. To further reduce the stiffness of the volume, some embodiments incorporate a piston accumulator (not shown), for example a high pressure piston accumulator that can accommodate pressures up to 1,000 bar. Moreover, such an accumulator also allows additional time for system shut down if a seal were to fail. In some embodiments, the pressure is monitored, and a lower threshold is set such that when the pressure drops below the set point, the system shuts down and sends an alarm to the operator. The lower set point, however, is still within a reasonable clamp load such that the compressor modules remain under load during the shutdown. Since the compressor modules are hydraulically driven, the shutdown may be rapid.

For service and change out of compressor modules 100, once any plumbing or electrical connections are disconnected from a given compressor module 100, the individual compressor module can be deactivated, serviced, and/or removed as a unit. In embodiments, an overhead gantry crane (not shown) is integrated into the stack skid 228, and has a designated area at the end or off to the side. In embodiments, each compressor module 100 comprises an eye bolt 246 (FIG. 2) or other attachment for lifting and moving the module via the gantry crane or the like. In some embodiments, each compressor module 100 comprises one or more feet 242, such as four feet shown in FIG. 3, which may function as a cart to move the module and/or may function to engage the skid 228 or other base of the stack 201.

Figure 24:
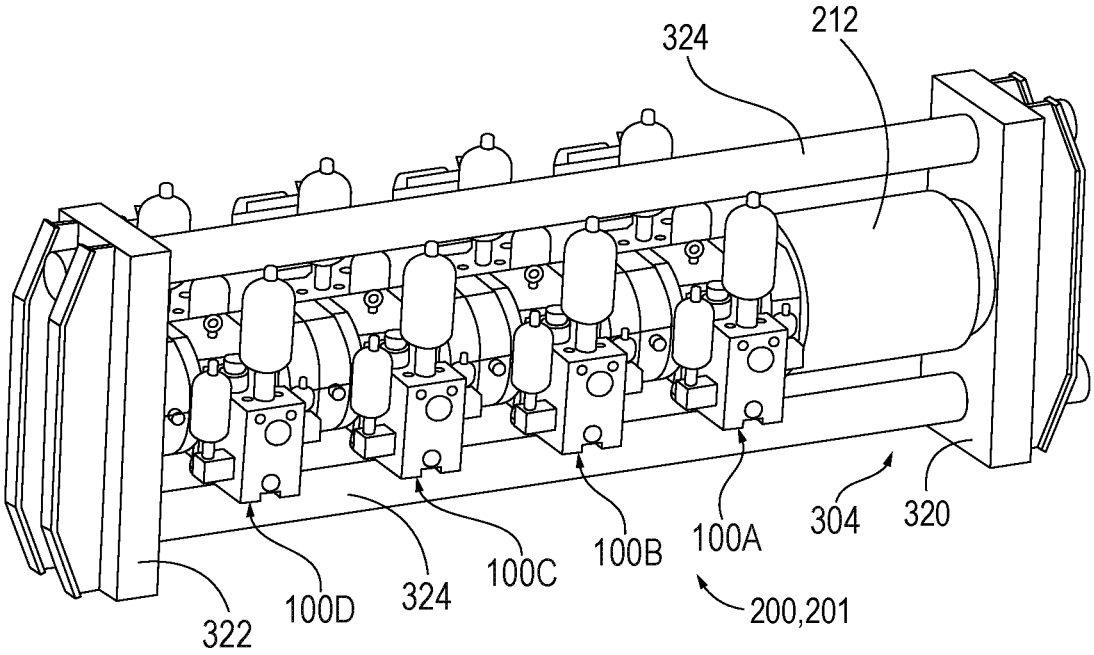
FIG. 24 is a front perspective view of another high-throughput compressor system with stacked compressor modules in accord with embodiments of the present disclosure.

Referring to FIG. 24, in other embodiments, a clamping mechanism 304 comprises a base plate 320 and end plate 322 that are connected by two tie rods 324. The clamp actuator 212 may similarly be provided between the base plate 320 and the compressor modules 100. Both of these embodiments of the tie rod based clamping mechanisms 204, 304 have their own respective advantages. The four-bolt arrangement of clamping mechanism 204 can allow for easier service (e.g., service in place, change out, or temporary removal for service) of the compressor modules 100 but may be more difficult to accommodate plumbing. The two-bolt arrangement of clamping mechanism 304 provides easier plumbing access but may be more difficult to service a module.

Figure 25:
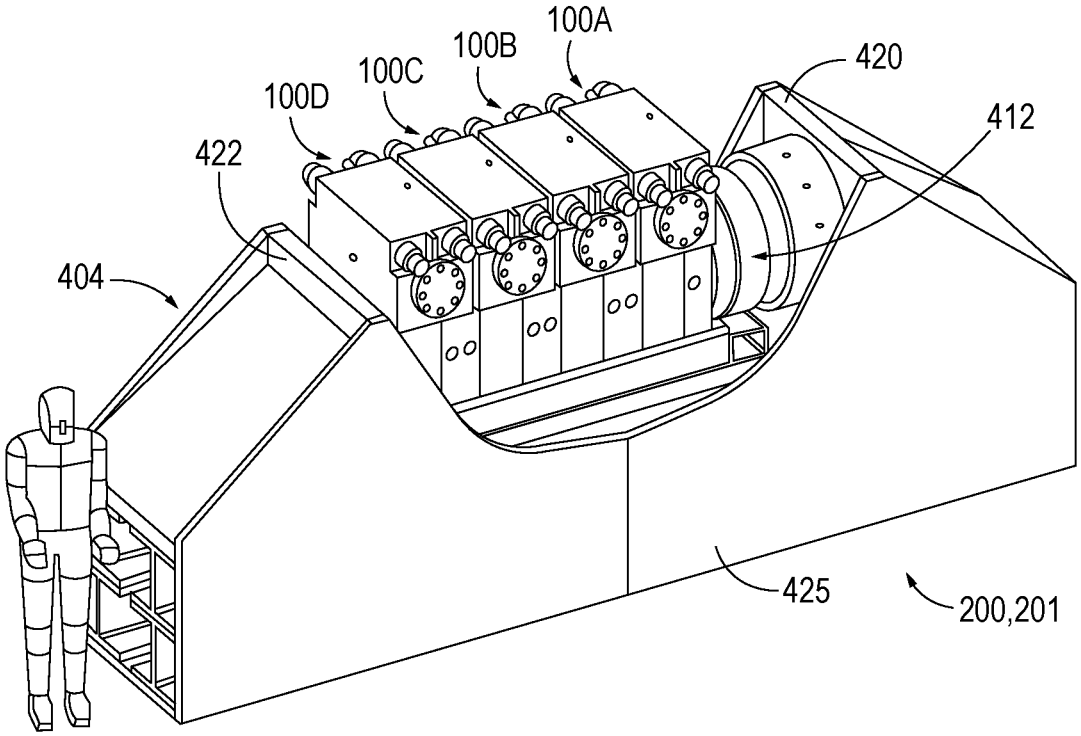
FIG. 25 is a front perspective view of still another high-throughput compressor system with stacked compressor modules in accord with embodiments of the present disclosure.
Figure 26:
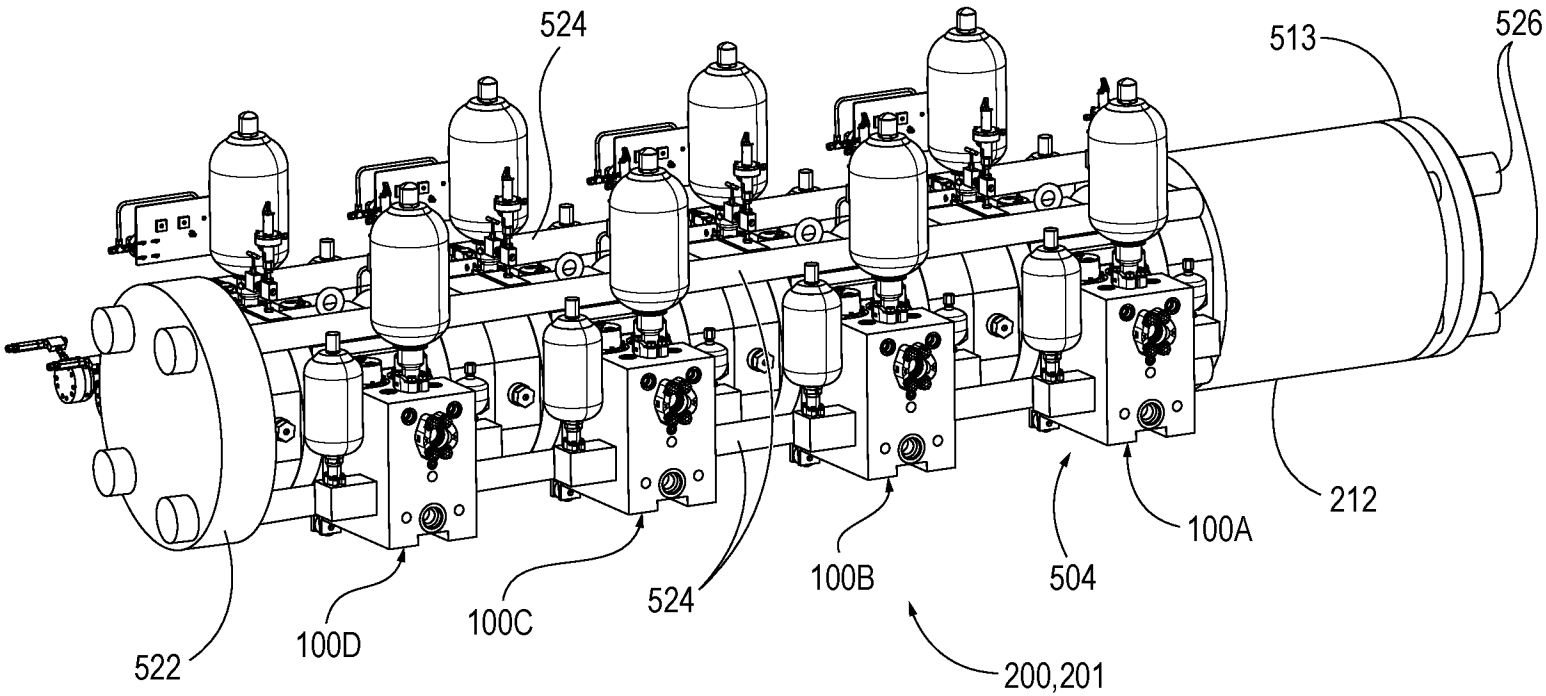
FIG. 26 is a front perspective view of yet another high-throughput compressor system with stacked compressor modules in accord with embodiments of the present disclosure.

Referring to FIG. 25, in still other embodiments, a clamping mechanism 404 comprises a base plate 420, an end plate 422, and a reactionary frame 425 mounting the plates along with the compressor stack 201 and a clamp actuator 412. In some embodiments, the actuator 412 may be the same as the clamp actuator 212. In embodiments, the reactionary frame 425 is rigidly affixed (for example, bolted) to a foundation. In some embodiments, to withstand the large tensile loads applied, the reactionary frame 425 is a one-piece unitary component or two pieces rigidly affixed together, and in particular embodiments the reactionary frame is formed of one cast metal part or two cast metal parts rigidly affixed together. As shown in FIG. 26, this embodiment of clamping mechanism 404 leaves the top and sides of the compressor modules 100 substantially open and accessible, which provides access for plumbing and servicing. However, the overall size of the clamping mechanism 404 may be larger than other embodiments.

Figure 27:
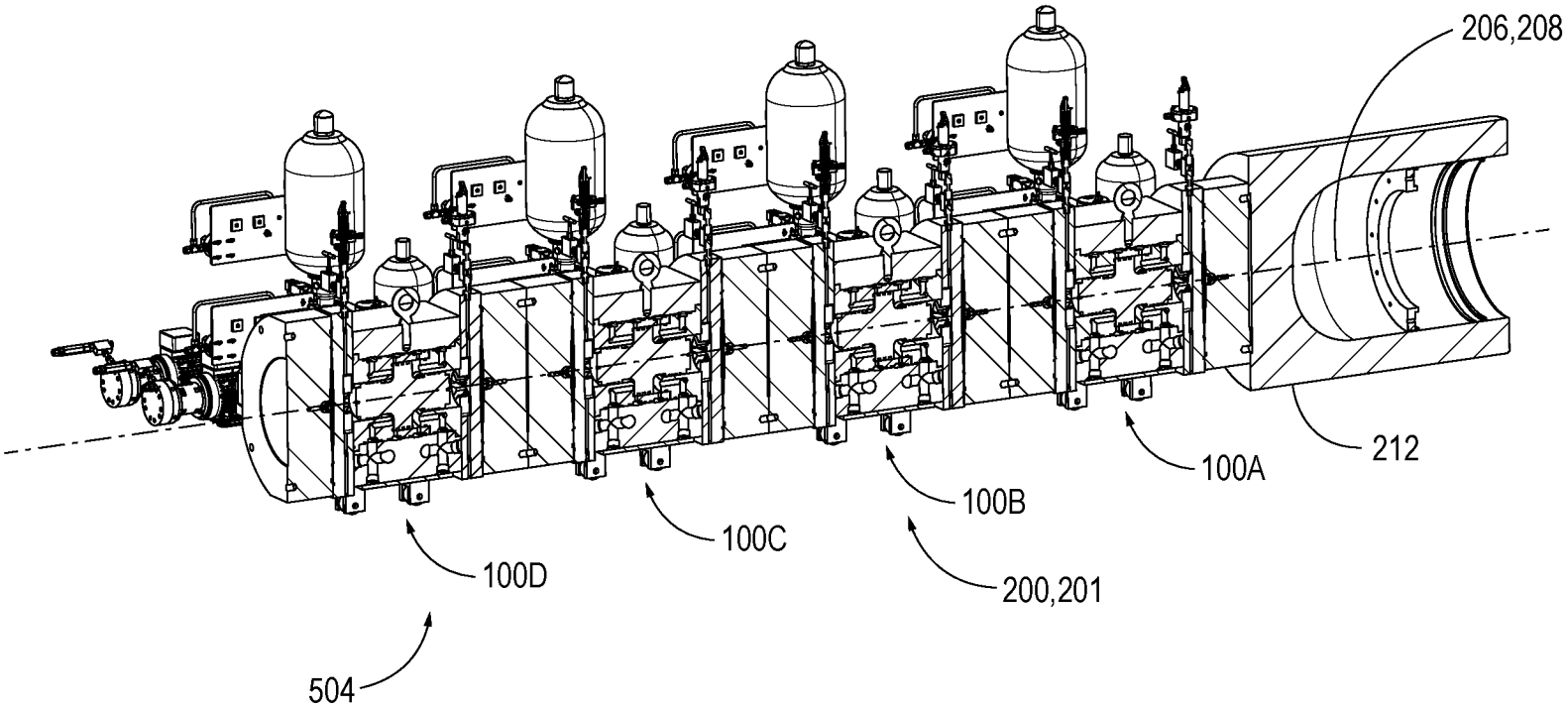
FIG. 27 is a cross-sectional view of the system of FIG. 26.

Referring to FIGS. 26-27, a clamping mechanism 504 provides a different embodiment based on the four tie rod embodiment. The clamping mechanism 504 comprises a base plate 520 and end plate 522 that are connected by four tie rods 524, and a clamp actuator 512 mounted to the base plate. In this embodiment, pre-tensioning nuts 526 are mounted on the tie rods 524 at the base plate 520 and apply an initial preload to the stack 201 before operation. The remainder of the required clamping force is then made up by the clamp actuator 512. As the clamping actuator 512 pressure is applied, a thermal expansion gap 513 is created at the base of the actuator to accommodate thermal expansion.

One benefit of this embodiment is that the pre-tensioned of the tie rods 524 creates a safety if the clamp actuator 512 fails such that the stack 201 is contained to the initial preload. However, service of each compressor module 100 may be more challenging than some of the other embodiments since the tie rods 524 are mounted more closely to the compressor modules.

Figure 28:
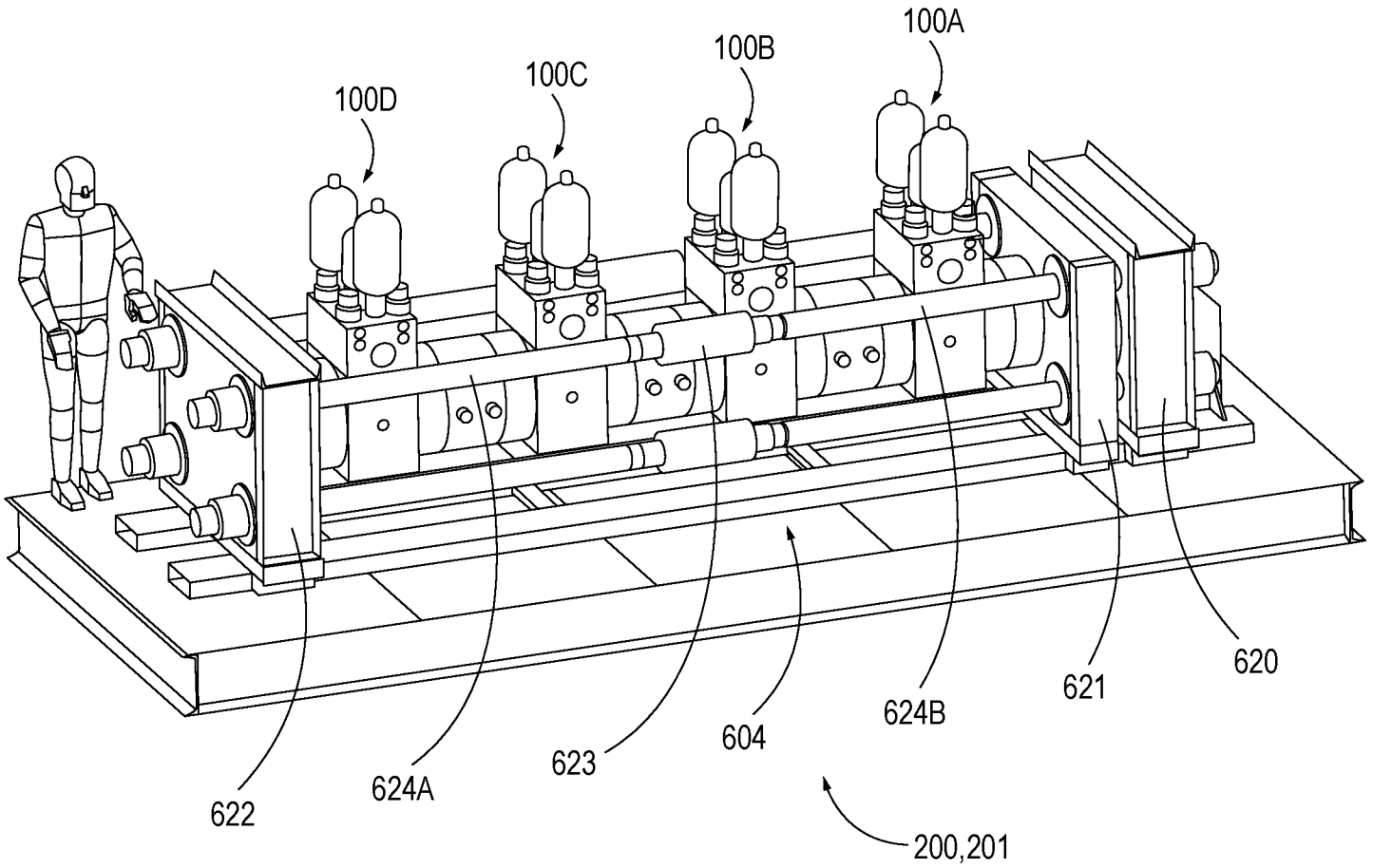
FIG. 28 is a front perspective view of another high-throughput compressor system with stacked compressor modules in accord with embodiments of the present disclosure.

Referring to FIG. 28, an embodiment of the clamping mechanism 604 provides a different embodiment based on the four tie rod embodiment. The clamping mechanism 604 comprises a base plate 620 and end plate 622 that are connected by four tie rod assemblies, each including a first tie rod 624A and a second tie rod 624B connected by a coupler 623. In embodiments, an additional plate 621 is mounted inside the base plate 620. In this embodiment, the coupler 623 provides for ease of assembly and service by separately receiving the first and second tie rods 624A, 624B, which allows for the first and second tie rods to be relatively shorter and able to be installed from each respective side of the stack instead of assembling one long tie rod across the entire stack. In embodiments, the coupler 623 is a threaded collar. In other embodiments, the coupler 623 may provide some or all of the clamping load and thermal accommodation. In the illustrated embodiment, the tie rods 624A-B are entirely outside of the modules 100, providing easier access for lifting the modules out of the stack.

Figure 29:
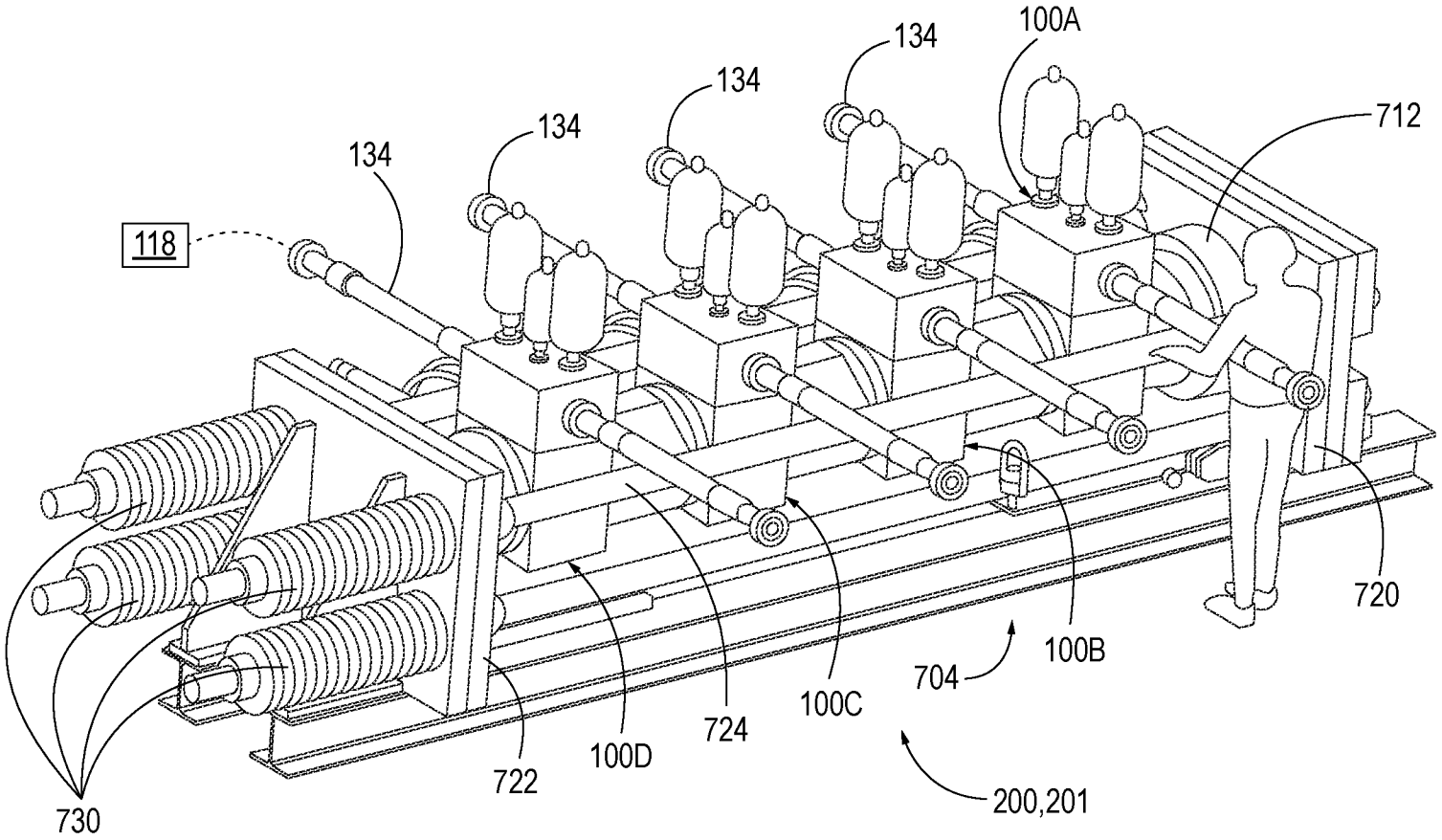
FIG. 29 is a front perspective view of still another high-throughput compressor system with stacked compressor modules in accord with embodiments of the present disclosure.

Referring to FIG. 29, an embodiment of the clamping mechanism 704 provides a variation on the four tie rod concept. The clamping mechanism 704 comprises a base plate 720 and end plate 722 that are connected by four tie rods 724. In this embodiment, Belleville washers 730 are mounted on the tie rods 724 at the end plate 722 and to apply a clamping load to the stack 201. The Belleville washers are springs that are mounted to be biased in the direction of the clamping force. In use, the Belleville washers 730 receive the axial load from thermal expansion and may compress under this load while maintaining the requisite clamping force against the stack 201. For stacks 201 of a different number of size of compressor modules 100, the clamping mechanism 704 may be adjusted by selecting Belleville washers 730 of different sizes or a different number stacked. Additional clamping force is provided by the clamp actuator 712.

Another embodiment of the present disclosure incorporates a hydraulic actuator (such as clamp actuator 212) to apply initial load and a threaded lock ring (not illustrated) to mechanically maintain the load. This eliminates piston seal failure as a failure mode. However, this approach provides limited thermal accommodation, or requires an adjustable lock ring.

In other embodiments, the clamp actuator 212 is modified to minimize axial length, reducing the overall footprint of the stack 201. If the parameters of the high throughput compressor system 200 and the compressor modules 100 are known, the length of the piston 233 and the cylinder 232 can be decreased to a minimum size that is capable of providing the corresponding required reactive clamping force and thermal accommodation. Additional concepts may be employed to reduce overall piston size, such as introducing a lever (e.g., a single lever arm or compound lever) functionally between the piston and the stack 201, for example with one end of the lever rigidly affixed to the piston and the other end of the lever rigidly affixed to the second compressor head 51 of the first compressor module 100A. The fulcrum of the lever may be mounted to the skid 228 or incorporated with other fixed parts of the clamping mechanism 204/304/404/504/604/704. Such a lever arm multiplies the linear force of a downsized piston.

Staging and Reconfigurability Embodiments of the high throughput compressor system 200 provide several potential arrangements of interconnecting and controlling the plurality of compressor modules 100 to customize a tank-filling operation. In various embodiments, some or all of the compressor modules 100 may be operatively arranged in parallel to pressurize a larger volume of process gas than would be accomplished by a single compressor module 100 over a period of time. In some embodiments, some or all of the compressor modules 100 may be operatively arranged in series to progressively pressurize process gas to a higher pressure than would be accomplished by a single compressor module 100 or a single constituent compressor head. In certain embodiments, the high throughput compressor system 200 is controlled and configurable to switch between such modes, or to combine such modes, e.g. some modules 100 operating in series and some modules 100 operating in parallel. For example, many or all of the diaphragms 5 can be used in parallel to start filling a tank 256 at low pressure. In this embodiment, some compressor heads 31, 51 may be low pressure heads 31, and some may be high pressure heads 51. In this mode, both high 51 and low 31 pressure heads are used to pressurize process gas to the pressure of the low pressure head 31 or less. Then as the pressure rises the system can be reconfigured to be a two-stage compressor (i.e., first and second stages of different pressure in series) by switching valves. In this embodiment, the low pressure head 31 pressurizes gas from a low pressure to a medium pressure, and this medium pressure gas is fed to the high pressure head 51 that pressurizes the process gas from a medium pressure to a high pressure. The heads 31, 51 can be configured such that the compressor system 200 can have as many stages as are desired for optimizing the tank fill process.

In embodiments, the compressor modules 100 are mechanically driven, e.g. with a cam driven shaft. In other embodiments, the compressor modules 100 are hydraulically driven. In order to provide high throughput and high pressure of process gas under the physical constraints of hydraulic power and diaphragm actuation, the compressor modules 100 of the present disclosure are configured to operate at high speeds with precision to prevent damage to any components. To this end, embodiments of the compressor modules 100 implement fast valving, particularly in a main stage valve 250 ("MSV 250") controlling the hydraulic supply, and damping of moving components such as pistons or valves.

In embodiments, one or more compressor modules 100 may have compressor heads 31, 51 that are different from the heads of other compressor module(s) with regard to pressure discharge, throughput, and/or size. In some non-illustrated embodiments, a compressor module 100 may have compressor heads 31, 51 that are different from each other, or a different number of compressor heads such as one, three, four, or more compressor heads.

Figure 22:
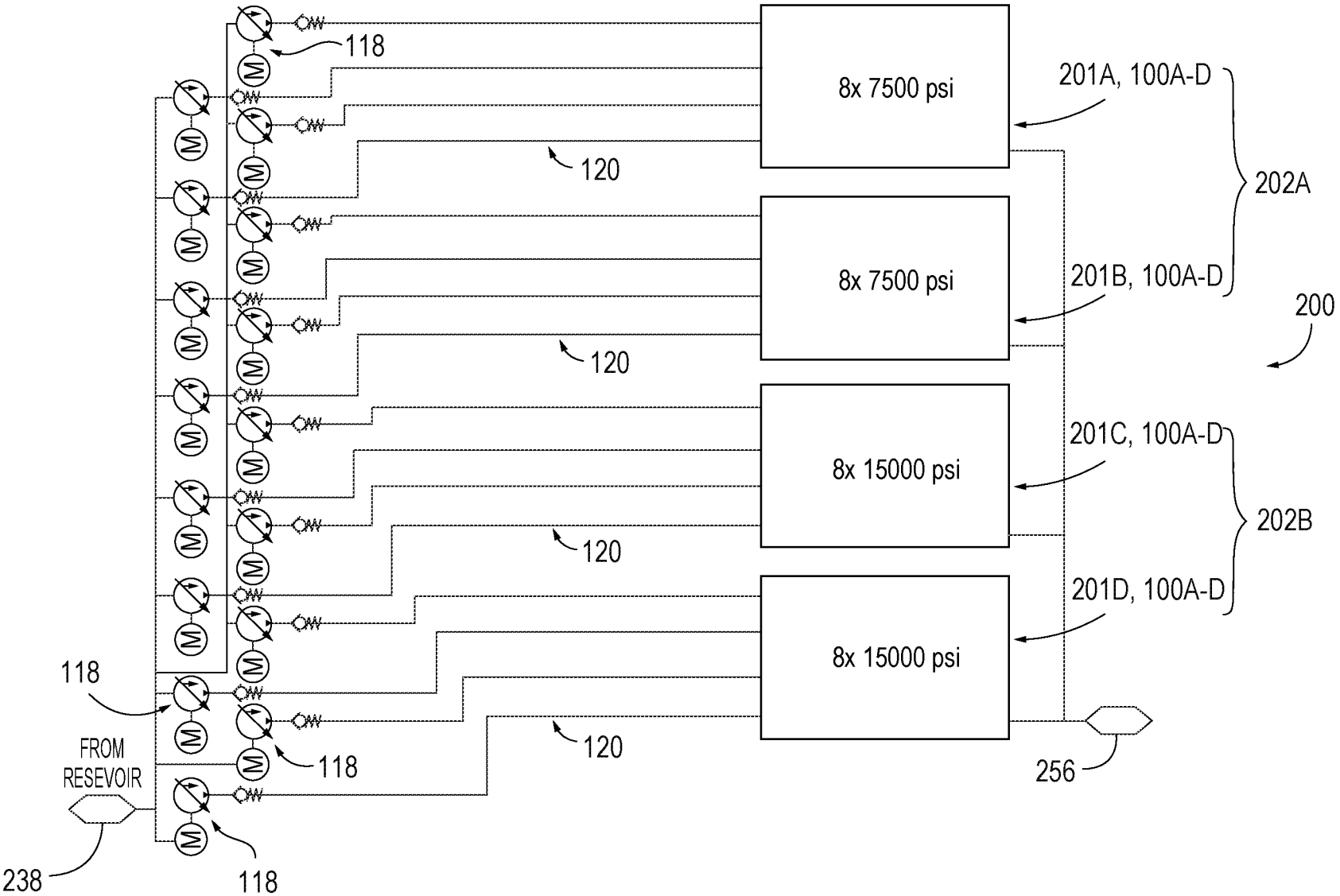
FIG. 22 is a hydraulic circuit diagram of a staged arrangement of multiple stacks of the high-throughput compressor system of FIG. 1 in accord with embodiments of the present disclosure.

Referring to FIG. 22, an embodiment of the high-throughput compressor system 200 includes two stages 202A and 202B. In certain embodiments, components of the compressor system 200 are configured for process gas inlet at 120 bar. In some embodiments, each stage 202A-B is split into two stacks 201A-B and 201 C-D respectively; each stack 201A-D comprising four compressor modules 100A-D, eight compressor heads 31, 51, and four hydraulic drives 110. In certain embodiments, each hydraulic drive 110 has a dedicated HPU 118 with a single pump/motor combination or a dedicated pump/motor group. This arrangement is advantageous from an operational flexibility perspective, in that an individual hydraulic drive 110 (serving two compressor heads) can be taken offline, and its corresponding HPU 118 pump(s)/motor(s) turned off completely, while the rest of the compressor system 200 continues to operate. In one embodiment of a two-stage, single pressure supply scenario, each HPU 118 comprises a 250 hp motor and a pump sized at either 270 or 360 cc/rev. The flow requirements may be satisfied with a 2" ID supply rail hose, and return rails can be joined into a single large, welded pipe.

Figure 23:
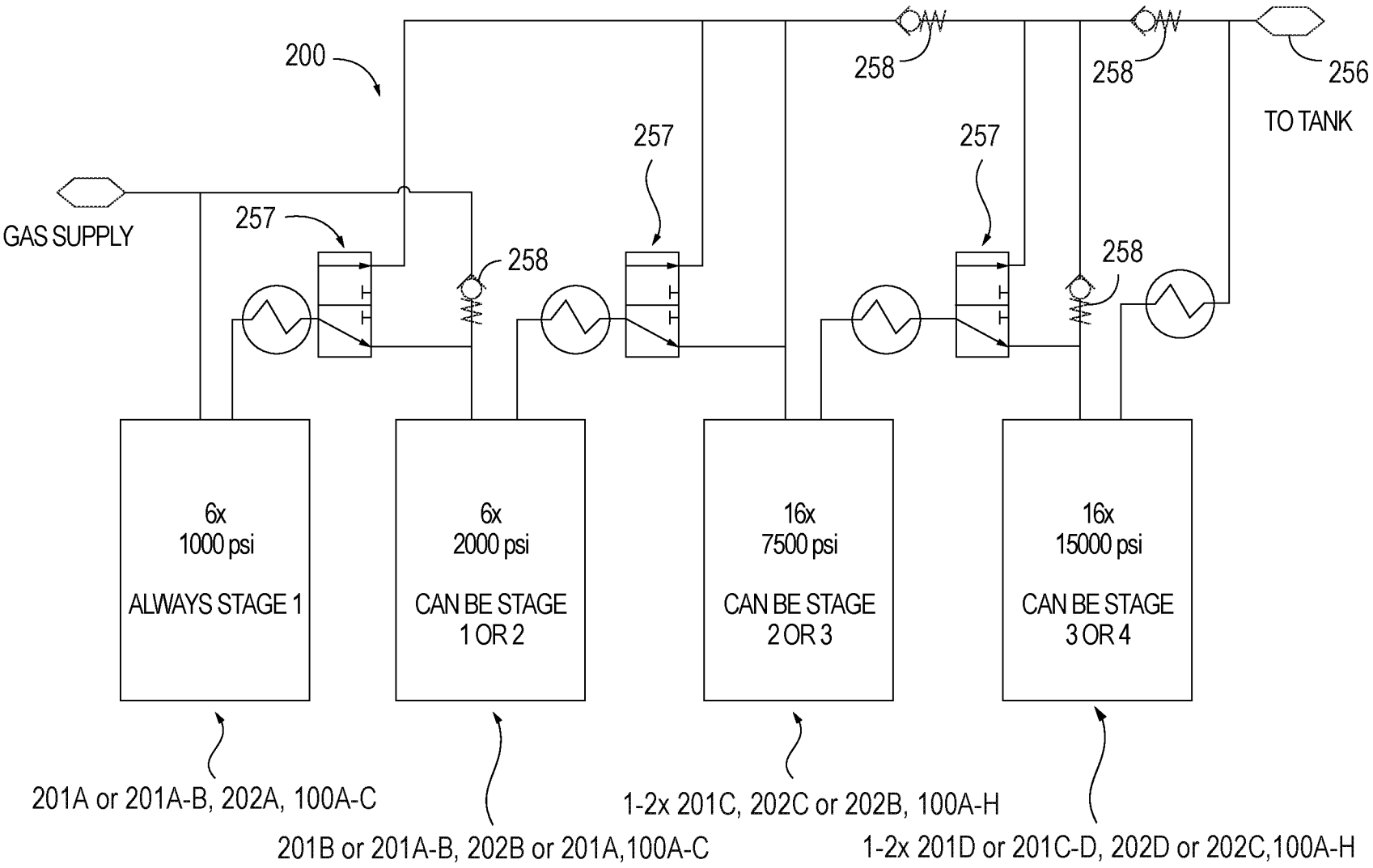
FIG. 23 is a hydraulic circuit diagram of another staged arrangement of multiple stacks of the high-throughput compressor system of FIG. 1 in accord with embodiments of the present disclosure.

Referring to FIG. 23, another embodiment of the high-throughput compressor system 200 is illustrated with four stages 202A-D of increasing pressure output and stage bypassing to allow reconfigurability. In some embodiments, three bypass valves 257 are implemented respectively preceding the second, third, and fourth stages 202B-D to selectively bypass these latter stages. With stage bypassing, when the tank pressure is low, only the lower pressure stages may be doing the compression work, and in one embodiment the discharge process gas may bypass the upper stages. This embodiment avoids pressure drop through the additional lines, check valves and intercoolers of the upper stages, improving efficiency. In embodiments, the bypass valves 257 are three-way valves or an equivalent combination of 2-way valves. It will be appreciated that the compressor system 200 may operate when the tank 256 pressure is at any level within the operating parameters, i.e., from 0-100% of the target tank fill pressure. Accordingly, the compressor system may begin filling a higher pressure tank 256 with the high pressure stages.

In the illustrated embodiment of FIG. 23, the first stage 202A is the lowest pressure stage and comprises six compressor heads 31, 51 arranged as three compressor modules 100A-C, with each compressor head configured to pressurize process gas to 1,000 psi. The second stage 202B is the second lowest pressure stage and comprises three compressor modules 100A-C totaling six compressor heads 31, 51, with each compressor head configured to pressurize process gas to 2,000 psi. The first and second stages 202A, 202B may be in separate respective first and second stacks 201A, 201B or arranged in a single stick 201A-B. The third stage 202C is the second highest pressure stage and comprises sixteen compressor heads 31, 51 arranged as eight compressor modules 100A-H in one or two stacks 201C, with each compressor head configured to pressurize process gas to 7,500 psi. The fourth stage 202D is the highest pressure stage and comprises eight compressor modules 100A-H in one or two stacks 201D totaling sixteen compressor heads 31, 51, with each compressor head configured to pressurize process gas to 15,000 psi. Generally, the stages 202A-D may be referred to by their relative output pressure. One or both of the first and second stages 202A-B may be considered "low pressure stages" while one or both of the third and fourth stages 202C-D may be considered "high pressure stages;" alternatively, the second and third stages 202B-C may be considered "medium pressure stages." In some embodiments, the high-throughput compressor system 200 may increase the overall process gas throughput by including plumbing for a given compressor head 31, 51 to be used for multiple stages, providing selective gas configurability. Although the lower pressure heads 31, 51 may not be capable of use as high pressure stages when the gas discharge pressure is high, the higher pressure heads 31, 51 and components (e.g., high-pressure circuit 134 and/or medium-pressure circuit 132) can be used as a lower pressure stages when the process gas discharge pressure of the system is low, and the overall pressure increase does not yet require as many compression stages. The reconfiguration of the gas compression heads to serve as different stages may provide an increase in flow throughput and consequently e.g. reduce tank filling times.

In some embodiments such as FIG. 23, the high-throughput compressor system 200 comprises four check valves 258 to implement the gas configurability option. This configuration allows the second stage 202B to also selectively function as the first stage (e.g., outputting process gas at 1,000 psi), the third stage 202C to also selectively function as the second stage (e.g., outputting process gas at 2,000 psi), and the fourth stage 202D to also selectively function as the third stage (e.g., outputting process gas at 7,500 psi). This embodiment may result in a gain of up to about 15% in flow throughput over the course of a tank fill compared to sequentially running the stages 202A-D individually (e.g. 11.5 kg/min vs 10 kg/min). When the outlet pressure is low (e.g. 30 to 85 bar for hydrogen process gas), only a single compression stage is needed, so all of the compressor heads 31, 51 may be plumbed in parallel and configured to provide the pressure of the first stage 202A. When the outlet pressure increases (e.g. 85 to 250 bar), only two compression stages are needed, and roughly ¾ of the total compressor displacement may be used as the first stage 202A, and the remaining ¼ may be used as the second stage 202B. The increased flow rates of this embodiment are most significant when the system can operate as 1 or 2 stages, but this may only possible for about 5% and 20% (respectively) of the total duration of the tank fill. Generally, the compressor heads 31, 51 of any stage 202A-D are able to provide the selective operation at other desired pressures as long as sufficient pressure is applied to the diaphragm 5; in certain embodiments this pressure is due to the suction condition applied to the compressor head, for example the suction pressure defined by the check valve 258 at the outlet port 7 (see also FIGS. 6, 15)

It will be appreciated that embodiments of the present disclosure may comprise various numbers and physical arrangements of stages 202, stacks 201 per stage 202, compressor modules 100 per stack 201, compressor modules 100 per stage 202, compressor heads 31, 51 per compressor module 100, and compressor heads 31, 51 per stage 202. Moreover, embodiments may have various pressure ratings of the compressor heads 31, 51. Accordingly, embodiments of the diaphragm compressor system 200 comprise from one to ten stages 202 with particular embodiments comprising one, two, three, four, five, six, seven, eight, nine, ten or more stages 202. Embodiments of the diaphragm compressor system 200 comprise from one to ten stacks 201 or more and any number of the stacks may comprise one or more stages 202 (for example, stack 201 in FIG. 1 may be configured with compressor modules 100A-B comprising a first stage 202A and compressor modules 100C-D comprising a second stage 202B). In some embodiments, an individual stack 201 comprises one, two, three, or more stages 202. Embodiments of the diaphragm compressor system 200 comprise from one to twelve or more compressor modules 100 per stack 201 and, similarly, one to twenty-four compressor heads 31, 51 per stack, or any ranges therebetween. Other embodiments comprise stacks 201 with different numbers of compressors 100 or compressor heads 31, 51 per stack. Certain embodiments of the diaphragm compressor system 200 comprise from one to six compressor heads 31, 51 per compressor module 100.

The output performance of embodiments of the diaphragm compressor system 200 may likewise have various configurations system-wide and various output configurations among the constituent compressor heads 31, 51, modules 100, and stages 202. For compressed hydrogen process gas, embodiments of the diaphragm compressor are configured to output pressures up to 30,000 psi or more. Embodiments of the diaphragm compressor system 200 comprise stages 202 that each have a compression ratio in a range of about 1:1 to 10:1 or a range of about 2:1 to 6:1; such ratios may be distinct from each other. In certain embodiments, the compressor system 200 comprises a first stage 201A outputting process gas at about 40-7,500 psi and an additional stage (e.g., second stage 201B, third stage 201C, and/or fourth stage 201D) outputting process gas at about 1,000-15,000 psi. In other embodiments, the compressor system 200 comprises a first stage 201A outputting process gas at about 100-7,500 psi, optionally a second stage 201B outputting process gas at about 200-15,000 psi, optionally a third stage 201C outputting process gas at about 300-25,000 psi, and optionally a fourth stage 201D outputting process gas at about 400-30,000 psi.

In embodiments, the high-throughput compressor system 200 is configured for a tank-filling operation from 30 to 1000 bar, with a 4-stage system comprising stages 202A-D. This is generally similar to FIG. 23, comprising a first stack 201A of compressor modules 100 comprising a first stage 202A of the lowest pressure, a second stack 201B of compressor modules 100 comprising a second stage 202B of a higher pressure than the first stack, a third stack 201C of compressor modules 100 comprising a third stage 202C of a higher pressure than the second stack, and a fourth stack 201D of compressor modules 100 comprising a fourth stage 202D of a highest pressure.

Disclosed embodiments and features of the high throughput compressor system 200 for hydrogen process gas can meet a throughput target of up to 10 kg/min or more compressed hydrogen at a minimum outlet pressure of 875 bar, with embodiments capable of 1,000 bar or more. Embodiments provide a compact compressor module 100 that can be stacked together with one or more additional compressor modules and plumbed to achieve essentially any required throughput. For some embodiments, the design is a system with two stages 202A-B with approximately sixteen diaphragms 5 (each compressor head 31, 51 having one diaphragm 5) per stage 202, which may be eight compressor modules 100 per stage and is designed for 120 bar inlet pressure. The present disclosure can be applied to a larger system with lower inlet pressure such as 30-50 bar inlet pressures, requiring four stages 202A-D to achieve compression up to 1,000 bar.

Certain embodiments provide two stacks 201 of four compressor modules 100 per each stage 202, although other arrangements are feasible and contemplated. Each module 100 may actuate two compressor heads 31, 51 of the same size and operating pressures, as would all modules 100 within the same stack 202, and thus have common suction and discharge gas pressures. This has benefits for simplicity of gas plumbing (e.g., hydraulic components such as HPU 118, pressure circuits 130, 132, 134, 138 or main stage valve 250 are the same and may be operatively connected to multiple compressor modules 100), and also reduction in accumulator count and size (e.g., one or more of accumulators 136A-E (see, e.g., FIGS. 2-3, 15).

In some embodiments, one of the compressor modules 100 can be deactivated within the stack 201 and still allow the stack to operate. The compressor module may be deactivated for servicing, repair, or replacement, e.g. by isolating the module 100 by valving. Because the rest of the modules 100 in the stack 201 continue to operate, maintenance can be temporarily deferred for a more convenient time if desired. Additionally, for some embodiments such as embodiments with multiple stacks 201 per stage 202, the compressor system 200 may provide continued operation during service, albeit at a reduced throughput. This could be achieved by valving and deactivating one stack 201A while the other stack 201B of the stage 202A continues. Consequently, the other stacks 201A of other stages 202B before or after the compressor module being serviced may need to be shut down accordingly to match pressure ratios per stage, but this may nonetheless allow continued operation during service and make emergency service requirements less detrimental to overall system operation. Effectively, by having multiple stacks 201 per stage 202, the system may create a redundancy effect which is beneficial from a failure and service perspective.

Damping of the Hydraulic Actuator As shown generally in FIGS. 6-11 with certain embodiments detailed in FIGS. 8 and 11, certain embodiments of the compressor module 100 comprises a damping mechanism 105 that includes venting of the work oil being compressed in the direction of travel of the actuator piston 126. Generally, in some embodiments, the actuator piston travel distance in a discharge stroke may be about 0.5-3 inches, about 1-2.5 in., about 0.5 in., about 1 in., about 1.5 in., about 2 in., about 2.5 in., about 3 inches, or about 0.5 to 4 inches. In embodiments, the travel time of the actuator piston is less than 100 milliseconds (ms). In certain embodiments, the travel time is about 30-95 ms, about 45-75 ms, about 50-70 ms, or about 60-65 ms. Additionally, in embodiments the dwell time of the actuator piston 126 is less than about 50 ms, less than about 25 ms, about 5-30 ms, about 10-25 ms, or about 15-20 ms. Accordingly, the actuator piston 126 reciprocates with quick starts and quick stops including possible impact with a hard stop 106 formed in the drive housing 114. Embodiments of the present disclosure comprise a damping mechanism 105 to aid in stopping the actuator piston 126 as it approaches the end of a stroke to decrease the impact velocity against the hard stop 106. The damping mechanism 105 is provided on both sides of the actuator piston 126 and in each of the first and second actuation volume 144, 146.

The drive housing 114 comprises a plurality of ports 147 including the first and second distal ports 148A, 148B that are in fluid communication with components of the hydraulic drive 110. The hydraulic drive 110 and the HPU 118 are configured to provide a variable-pressure supply of work oil to the drive cavity 116 through one or more of the plurality of ports 147. One or more of the plurality of ports 147 is configured to supply work oil to the hydraulic drive 110, and one or more of the plurality of ports is configured to vent work oil out of the hydraulic drive. In the illustrated embodiments, the plurality of ports 147 is configured to both supply and vent work oil from the hydraulic drive 110 depending on the direction of travel of the actuator piston 126, as with the first and second distal ports 148A, 148B of FIGS. 6-8. The first and second distal ports 148A, 148B are each operatively coupled to a respective main stage valve 250 to control the supply and vent operations.

Referring to FIGS. 6-8, the drive housing 114 comprises orifices 152 for both the first and second actuation volumes 144, 146. The orifices 152 are operatively connected to either a first radial port 153 at the first actuation volume 144 or a second radial port 155 at the second actuation volume 146. In other embodiments and as shown in FIGS. 10-11, the damping mechanism 105 comprises a first plurality of orifices 152A and a second plurality of orifices 152B in communication with the drive cavity 116. In embodiments, the orifices 152, 152A, 152B are also in communication with one or more ports of the plurality of ports 147. In embodiments, one or more of the orifices 152, 152A, 152B are in communication with the plurality of ports 147 for both venting and supply of work oil. In certain embodiments, the orifices 152, 152A, 152B at the first actuation volume 144 are in fluid communication with the first distal port 148A and the orifices 152, 152A, 152B at the second actuation volume 146 are in fluid communication with the second distal port 148B. For any such embodiments, the work oil that is vented from the drive cavity 116 through the orifices 152, 152A, 152B and one or more of the plurality of ports 147 is supplied to the reservoir 230 or an accumulator such as the recovered oil accumulator 136D.

During the discharge cycle of the first compressor head 31, the hydraulic drive 110 is configured to provide the variable-pressure supply of work oil through the second distal port 148B to the second actuation volume 146 to press against the second side 145 of the actuator piston to drive the actuator piston, driving the first diaphragm piston 3 toward the corresponding first compressor head 31, intensifying the work oil in the first variable volume region 54 to an intensified pressure, and actuating the diaphragm 5 of the first compressor head to the second position. As the actuator piston 126 moves, the damping mechanism 105 comprises the drive cavity 116 being configured to dampen the drive motion of the actuator piston 126 due to a volume of work oil in the opposing first actuation volume 144 with outflow restricted (i.e., the first actuation volume is in the direction of travel of the actuator piston). In certain embodiments, the volume of work oil vents through the first plurality of orifices 152, 152A and out of the first actuation volume 144, providing space for the actuator piston 126. Therefore, the damping force of the damping mechanism 105 is a function of the number and size of the plurality of orifices 152, 152A, (and 152B discussed below), provided that the orifices freely flow to vent.

At the beginning of the actuator piston 126 stroke for the discharge cycle of the first compressor head 31, the first plurality of orifices 152, 152A is open to the first actuation volume 144. Subsequently, the first plurality of orifices 152, 152A is progressively covered by the actuator piston 126 as it moves along its driving stroke, which constricts outflow through the first plurality of orifices and increases the damping force of work oil remaining in the first actuation volume 144 against the first side 143 of the actuator piston. In other words, as the obstruction by the actuator piston 126 occurs the effective size of the plurality of orifices 152, 152A decreases and the damping force increases because there is less area for the work oil in the first actuation volume 144 to escape. In this manner, the damping mechanism 105 provides an increasing damping force configuration due to work oil that remains in the first actuation volume 144 having access to less available venting area.

In some embodiments and as shown in FIGS. 10-11, the drive housing 114 further comprises a second layer of orifices illustrated as a plurality of second or supplemental orifices 152B in communication with the first actuation volume 144, the plurality of supplemental orifices being staggered axially relative to the plurality of first orifices 152A. In the illustrated embodiments, the plurality of supplemental orifices 152B are located relatively closer to the respective compressor head 31, 51 and further along the discharge stroke of the actuator piston. In other embodiments, the plurality of supplementary orifices 152B may partially overlap axially with the plurality of first orifices 152A. The plurality of supplemental orifices 152B dampen the driving of the actuator piston 126 due to the volume of work oil in the first actuation volume 144 that slowly vents through the plurality of supplemental orifices 152B during driving of the actuator piston. As the actuator piston continues its stroke past the first plurality of orifices 152A, the actuator piston 126 progressively obstructs the plurality of supplementary orifices 152B. As the obstruction increases, the damping force increases due to work oil that remains in the first actuation volume 144 having access to less available venting area.

In some embodiments, the second orifices 152B are smaller than the first orifices 152A, which smaller diameter provides a relatively higher damping force due to less available venting area compared to an equal number of first orifices. When arranged as shown in FIG. 11, as the actuator piston 126 completes its stroke from right to left, the damping mechanism 105 provides an increasing damping force configuration due to several factors: progressively obstructing the first plurality of orifices 152A, completely blocking the first plurality of orifices 152A, the remaining second plurality of orifices 152B being relatively smaller, progressively obstructing the second plurality of orifices 152B, and finally completely blocking the second plurality of orifices 152B. Accordingly, the damping mechanism 105 increases the damping force against the actuator piston 126 as it nears the end of its stroke.

Embodiments of the first and second orifices 152A-B and their associated porting (including the plurality of ports 147) may have various shapes, sizes, and orientations. In embodiments one or both of the first and second orifices 152A-B are circular, though other embodiments may be elongated in the direction of actuator piston driving, for example oval shaped with a long axis parallel to the direction of actuator piston 126 driving. In some embodiments, the first and second orifices 152A-B are formed in one or more surfaces of the drive housing 114 oriented at a non-parallel angle relative to the actuator piston axis 208. In embodiments, the orifices 152A-B are formed in surfaces extending substantially perpendicular to the actuator piston axis 208. In some embodiments, the first and supplemental orifices 152A-B extend radially away from the drive cavity 116 and the actuator piston 126.

In certain embodiments, 24 orifices 152 are provided in the drive cavity 116, with 12 orifices in the first actuation volume 144 and 12 orifices in the second actuation volume 146. Similarly, in embodiments, up to 24 first orifices 152A and 24 second orifices 152B are formed in the drive cavity 116 or more generally, in embodiments the number of orifices 152 may be any number from 1-48 orifices. In other embodiments, the number of orifices 152 may be greater or smaller, such as each actuation volume 144, 146 having up to 100 or up to 200 orifices or more. In embodiments, additional layers of orifices 152 may be included. The number of orifices may be different in different layers, for example the number of first orifices 152A may be different than the number of second orifices 152B.

Referring to FIGS. 7-8, in embodiments the drive housing 114 comprises a slight annular gap 151 between the actuator piston 126 and the drive cavity 116 and extending around an outer surface of the actuator piston (e.g., the circumferential outer surface in the illustrated embodiment). The annular gap 151 is in fluid communication with both the actuation volume 144 and the second actuation volume 146 and, in some embodiments, is configured to dampen the driving of the actuator piston 126 throughout the piston stroke in either direction by maintaining a small volume of work oil that is not in direct communication with any of the plurality of ports 147. Accordingly, in certain embodiments, the annular gap 151 is positioned to dampen the driving of the actuator piston 126 after the orifices 152 are obstructed by the actuator piston. When the orifices 152 are fully closed leaving the plurality of ports 147 unable to vent, the relatively small annular recess 151 provides a small amount of flow area and acts like a fixed orifice during final damping. As shown in FIG. 8, as the actuator piston 126 strokes to the left, work oil leaves the actuation volume 144 via the orifices 152. In certain embodiments, the circumferentially-arranged orifices 152 are fully closed off at the end of stroke; in other embodiments the orifices are fully closed off slightly before. The dampening capability of the annular gap 151 is at least in part due to compressibility of the work oil.

Referring to FIGS. 9-11, in embodiments, additional or final damping is provided by venting work oil through the first opening 154 and the internal porting 127A, 127B of the actuator piston 126. As shown, the internal porting 127A is in fluid communication with the plurality of ports 147, in particular first proximal port 148C and (indirectly) first distal port 148A. In embodiments, the first and second proximal ports 148C, 148D are low-pressure ports supplying the low-pressure rail 130 and comprising a check valve preventing a vent flow out of the drive cavity. A landing orifice 107 connects the first proximal port 148C to the first distal port 148A, and vented work oil from the internal porting 127 flows out through the first distal port 148A to a pressurized circuit, accumulator, or the reservoir 230.

The landing orifice 107 is configured (e.g., sized) to provide desired deceleration performance of the actuator piston 126 at the end of its stroke in landing against the hard stop 106 with requisite velocity for intensifying process gas without excessive velocity that may damage components or otherwise inhibit operation. In some embodiments, the first opening 154 and the internal porting 127 vent work oil from the accumulation volume 144 throughout the stroke of the actuator piston; this venting through the first opening may occur during and/or after venting through the first and second plurality of orifices 152A, 152B. In certain embodiments, the internal porting 127 is configured to vent work oil after the first and second orifices 152A-B have been completely blocked. In embodiments, the landing orifice 107 is configured to vent only after the first and second orifices 152A-B by comprising a check valve (not shown) with a threshold pressure set at a relatively high pressure that is only achieved after the first and second orifices 152A-B have been completely blocked. Similarly at the opposite end of the actuator piston 126, in embodiments the internal porting 127B is in fluid communication with the plurality of ports 147 and an additional landing orifice 107.

In some embodiments, aspects of the damping mechanism 105 may be customized or tuned to increase or decrease the damping force against the actuator piston 126. In some embodiments, the landing orifice 107 and/or one or more of the orifices 152 may comprise a removable orifice (not shown) that can be exchanged for orifices of different size or flowrate. One or more orifices 152 may comprise or a removable plug (not shown) to block one or more of the orifices by switching out. In embodiments, one or more of the annular recess 151 or the first and second plurality of orifices 152 are configured to be removable from the drive housing 114 individually or as a ring of orifices. In embodiments, this customization and tuning may optimize performance of the same compressor module 100 in different use cases (e.g., in different stack and staging arrangements or for different process gas output pressures) or in different environments (e.g., in different elevations or climates). In certain embodiments, this customization and tuning may optimize performance of the same drive housing 114 and drive cavity 116 for different pressure ratings of the compressor heads 31, 51. The first and second proximal ports 148C, 148D may be operatively connected to the low-pressure circuit 130 or the medium-pressure circuit 132.

In some embodiments, the drive housing 114 further comprises a removable sleeve insert 115 mounted internally to define the drive cavity 116 and may comprise the plurality of orifices 152, 152A, 152B and the first and second radial ports 153, 155 in whole or in part, along with other components of the drive housing 114. The sleeve insert 115 is subjected to significant loads and wear forces due to the motion of the actuator piston 126 and the pressurization of the drive cavity 116. Therefore, the sleeve insert 115 is removable for replacement after wearing down without requiring replacement of the whole drive housing 114. In embodiments and as illustrated in FIGS. 6-11, the sleeve insert 115 comprises one or more annuli 149A-D in fluid communication with the drive cavity 116 and a respective one or more of the plurality of ports 147. In certain embodiments, a first and second distal annulus 149A, 149B are arranged respectively with the first and second distal ports 148A, 148B and, similarly, a first and second proximal annulus 149C, 149D are arranged respectively with the first and second proximal ports 148C, 148D. In other embodiments not illustrated, one or more of the plurality of ports 147 does not have a corresponding annulus and instead extends through the drive housing 114 and the sleeve insert 115 directly to the first or second actuation volume 144, 146.

Each of the annuli 149A-D extends partially or completely around the actuator piston 126 and operatively couple together the multiple discrete ports that constitute the respective port and the multiple orifices that constitute the plurality of orifices 152, 152A, 152B. For example in FIGS. 10-11, the first distal annulus 149A connects the multiple first distal ports 148A with both of the first plurality of orifices 152A (corresponding radial ports not shown) and the second plurality of orifices 152B (through first radial ports 153) and the first proximal annulus 149C connects the multiple first proximal ports 148C with the first internal porting 127A. In the example of FIG. 7, the first distal annulus 149A connects each of the multiple first distal ports 148A arranged around the actuator piston 126 with the manifold port 117.

In embodiments with first and second compressor heads 31, 51, during the discharge cycle of the second compressor head 51, the drive cavity 116 is configured to similarly dampen the driving of the actuator piston 126. A volume of work oil in the second actuation volume 146 provides damping force and vents through the plurality of orifices 152, 152A during driving of the actuator piston 126. The plurality of orifices 152, 152A are open to the second actuation volume 146 when the driving of the actuator piston 126 begins, and the plurality of orifices are progressively covered by the actuator piston during the driving. Covering the plurality of orifices increases the damping force of work oil remaining in the second actuation volume 146 acting against the second side 145 of the actuator piston 126. In embodiments, the internal porting 127B and corresponding landing orifice 107 provide damping and control the final velocity of the actuator piston 126 impacting the respective hard stop 106.

It will be appreciated that in embodiments, any of the ports and orifices that provide damping can be reversible and configured to provide an actuation supply of pressurized work oil for the actuator piston 126, for example in a discharge cycle of the second compressor head 51. In embodiments, the actuation supply is provided sequentially in a reverse order from the damping sequence above. Accordingly, for the discharge cycle of the second compressor head 51 in FIGS. 9-11, the actuation supply of work oil to the first actuation volume 144, work oil (e.g., low-pressure work oil from the low-pressure circuit 130) begins from the first proximal port 148C and then through the first internal porting 127A of the actuator piston 126 feeding to the first opening 154. Subsequently, the second plurality of orifices 152B is configured to provide additional actuation supply of pressurized work oil via the first distal port 148A. Finally, the first plurality of orifices 152A is configured to provide additional actuation supply of pressurized work oil via the first distal port 148A. In embodiments, this sequential actuation supply provides one or more of the plurality of pressure circuits 120. In some embodiments, one or more ports of the plurality of ports 147 is configured to further supplement the actuation supply of work oil provided by another port. In certain embodiments the first proximal port 148C comprises a bypass check valve (not shown) to provide supplemental flow in addition to the first distal port 148A, which may be configured to avoid cavitation of work oil in the first actuation volume 144 as the actuator piston 126 moves quickly. As discussed above, the initial movement of the actuator piston 126 may be aided by additional forces such as the return of the diaphragm 5 of the first compressor head 31.

The damping mechanism 105 may be advantageous for embodiments of the compressor module 100 with a short stroke of the actuator piston 126, for example about 1" or 2.5", or more generally a stroke below about 7.5". With shorter travel distance, the peak speed of the actuator piston 126 may be lower than with a relatively longer stroke, and deceleration at the end of the stroke may achieve low impact velocities. In certain embodiments, compressor heads 31, 51 that are configured for higher pressures comprise a stroke of about 1" (e.g., about 7,500 psi and above, including embodiments comprising about 7,500 psi and about 15,000 psi and ranges therebetween), whereas compressor heads configured for relatively lower pressure comprise a stroke of about 2.5" (e.g., about 5,000 psi and below, specific embodiments comprising 1,000 psi; 2,000 psi; 5,000 psi; and ranges therebetween).

As discussed above, in certain embodiments of the damping mechanism 105, the actuator piston 126 closes off circumferential primary supply ports (such as the first and second distal ports 148A, 148B) as it reaches the hard stop 106. Dynamic computer simulations of such embodiments of the damping mechanism 105 show that, for embodiments of the actuator pistons 126 with 1" stroke, the impact velocities are less than about 0.2 m/s for nominal conditions and less than about 0.7 m/s for avoiding a failure condition. The simulations assumed nominal radial clearances in a range between about 0.0025-0.010 inches between the actuator piston 126 and inner walls of the drive cavity 116, although smaller clearances are contemplated for other embodiments. For the actuator pistons 126 with 2.5" stroke and higher pressure supply, the impact velocities were less than about 0.3 m/s for nominal conditions and less than about 1.5 m/s for avoiding a failure condition. It will be appreciated that other embodiments may comprise a broader range of values for parameters such as the stroke distance of the actuator piston 126, landing velocity, and output pressure of the compressor heads 31, 51.

Main Stage Valve

In certain embodiments, the high-throughput compressor system 200 comprises one or more main stage valves 250 ("MSV 250") to control the hydraulic drive 110, in particular the flow of work oil to and from the drive cavity 116.

The work oil drives and damps the actuator piston 126, therefore the MSV(s) 250 control the timing (cycle time, travel time) of the actuator piston 126. As detailed above, the actuator piston 126 discharge stroke travel distance may be in a range of about 0.5-3 inches with a travel time of less than 100 milliseconds, other embodiments may range from 0.5-7 inches or more. Accordingly, the timing of the MSV(s) 250 in supplying and venting work oil from one or more of the plurality of pressure circuits 120 must correspond to these parameters.

In some embodiments, the MSV(s) 250 control the interface of the HPU 118 and of the one or more pressure circuits 120 with the hydraulic actuator 112, such interface including both the supply and vent of work oil for the drive cavity 116. In other words, the MSV(s) control a pressurized hydraulic supply of work oil for operating the hydraulic actuator 112 and the MSV(s) may control at least some venting of work oil from the drive cavity 116. In embodiments, the MSV 250 is an actively-controlled valve. In the illustrated embodiment, the MSV 250 is a three-way valve as shown in FIGS. 18A (vent stage) and 18B (supply stage).

Figure 18A:
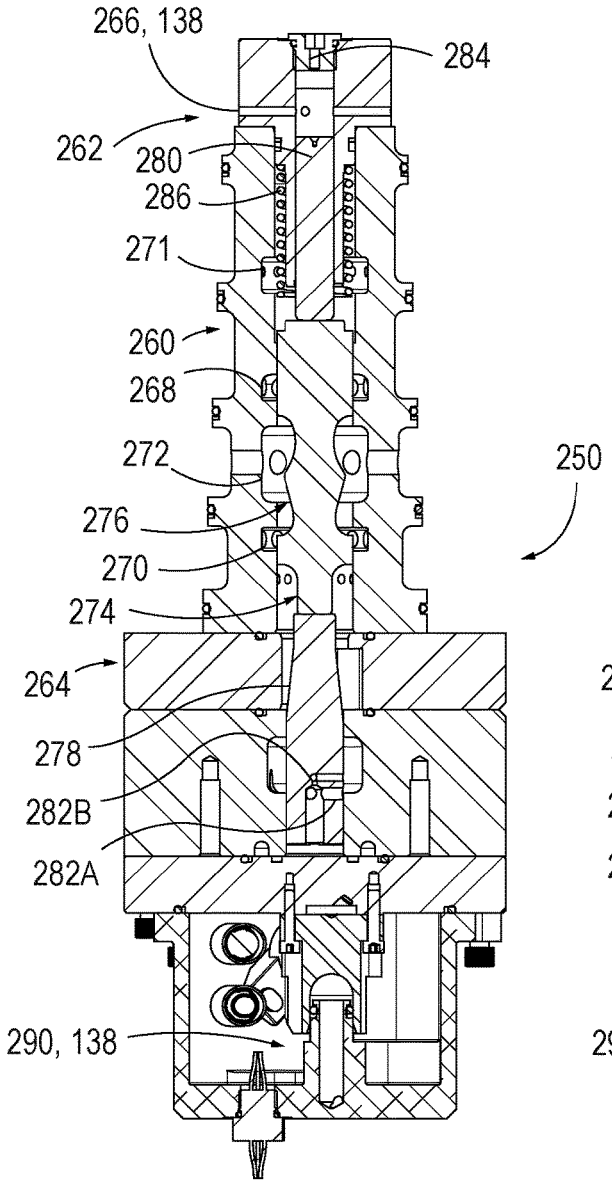
FIG. 18A is a cross-sectional view of a main stage valve of the high-throughput compressor system in accord with embodiments of the present disclosure in a vent position.
Figure 18B:
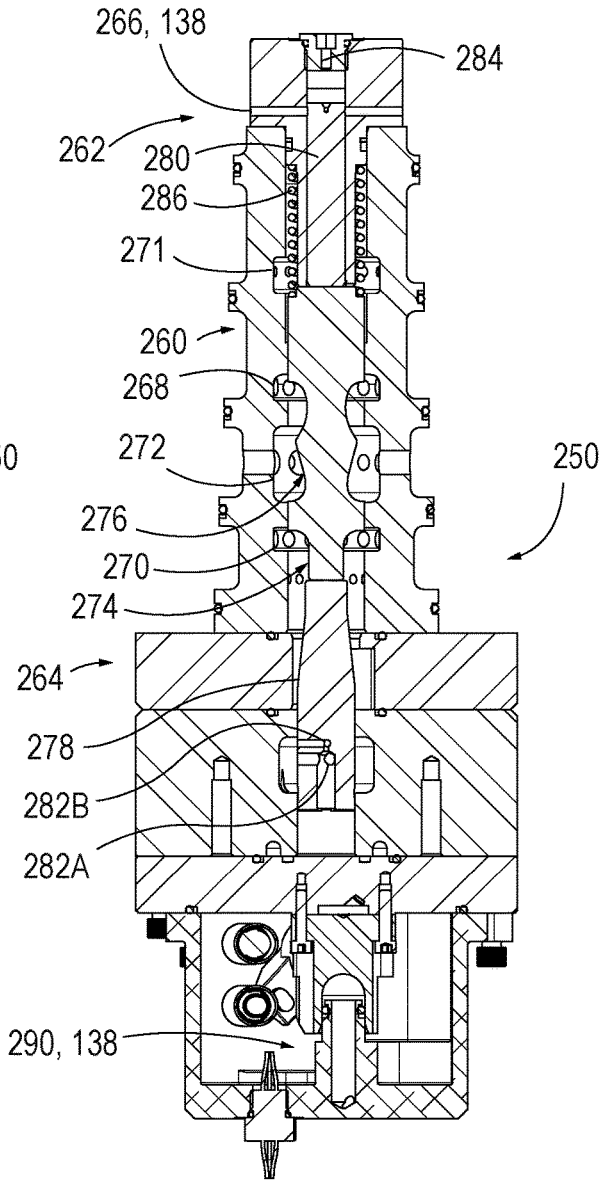
FIG. 18B is a cross-sectional view of the main stage valve of FIG. 18A in a supply position.

Referring to FIGS. 18A-B, in embodiments, The MSV 250 for controlling a diaphragm compressor system 100 comprises a valve body 260 comprising a first end 262 and a second end 264, a pilot port 266 proximate the first end, a supply port 268, a first vent port 270, a second vent port 271, and a cylinder port 272. The MSV 250 comprises a pin subassembly 274 for reciprocating in the valve body 260, the pin comprising a spool 276, a pilot pin 278 proximate the second end 264, and a return pin 280 proximate the first end 262. In certain embodiments, the MSV 250 is mounted to the valve manifold 244 or the drive housing 114. In some embodiments, each of the vent port 270 and the cylinder port 272 are in fluid communication with the drive cavity 116 and the supply port 268 operatively coupled to the hydraulic power unit 118. In embodiments, the position of the pin subassembly 274 selectively blocks one or both of the vent port 270 and the cylinder port 272 to control the flow of work oil between the drive cavity 116 and the MSV 250 along with controlling the flow of work oil between the MSV 250 and any other component(s) attached to the MSV. It will be appreciated that any of the ports may be one or more ports in some embodiments, and in the illustrated embodiment each of the pilot port 266, supply port 268, the first vent port 270, and the cylinder port 272 is a plurality of ports arranged annularly about the pin subassembly 274.

FIG. 18A shows a vent position of the MSV 250 configured for allowing an outflow of work oil from the drive cavity 116, e.g. from work oil in the first or second actuation volume 144, 146 when being compressed by the actuator piston 126 and vented through the plurality of orifices 152. The pin subassembly 274 is configured to move axially to the vent position with the cylinder port 272 in fluid communication with the first vent port 270, such that work oil from the drive cavity 116 flows to the cylinder port 272, through the valve body 260, and out through the first vent port 270. In embodiments, the hydraulic drive 110 further comprises a recovered oil accumulator 136D operatively coupled to the first vent port 270 of the MSV 250 for storing and recycling this work oil in subsequent cycles. In other embodiments, the first vent port 270 is operatively connected to a reservoir 230 of the hydraulic drive 110.

In embodiments, the MSV 250 comprises one or more vent orifices 282A, 282B configured to vent work oil out of the MSV and dampen motion of the pin subassembly 274 when moving into the vent position. The vent orifices 282A, 282B are arranged annularly around the pin subassembly 274. Similar to the damping mechanism 105 of the actuator piston 126, the vent orifices 282A in the MSV 250 are configured to be progressively obstructed as the pin subassembly 274 moves axially, increasing the damping force as the pin reaches the end of its stroke. Accordingly, the pin subassembly 274 moves quickly to the vent position without any hard impact or bounce. In the illustrated embodiment, vent orifices 282B are not configured to be obstructed, but in other embodiments these or additional layers of orifices (not shown) may be configured to be obstructed in addition to the vent orifices 282A.

FIG. 18B shows a supply position of the MSV 250 configured to supply work oil to the hydraulic actuator 112. The MSV 250 is configured to selectively move to the supply position to operatively connect the HPU 118 to the drive cavity 116 during the discharge cycle of the first or second compressor head 31, 51. In embodiments, the MSV 250 supply position is configured to control a discharge stroke of the compressor head 31, wherein the MSV 250 connects one of the pressure circuits 120 to the second actuation volume 146 of the drive cavity 116 to supply pressurized work oil to the second side 145 of the actuator piston 126 to drive the actuator piston and consequently drive the diaphragm piston 3 toward the diaphragm 5 of the first compressor head 31. This connection in embodiments is from the high-pressure circuit 134, medium-pressure circuit 132, or low-pressure circuit 130. The pin subassembly 274 is configured to move axially to the supply position with the supply port 268 in fluid communication with the cylinder port 272, such that work oil flows from the HPU 118 or a pressure circuit enters through the supply port 268, passes through the valve body 260, and exits through the cylinder port 272. An end orifice 284 is located proximate the first end 262 of the MSV 250. The pilot port 266 and the end orifice 284 configured to vent work oil out of the MSV 250 and dampen motion of the pin subassembly 274 when moving into the supply position in a similar manner to the vent orifices 282A, 282B for the vent position.

In embodiments, during a suction cycle of the first compressor head 31, the MSV 250 is configured to move to the vent position (FIG. 18A) to connect the drive cavity 116 of the drive housing 114 to the first vent port 270 of the main stage valve 250, and the hydraulic drive 110 vents work oil from the second actuation volume 146 to the main stage valve 250 through the vent port 270.

In embodiments, one or more of the pilot port 266 and the vent orifice 282A-B comprises a plurality of rows of orifices that are axially spaced. In certain embodiments, this plurality of rows comprises a row of relatively larger orifices proximate the spool 276 and a row of smaller orifices proximate the respective first or second end 262, 264. In some embodiments, the pilot port 266 comprises a ring or layer of removable orifices, or plugs for certain orifices, for fine tuning of the damping performance. Such tuning may be necessary for implementing the MSV 250 with different pressure ratings of compressor heads 31, 51, for utilizing different types of work oil, or for operating at different temperature ranges.

In embodiments, the low-pressure circuit 130 of the hydraulic drive 110 further comprises a recovered oil accumulator 136D operatively coupled to the first vent port 270 of the main stage valve 250. In such embodiments, in the vent position, the main stage valve 250 is configured to supply oil from the drive cavity 116 to the cylinder port 272, through the valve body 260, and exiting the first vent port 270 to the recovered oil accumulator. In some embodiments, the low-pressure circuit 130 comprises the recovered oil accumulator 136D. In certain embodiments, a passive valve 131 (FIG. 17) is operatively connected to the recovered oil accumulator 136D and the drive cavity 116 downstream of the main stage valve 250. During the suction cycle of the first compressor head, the passive valve 131 is configured to supply oil from the recovered oil accumulator 136D to the drive cavity 116. In embodiments, this supply from the recovered oil accumulator 136D may occur at one or more times, for example during a low-pressure stage of tank fill or during a beginning portion of each actuator 126 stroke.

Figure 15:
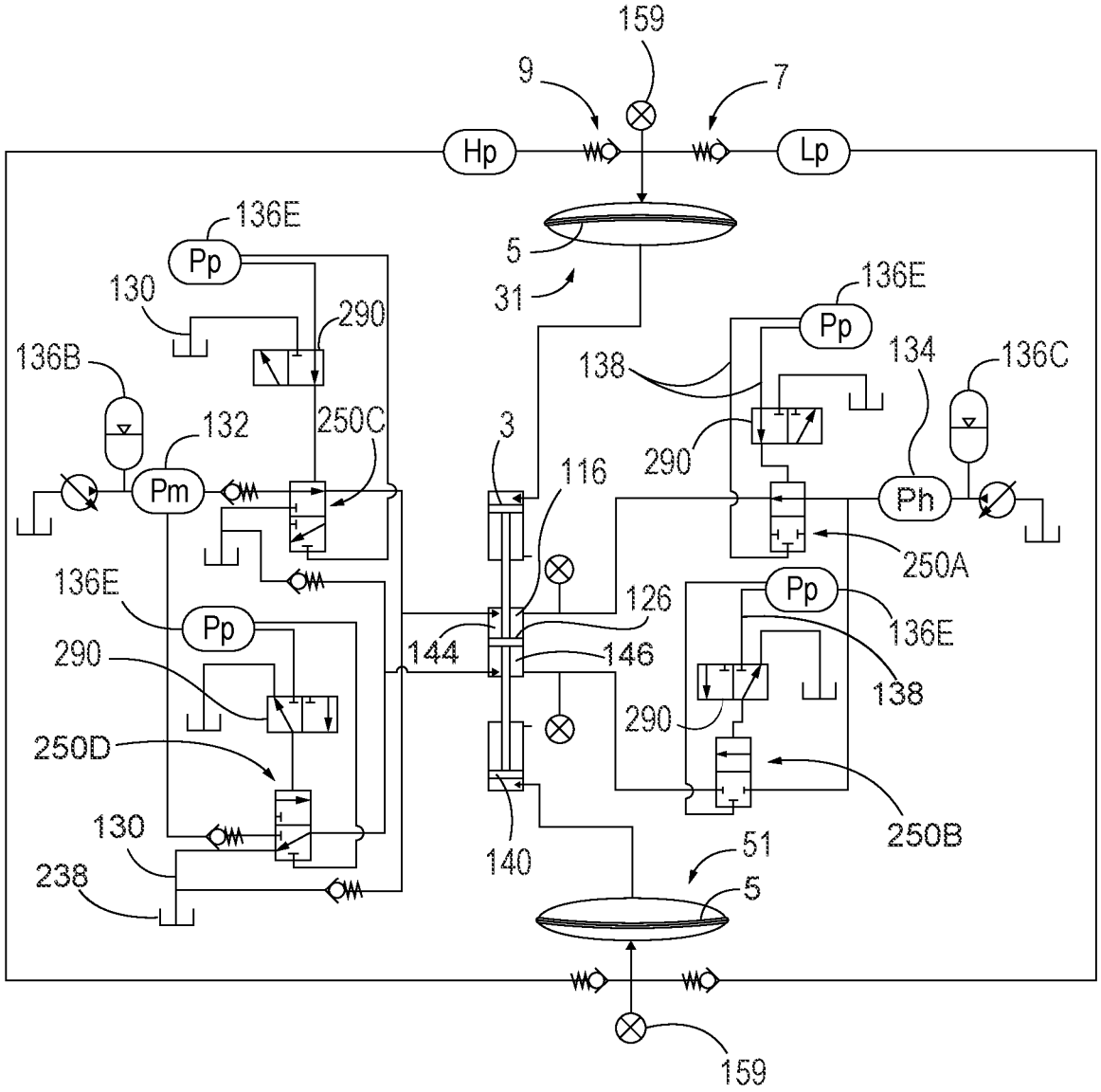
FIG. 15 is a hydraulic circuit diagram of a hydraulically-driven compressor module with three pressure rails in accord with embodiments of the present disclosure.

In some embodiments, the MSV 250 further comprises a pilot valve 290 configured to selectively actuate the pin subassembly 274 of the MSV 250. The pilot valve 290 controls a supply of pilot fluid (e.g., work oil at a pilot pressure) to the MSV 250 to move the pin subassembly 274. The pilot valve 290 in the illustrated embodiment is mounted in the second end 264 of the valve body 260 and is a multi-stage valve comprising a spool and two coils. In some embodiments, the hydraulic drive 110 further comprises a pilot pressure circuit 138 and a pilot pressure accumulator 136E operatively coupled to the pilot valve. The pilot pressure accumulator 136E in embodiments is charged in various ways such as a separate hydraulic unit, the HPU 118, or recovered intensified work oil vented from one or more MSVs 250. In some embodiments, the pilot valve 290 is a three-way valve or two two-way valves. In other embodiments, a different actuator or valve (not shown, for example a spool valve with one coil and one spring return, a piezoactuator, or servomotor) is implemented with the MSV 250 to selectively actuate the pin subassembly 274 of the MSV 250 to the supply position In embodiments, the pilot pressure circuit 138 is also operatively coupled to the pilot port 266 at the first end 262 of the valve body 260. In some embodiments, the pin subassembly 274 of the MSV 250 has a larger area proximate the pilot valve 290 than proximate the pilot port 266. Therefore, when pilot pressure is supplied to the pilot pin 278 through the pilot valve 290 and the pilot port 266, the pin subassembly 274 is configured to move to the supply position. In embodiments, the MSV 250 comprises a return spring 286 configured to bias the pin subassembly 274 toward the vent position when pressure is not supplied to the pilot valve 290. As shown in FIG. 15, each of multiple MSVs 250A-D may comprise a respective pilot valve 290.

Figure 17:
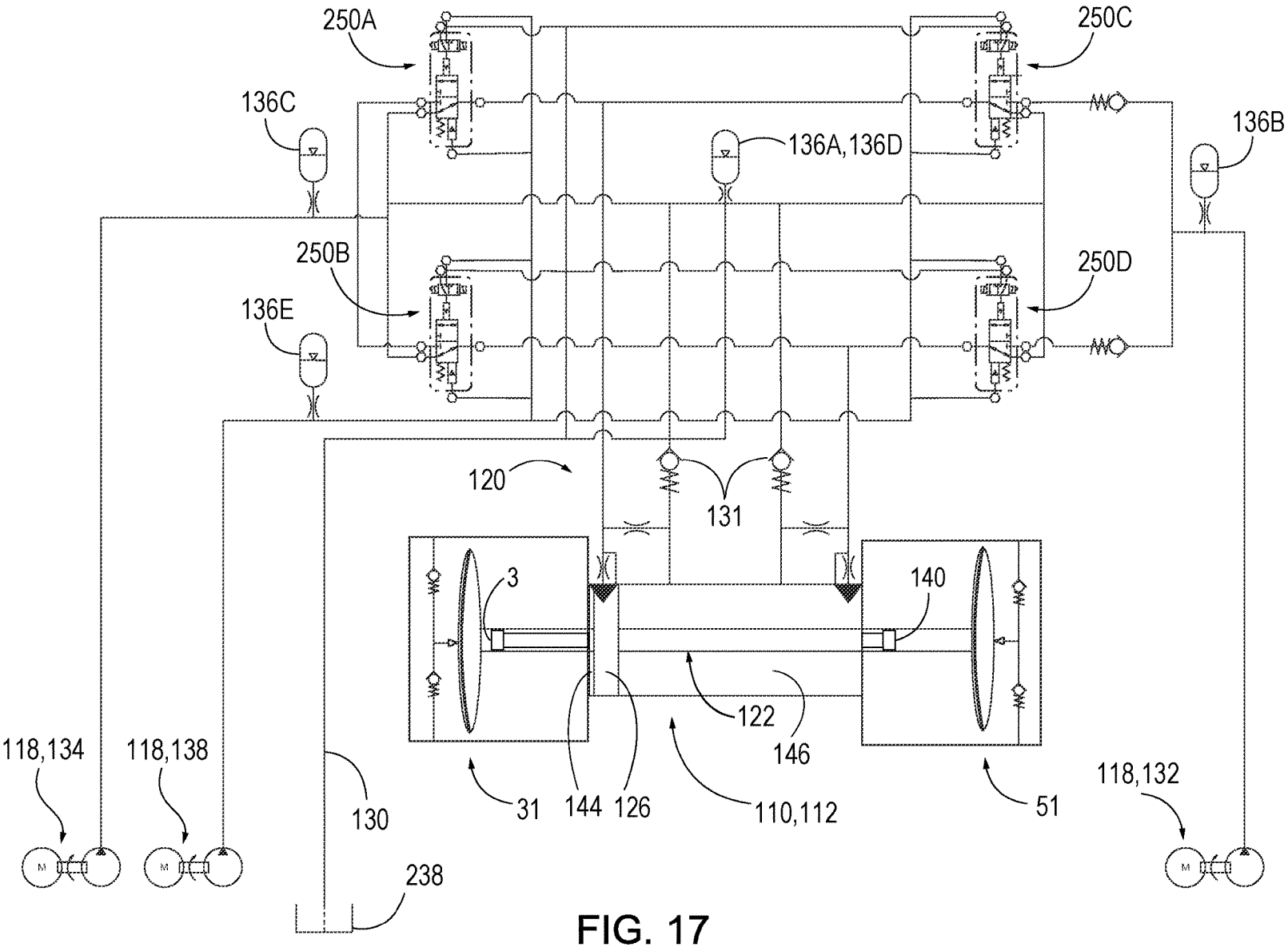
FIG. 17 is a hydraulic circuit diagram of a hydraulically-driven compressor module with three pressure rails in accord with embodiments of the present disclosure.

As noted above, some embodiments of the high-throughput compressor system 200 and/or the individual compressor modules 100 comprise multiple MSVs 250. Referring also to FIGS. 15-17, in embodiments a first MSV 250A is operatively coupled to the first actuation volume 144 of the drive cavity 116. A second MSV 250B is substantially similar to the first MSV 250A, and the second MSV 250B is mounted to the drive housing 114 with each of the vent port 270 and the cylinder port 272 in fluid communication with the second actuation volume 146 of the drive cavity 116 and the supply port 268 operatively coupled to the hydraulic power unit 118. The first MSV 250A is configured to selectively move to the supply position to connect the high-pressure circuit 134 to the second actuation volume 146, while the second MSV 250B is configured to selectively move to the respective supply position to connect the medium-pressure circuit 134 to the second actuation volume 146.

In other embodiments, four MSVs 250A-D are provided with a first MSV 250A connecting the high-pressure circuit 134 to the first actuation volume 144, a second MSV 250B connecting the high-pressure circuit 134 to the second actuation volume 146, a third MSV 250C connecting the medium-pressure circuit 132 to the first actuation volume 144, and a fourth MSV 250D connecting the medium-pressure circuit 132 to the second actuation volume 146.

In embodiments one or more of the MSVs 250A-D vents to the recovered oil accumulator 136D. In the illustrated embodiment, the third and fourth MSVs 250C, 250D are each configured to vent from the respective first or second actuation volume 144, 146 through the respective first vent port 170 to the accumulator 136D.

Figure 20:
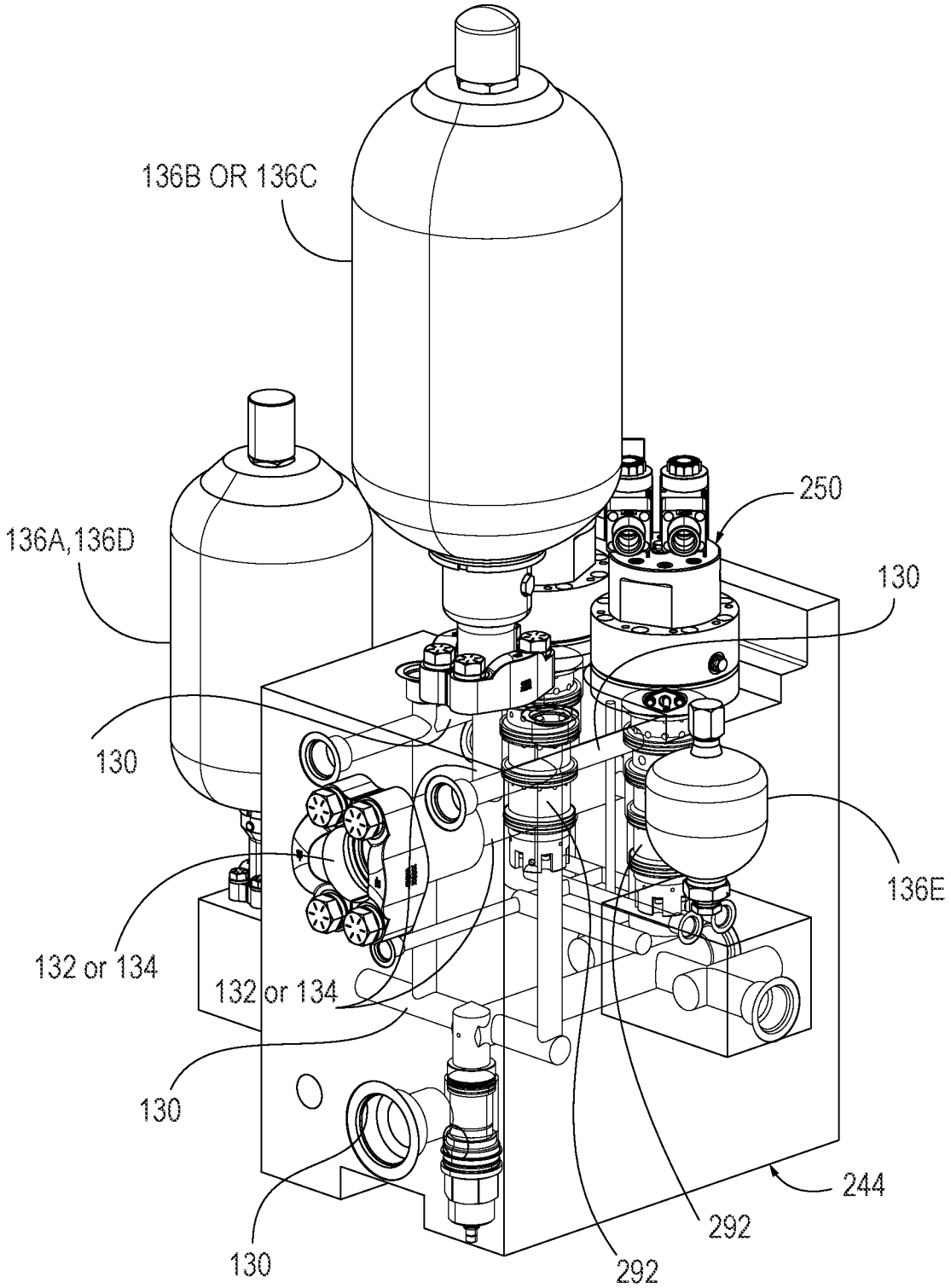
FIG. 20 is a top perspective wireframe view of a valve manifold of the compressor module of FIG. 2 in accord with embodiments of the present disclosure.

Referring to FIG. 20, the valve manifold 244 is illustrated with some of the corresponding hydraulic components and internal plumbing. The MSV 250 is mounted in a valve mount 292 that is plumbed to the operative ports of the MSV 250. The low-pressure circuit 130 is collected from several sources including each MSV 250 along with vented return from the hydraulic drive 110, these sources lead to the recovered oil accumulator 136D. The high-pressure crcuit 134 is ported externally from the HPU 118 (not shown, see also FIG. 29). Embodiments comprising the medium-pressure circuit 132 are similarly supplied by another HPU 118. It will be appreciated that the valve manifold 244 in embodiments may be operatively connected to multiple compressor modules 100, reducing the overall footprint of the diaphragm compressor system 200. In certain such embodiments, each MSV 250 is configured and operatively connected to the multiple compressor modules 100. In other such embodiments, the valve manifold 244 comprises one or more additional MSVs for the additional compressor module(s).

In some embodiments, the location and orientation of ports in the MSV 250 are selected to fit in the valve housing 244 (FIG. 20) while accommodating nearby components. In certain embodiments, pilot port 266, the supply port 268, and/or the first and second vent ports 270, 271 are arranged to allow work oil to enter and exit on a same side of the valve mount 292 (FIG. 20) that is opposite from the pilot pressure circuit 138 and other control components. Embodiments of the present disclosure provide sufficiently large flow areas through the ports to result in minimal or substantially no pressure drop of pressurized fluid passing through the MSV 250. In some embodiments, the MSV 250 is configured to accommodate pressures up to 5,000 psi and provides an effective flow area (CdA, i.e., discharge coefficient×area) of about 300 $mm^2$. In embodiments, the MSV 250 provides a CdA of about 275-325 $mm^2$, about 250-350 $mm^2$, about 200-400 $mm^2$, about 100-500 $mm^2$, at least 200 $mm^2$, at least 250 $mm^2$, or at least 300 $mm^2$. In embodiments, the MSV 250 is configured to accommodate pressures up to 15,000 psi.

In other embodiments, other valve types are employed in addition to or in lieu of the MSV 250, including poppet, spool, directional, proportional and servo valves, among others. Different types of valves could be used as MSV 250 to operate the system differently. In some embodiments, proportional valves control the flow into the system with a fixed supply pressure. In this way the valve could be used to speed up or slow down the travel of the hydraulic drive actuator to fit a desired profile or to reduce the velocity of the actuator 112 as it nears top dead center or bottom dead center.

In other embodiments, digital or on/off valves allow full flow to be supplied to (or vented from) the MSV 250 with a fixed flow area. As these valves open to the pressurized supply of work oil, the maximum flow area is exposed and allows full flow into the MSV 250 as dictated by the differential pressure across the valve. These valves are closed to shut off flow to the hydraulic actuator 112 for embodiments as a two-way valve. These valves can also vent the hydraulic actuator 112 for embodiments as a three-way valve. In still other embodiments, a variation of the digital on/off valve has multiple outlet ports that could be opened in series to allow flow to variable areas within the hydraulic drive. In this valve, the internal spool moves only a portion of its travel distance to open up flow to a single outlet port, then as the spool continues its travel additional outlet ports are opened. Operation of the digital valves can be achieved in several ways. In embodiments, the digital MSVs 250 are operated with a solenoid to drive the valve. In other embodiments, the digital MSVs 250 are operated with a set of two-way pilot valves to control the supply of pilot fluid to drive the valve spool. In other embodiments, the digital MSVs 250 are operated with a single three-way pilot valve to control the supply of pilot fluid to drive the valve spool. It will be appreciated that in embodiments, the MSVs 250 can be combinations of one or more of the above valve types.

Active Oil Injection System

Figure 33:
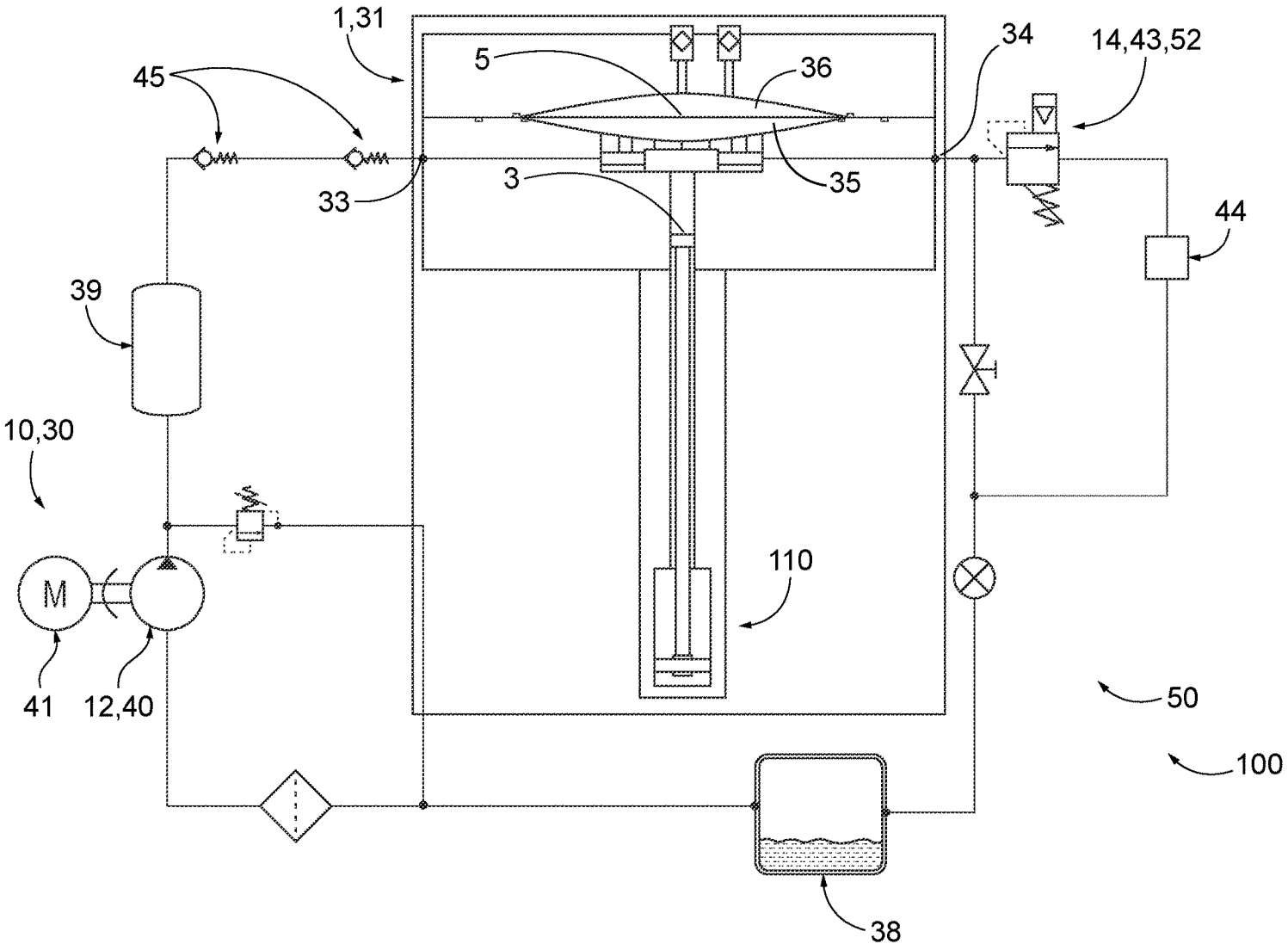
FIG. 33 is a schematic view of a hydraulically-driven compressor module with an active oil injection system in accord with embodiments of the present disclosure.

In some embodiments, the diaphragm compressor 1 employs a hydraulic injection pump system 10. The hydraulic injection pump system 10 comprises a pump 12, at least one oil check valve 45 and a fixed setting oil relief valve 14 as illustrated in FIG. 33. Other embodiments discussed below replace the fixed setting oil relief valve with a variable pressure relief valve 52 ("VPRV 52"). The injection pump system 10 primary function is to maintain the required oil volume between the high-pressure oil piston 3 and diaphragm set 5. During the compressor 1 (e.g., compressor head 31 or 51) suction stroke, a fixed volume of work oil is injected into the work oil region 35 of the compressor 1. This ensures a sufficient volume of oil is injected during each suction stroke to ensure the oil volume is maintained for proper compressor 1 performance.

In certain embodiments the oil volume between the diaphragm piston 3 and diaphragm 5 is impacted by two modes of oil loss. The first mode of oil loss is annular leakage past the diaphragm piston 3 (also referred to as a high-pressure oil piston) back to the drive housing 114 or an oil reservoir. This annular leakage may be most significant on high pressure compressors 1 operating above 5,000 psi. In some embodiments, the annular leakage varies during operation of the diaphragm compressor 1.

The second mode of oil loss is defined as "overpump" which is hydraulic flow over the oil relief valve 14 that occurs every cycle during normal compressor 1 operation. The injector pump system 10 is designed and operated to maintain an "overpump" condition through the relief valve 14 ensuring the diaphragms 5 are sweeping the entire compressor cavity 15 (i.e., completely or substantially discharging process gas from the process gas region 36) thereby maximizing volumetric efficiency of the compressor 1. Embodiments of the present disclosure comprise an injection pump system 10 that is actively controlled, referred to as an active oil injection system ("AOIS") 30 as further discussed below.

Some embodiments of the injection systems 10 are mechanically adjustable by a user to vary the injector pump's 12 volumetric flow rate into the compressor 1. However, this requires manual observations and adjustment. An incorrect volumetric displacement from the injection pump system 10 that does not sufficiently account for oil losses can lead to various machine failures.

In certain embodiments, the hydraulic relief valve 14 has a manually adjustable relief setting. These oil relief valves are set to a fixed oil relief pressure setting that is higher than the maximum process gas pressure. The maximum process gas pressure is the maximum expected pressure of the process gas for any particular use case. This elevated relief setting allows the diaphragm 5 to contact the process gas head support plate 6 firmly before any work oil flows over the relief valve 14, thus, assuring a complete sweep of the entire volume of the head cavity 15 at the highest expected pressure of the process gas. When the diaphragm reaches the top of the head cavity 15, the diaphragm piston 3 still has a pressure below the setting of the relief valve 14. During this period, the work oil in the work oil region 35 compresses further and the hydraulic pressure rises above the compressor gas discharge pressure until it reaches the setting of the oil relief valve 14. At this point, the relief valve 14 opens and oil, in the amount of the injection pump displacement (i.e., injection volume) less the annular leakage in the system, is displaced over the oil relief valve 14. This oil flow out of the relief valve 14 is defined as overpump. Because the annular leakage may vary during operation, in some embodiments the injection volume does not correlate or loosely correlates to the volume of overpump flow through the relief valve 14. In other embodiments, the injection volume corresponds or correlates to the volume overpump flow (for example, when the annular leakage has only minor variation, the annular leakage is variably estimated for different operating conditions, or the annular leakage is measured or otherwise detected).

Certain embodiments of the present invention include an active oil injection system 30 ("AOIS") in a diaphragm compressor 1. The feedback and control of the AOIS 30 allow the compressor system 100 to minimize any excess energy used while ensuring the complete sweep of the diaphragm 5 discussed above.

In certain embodiments, the compressor 1 forms a hydraulic circuit 50 connecting the outlet 34 of the work oil head support plate 8 to the inlet 33 of the work oil head support plate 8. In those embodiments, the hydraulic circuit may also include an oil reservoir 38 configured to collect overpumped work oil from the work oil region 35 via the outlet 34 of the work oil head support plate 8. By forming a hydraulic circuit, oil is circulated from the oil reservoir 38, through the inlet 33 and into the work oil region, and then out the outlet 34 and back into the oil reservoir 38. In another sense, work oil that exits the outlet 34 and passes through the oil relief valve 14 constitutes the overpumped work oil from the compressor 1.

In other embodiments, the hydraulic circuit also includes an AOIS 30 including a hydraulic accumulator 39 configured to provide a supply of supplemental work oil to the inlet 33 of the work oil head support plate 8. In certain embodiments, the hydraulic accumulator 39 may be a hydraulic volume or any style of hydraulic accumulator 39 such as a bladder, piston, or diaphragm gas over fluid style hydraulic accumulator 39. In still further embodiments, the AOIS includes an AOIS pump 40 in communication with the hydraulic accumulator 39, the AOIS pump 40 configured to produce a variable volumetric displacement of the supplemental work oil from the oil reservoir 38 to the hydraulic accumulator 39 or directly to the inlet 33. As used herein, variable volumetric displacement means that the AOIS 30 can provide a variable volumetric flow (i.e. injection quantities of supplemental work oil via the pump 40) and/or an independently variable speed (i.e., flow rate via the motor 41), to the work oil region 35 depending on the particular process conditions of the compressor 1 (e.g., compressor head 31). This allows for variable injection quantities during the compressor's 1 operation to maintain the compressor's 1 oil volume most efficiently within the compressor 1, and particularly the work oil region 35. In certain embodiments, the AOIS 30 includes the AOIS pump 40 operatively coupled to the hydraulic accumulator 39, and a motor 41 configured to power the AOIS pump 40 independently from the hydraulic drive 110. In other words, the speed and control of the motor 41 is completely independent from, and not mechanically linked to, the hydraulic drive 110 that powers the diaphragm piston 3.

In certain embodiments, the AOIS 30 utilizes the existing pressure dynamics within the compressor 1 to satisfy the hydraulic flow requirements into the compressor 1, and particularly into the work oil region 35. As the compressor 1 transitions through its suction and discharge cycles, the AOIS pump 40 charges and discharges the hydraulic accumulator 39. During the compressor's 1 suction stroke, this lower pressure condition within the compressor 1, including the work oil region 35, creates a positive pressure differential between the hydraulic accumulator 39 and the oil within the compressor head 31, and particularly in the work oil region 35. During this suction condition, hydraulic flow goes through the oil inlet check valves 45 and through inlet 33 into the work oil region 35 satisfying the injection event. During this time, the pump 40 may be continuously pumping into the hydraulic accumulator. During this discharge stroke, the hydraulic pressure within work oil region 35 is greater than the pressure in the hydraulic accumulator 39 therefore there is no flow from the hydraulic accumulator 39 into the compressor. At least one check valve 45, and in some embodiments at least two check valves 45, prevent backflow from the work oil region 35 into the hydraulic accumulator 39 and beyond. During this this condition, the hydraulic flow from the AOIS pump 40 pressurizes the hydraulic accumulator 39 in preparation for the next injection event.

Further embodiments include a variable pressure relieve valve (VPRV) 52, which includes a pressure relief mechanism 42 operatively coupled to the work oil region 35 of the diaphragm cavity 15, the pressure relief mechanism 42 including a pressure relief valve 43 in communication with the outlet 34 of the work oil head support plate 8 and configured to relieve an outlet volume of the pressurized work oil from the work oil region 35. In these embodiments, the pressure relief valve 43 includes a hydraulic relief setting corresponding to an overpump target condition of the pressurized work oil relative to the process gas discharge pressure. In some embodiments, the overpump target condition corresponds to a maximum process gas discharge pressure. In other words, the overpump target condition corresponds to a maximum process gas discharge pressure that the compressor head 31 is configured to operate at, so that the process gas region 36 is configured to be completely evacuated by the diaphragm 5 at maximum gas discharge pressure.

In certain embodiments, during an oil relief event during the discharge cycle, the relief valve 43 opens and oil, in the amount of the injection volume per revolution less the annular leakage in the system, is displaced over the oil relief valve 14, defined as overpump. During this time, the hydraulic flow from the AOIS pump 40 pressurizes the hydraulic accumulator 39 in preparation for the next injection event during the next suction cycle.

However, in certain embodiments, the pressure relief valve 43 is configured to actively adjust the hydraulic relief setting of the pressure relief valve to correspond to an overpump current condition. In other words, the pressure relief valve 43 is configured to adjust the hydraulic relief setting up or down corresponding to a relative increase or decrease in gas discharge pressure. This prevents the compressor head 31 from experiencing more overpump than necessary to completely evacuate the process gas region 36 by the diaphragm 5 under conditions with a gas discharge pressure less than the maximum gas discharge pressure. Adjustability of the hydraulic relief setting may enable longer machine life expectancy and better system efficiency due to lower cyclic stresses and lower alternating loads during the compressor's 1 discharge and suction cycles.

Certain embodiments of the AOIS 30 include an injector pump 40 and hydraulic accumulator 39 without a VPRV 52, while other embodiments include both systems.

In certain embodiments, the AOIS 30 includes a feedback mechanism configured to control the AOIS pump 40 to maintain the overpump target condition of the work oil region 35. The feedback mechanism includes a measurement device 44 that provides feedback to verify the over pump condition is being met to control the injector pump system 30. In certain embodiments, the feedback mechanism includes a first measurement device 44 operatively coupled to the diaphragm compressor 1, the measurement device configured to detect and/or measure the overpump current condition of the intensified work oil flowing out of the outlet 34 from the work oil region 35. In certain embodiments, the feedback mechanism is configured to adjust the volumetric displacement of the injector pump 40 to the hydraulic accumulator 39 in response to the overpump current condition.

Turndown ratio refers to the operational range of a device, and is defined as the ratio of the maximum capacity to minimum capacity. In certain embodiments of the AOIS 30, the AOIS is configured to provide a large turndown ratio of supplemental work oil relative to the work oil 4 in the work oil region 35 of the compressor 31. By separating the functions of the hydraulic drive 31 and the AOIS pump 40, a large turndown ratio can be achieved allowing for significant adjustability of injection quantity to tightly control the amount of overpump through the relief valve 43 over a wide range of operating conditions.

In embodiments, the overpump target condition ranges from 0.1%-500% above a measured process gas discharge pressure. In various embodiments, the overpump target condition ranges from about 0.1%-100% above, 0.1%-50% above, 0.1%-40% above, 0.1%-30% above, 0.1%-20% above, 1%-20% above, or 1%-50% above the measured process gas discharge pressure.

ALTERNATIVE EMBODIMENTS

Some embodiments incorporate commonality of parts and assemblies between stages 202 even though the later stages may have larger compressor heads, higher pressure rails/circuits, and the like. Specifically, such items as valve manifolds 244, MSVs 250, and other hydraulic components can be common for cost and simplicity purposes. Additionally, the clamping mechanism 204 may have duplicate components or similar primary components with minor deviations to accommodate adapting and mating to specific stages.

In other embodiments, the first and second compressor heads 31, 51 are driven by two separate hydraulic actuators 112 instead of a single hydraulic actuator, and the two hydraulic actuators may be configured to act in parallel or phase with each other such that the discharge and suction cycles of the first and second compressor heads 31, 51 occur substantially simultaneously. Although certain embodiments of the disclosed compressor modules 100 are hydraulically driven, in other embodiments, other modes of actuating the diaphragms 5 may be implemented. In embodiments, one or more compressor modules 100 may be driven by a crank-slider mechanism (not shown) or other mechanism.

Applicable to any embodiments disclosed herein, the terms "upward" and "downward" are used for convenience in reference to the figures for explaining examples of motion, but are not meant to be limiting. In embodiments, the diaphragm piston 3, diaphragm 5, and other components may move in any direction relative to each other, for example left and right, inward and outward, and the like. In embodiments, the diaphragm piston 3 may move perpendicularly or otherwise angled relative to the diaphragm 5 or relative to the actuator piston 126 or other components of the hydraulic drive 110, so long as actuation movement of the diaphragm piston 3 pressurizes work oil against the diaphragm. In embodiments, the diaphragm piston 3 or intermediate pistons 183 may move in a direction away from or offset from the diaphragm 5. In other words, by referring to the movement of the piston as the terms "upward" and "downward" with respect to the diaphragm 5 or the compressor head, those terms may be understood as "toward" and "away from," respectively, or may understood as "pressurizing the work oil" and "depressurizing the work oil," respectively, or "discharge cycle" and "suction cycle," respectively.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A diaphragm compressor system, comprising:

a first compressor head comprising:

a head cavity, and a diaphragm mounted in the head cavity and dividing the head cavity into a work oil region and a process gas region, the diaphragm configured to actuate from a first position to a second position during a discharge cycle to pressurize process gas in the process gas region from an inlet pressure to a discharge pressure, and discharge the pressurized process gas through the first compressor head;

a hydraulic drive configured to pressurize work oil and provide the pressurized work oil to the first compressor head, the hydraulic drive comprising:

a drive housing comprising:

a drive cavity, a plurality of ports, the plurality of ports comprising a first distal port and a second distal port, wherein the hydraulic drive is configured to provide a variable-pressure supply of work oil to the drive cavity through one or more of the plurality of ports, a first plurality of orifices in communication with both the drive cavity and one or more ports of the plurality of ports, and a second plurality of orifices in communication with both the drive cavity and one or more ports of the plurality of ports, and a piston subassembly comprising:

a first diaphragm piston mounted in the drive cavity and comprising a first diameter, wherein a first variable volume region comprises the work oil region of the first compressor head and is defined between the first diaphragm piston and the diaphragm of the first compressor head, and an actuator piston located in the drive cavity, the actuator piston dividing the drive cavity into a first actuation volume in communication with the first distal port and the first plurality of orifices and a second actuation volume in communication with the second distal port and the second plurality of orifices, the actuator piston comprising a first side oriented toward the first actuation volume and a second side oriented toward the second actuation volume, wherein, during the discharge cycle of the first compressor head:

the hydraulic drive is configured to provide the variable-pressure supply of work oil through the second distal port to the second actuation volume to press against the second side of the actuator piston to drive the actuator piston, driving the first diaphragm piston to actuate the corresponding first compressor head, intensifying the work oil in the first variable volume region to an intensified pressure, and actuating the diaphragm of the first compressor head to the second position, the drive cavity is configured to dampen the driving of the actuator piston due to a volume of work oil in the first actuation volume that vents through the first plurality of orifices during driving of the actuator piston, and the first plurality of orifices is configured to be open to the first actuation volume when the driving of the actuator piston begins, and the first plurality of orifices being progressively covered by the actuator piston during the driving, increasing a damping force of work oil remaining in the first actuation volume against the first side of the actuator piston.

2. The diaphragm compressor system of claim 1, the drive housing further comprising a plurality of supplemental orifices in communication with the first actuation volume, the plurality of supplemental orifices being staggered axially relative to the first plurality of orifices, and the drive cavity is configured to dampen the driving of the actuator piston due to the volume of work oil in the first actuation volume that vents through the plurality of supplemental orifices during driving of the actuator piston.

3. The diaphragm compressor system of claim 2, wherein each of the plurality of supplemental orifices comprise a smaller area than the each of the first plurality of orifices.

4. The diaphragm compressor system of claim 3, wherein the plurality of supplemental orifices are configured to be progressively covered by the actuator piston during the driving, increasing the damping force of work oil remaining in the first actuation volume against the first side of the actuator piston.

5. The diaphragm compressor system of claim 1, wherein the actuator piston is configured to drive in a linear direction along an actuator piston axis, and the first plurality of orifices is formed in one or more surfaces of the drive housing oriented at a non-parallel angle relative to the actuator piston axis.

6. The diaphragm compressor system of claim 5, wherein the plurality of first orifices extend radially away from the drive cavity and the actuator piston.

7. The diaphragm compressor system of claim 1, further comprising one or more plugs installed in one or more orifices of the first plurality of orifices to increase the damping force of the first actuation volume.

8. The diaphragm compressor system of claim 1, further comprising an annular gap between the actuator piston and the drive housing, the annular gap configured to dampen the driving of the actuator piston by maintaining work oil in the first actuation volume during the discharge stroke.

9. The diaphragm compressor system of claim 8, the annular gap configured to dampen the driving of the actuator piston after the first plurality of orifices are obstructed by the actuator piston.

10. The diaphragm compressor system of claim 1, the actuator piston comprising a first internal porting and a first opening in the first side, wherein the first distal port is selectively in fluid communication with the first actuation volume via the first internal porting.

11. The diaphragm compressor system of claim 10, wherein, during the discharge cycle of the first compressor head, the work oil in the first actuation volume also vents through the first internal porting of the actuator piston during driving of the actuator piston, wherein the first distal port is configured to receive both the vented work oil from the first plurality of orifices and the vented work oil from the internal porting, and wherein the hydraulic drive is configured to fill an accumulator of a low-pressure circuit from the vented work oil in the first distal port.

12. The diaphragm compressor system of claim 11, further comprising a landing orifice operatively connecting the first distal port and a first proximal port, the landing orifice configured to control the flowrate of work oil venting through the first internal porting.

13. The diaphragm compressor system of claim 1, further comprising a feedback mechanism configured to determine at least one of a position and velocity of the actuator piston during use.

14. The diaphragm compressor system of claim 13, the actuator piston comprising a variable-geometry portion, and the feedback mechanism comprising a sensor configured to detect a distance from the variable-geometry portion during the driving of the actuator piston.

15. The diaphragm compressor system of claim 13, the feedback mechanism comprising a pressure sensor operatively coupled to process gas in the first compressor head or discharged therefrom, the feedback mechanism configured to determine the velocity of the actuator piston based on the pressure of the discharged process gas.

16. The diaphragm compressor system of claim 1, the first actuation volume in direct communication with a first proximal port, and the second actuation volume in direct communication with a second proximal port.

17. The diaphragm compressor system of claim 1, the drive housing further comprising a removable sleeve insert, wherein the sleeve insert comprises a first distal annulus in fluid communication between the first actuation volume and the first distal port and a second distal annulus in fluid communication between the second actuation volume and the second distal port.

18. The diaphragm compressor system of claim 17, the sleeve insert further comprising:

a first proximal annulus in fluid communication between the first actuation volume and the first proximal port; and a landing orifice operatively connecting the first distal annulus and a first proximal annulus, the landing orifice configured to control the flowrate of work oil venting through the first proximal annulus.

19. The diaphragm compressor system of claim 1, wherein the first plurality of orifices comprises twelve or more orifices, and wherein the second plurality of orifices comprises twelve or more orifices.

20. The diaphragm compressor system of claim 1, wherein both of the first and second plurality of orifices are in communication with at least one of the ports of the plurality of ports, and both of the first and second plurality of orifices are configured to:

during a stroke of the actuator piston toward the corresponding first or second actuation volume of the drive cavity, vent work oil from the same corresponding first or second actuation volume to the at least one of the ports, and during a stroke of the actuator piston in the opposite direction, supply work oil from the at least one of the ports to the drive cavity to pressurize the same corresponding first or second actuation volume.

* * * * *